US006183071B1

(12) United States Patent
Sugimoto et al.

(10) Patent No.: US 6,183,071 B1
(45) Date of Patent: Feb. 6, 2001

(54) INK JET RECORDING APPARATUS AND METHOD FOR RECORDING INFORMATION WITH BLEND OF PLURAL TYPES OF INK AND INK TANK USED IN THE SAME

(75) Inventors: Hitoshi Sugimoto, Yokohama; Miyuki Matsubara, Tokyo; Fumihiro Gotoh, Kawasaki; Hidehiko Kanda; Hiromitsu Hirabayashi, both of Yokohama; Toshio Kashino, Chigasaki; Noribumi Koitabashi; Yuji Akiyama, both of Yokohama; Takeshi Okazaki, Sagamihara, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 08/857,331

(22) Filed: May 16, 1997

Related U.S. Application Data

(63) Continuation of application No. 08/217,288, filed on Mar. 24, 1994, now abandoned.

(30) Foreign Application Priority Data

Mar. 24, 1993 (JP) ..... 5-065518
May 31, 1993 (JP) ..... 5-129278

(51) Int. Cl.[7] ..... B41J 2/175
(52) U.S. Cl. ..... 347/85; 347/7; 347/98
(58) Field of Search ..... 347/85, 84, 98, 347/43, 6, 7, 15, 100

(56) References Cited

U.S. PATENT DOCUMENTS

| | | | | |
|---|---|---|---|---|
| 3,476,874 | * | 11/1969 | Loughren | 347/3 X |
| 4,109,282 | * | 8/1978 | Robertson | 358/296 |
| 4,313,124 | | 1/1982 | Hara . | |
| 4,345,262 | | 8/1982 | Shirato et al. . | |
| 4,459,600 | | 7/1984 | Sato et al. . | |
| 4,463,359 | | 7/1984 | Ayata et al. . | |
| 4,494,128 | * | 1/1985 | Vaught | 347/43 X |
| 4,558,333 | | 12/1985 | Sugitani et al. . | |
| 4,608,577 | | 8/1986 | Hori . | |
| 4,672,432 | * | 6/1987 | Sakurada | 347/43 X |
| 4,723,129 | | 2/1988 | Endo et al. . | |
| 4,740,796 | | 4/1988 | Endo et al. . | |
| 4,757,331 | * | 7/1988 | Mizusawa | 347/85 |
| 5,142,374 | | 8/1992 | Tajika et al. | 347/43 X |
| 5,245,362 | * | 9/1993 | Iwata | 347/23 |

FOREIGN PATENT DOCUMENTS

| | | | | |
|---|---|---|---|---|
| 59-138461 | | 8/1968 | (JP) | B41J/3/04 |
| 54-56847 | | 5/1979 | (JP) | B41M/5/26 |
| 56-92092 | * | 7/1981 | (JP) | B41M/5/00 |
| 58-1562 | * | 1/1983 | (JP) | B41J/3/04 |
| 59-123670 | | 7/1984 | (JP) | B41J/3/04 |
| 60-71260 | | 4/1985 | (JP) | B41J/3/04 |
| 403284954 | * | 12/1991 | (JP) | B41J/2/175 |
| 40-4338554 | * | 11/1992 | (JP) | B41J/2/21 |

* cited by examiner

*Primary Examiner*—Joseph W. Hartary
(74) *Attorney, Agent, or Firm*—Fitzpatrick, Cella, Harper & Scinto

(57) ABSTRACT

An ink jet recording apparatus which performs recording using a plurality of types of inks which are different in nature such as level of thickness, improved to attain excellent gradation of recorded image with a reduced number of ink types which are prepared beforehand. In one form, a clear ink which does not contain any dye is mixed with an ink which contains dye so as to form an ink blend of a density which can be set by varying the mixing ratio. The ink blend thus formed is supplied to a recording head. The invention also provides an ink jet recording apparatus which permits inks of different compositions to be blended within the recording apparatus so a to enable selection of ink composition which is optimum for the image to be recorded or purpose of use.

40 Claims, 52 Drawing Sheets

INK JET RECORDING APPARATUS AND METHOD FOR RECORDING INFORMATION WITH BLEND OF PLURAL TYPES OF INK AND INK TANK USED IN THE SAME

This application is a continuation of application Ser. No. 08/217,288 filed Mar. 24, 1994, now abandoned.

BACKGROUND OF THE INVENTION

1. Field of the Invention

The present invention relates to an ink jet recording apparatus, as well as to a method, for recording information on a recording medium by jetting a recording liquid onto the recording medium. More particularly, the present invention is concerned with an ink jet recording apparatus and an ink jet recording method which use, as the recording liquid, a blended ink formed by mixing a plurality of types of ink. The present invention is also concerned with an ink supply system.

2. Description of the Related Art

In general, conventional ink jet recording systems employ a recording head having a plurality of ink discharge openings from which ink droplets are discharged in accordance with data to be recorded towards the recording medium so as to be deposited on the latter to record the data. This type of recording system is used in, for example, printers, facsimile machines and copying machines.

Various ink discharging techniques are available for discharging the ink as the recording liquid. For instance, a heat generating element (referred to as an "electro-thermal transducer") in the ink channel near the discharge opening. In operation, an electrical signal is applied to the heat-generating element to locally heat the ink so as to generate a bubble in the ink, thereby causing a pressure change in the ink channel to discharge the ink in the form of a droplet. Another discharge technique incorporates an electro-mechanical conversion element such as a piezoelectric element.

Techniques are also known for recording halftone images or information using one of the known discharge methods described above. For instance, a method referred to as dot-density control method is known in which halftone recording is realized by controlling the density per unit area of dots of a constant size formed by the ink droplets. In another method known as dot-size control method, half-tone is realized by controlling the size of the recording dots.

Since the latter method, i.e., the dot-size control method, requires a complicated control to achieve delicate variation of dot size, the former method, i.e., dot-density recording method, is used more broadly.

Recording heads incorporating the above-mentioned electro-thermal transducers can be produced comparatively easily and can perform recording with high level of resolution by virtue of this ability to attain high dot density. In this type of recording head, however, it is rather difficult to delicately control the level of pressure generated by the electro-thermal transducer and, therefore, it is impossible to modulate the dot size in accordance with the information to be recorded. Consequently, this type of recording head cannot suitably be used in dot-size control type recording operation.

For the reasons stated above, dot-density control method is used as a primary recording method rather than the dot-size control method. The ordered dither method is known as one of the typical binary coding methods for realizing halftone image recording. This method, however, has a shortcoming in that the number of levels of tone or gradation is limited by the matrix size. That is to say, a larger of matrix is required to obtain a greater number of gradation levels. A larger matrix size undesirably increases the size of one pixel of recorded image constituted by one matrix, resulting in problems such as degradation of resolution.

A conditioned determination type dither method such as the error diffusion method also has been known as another binary coding method. The above-mentioned structural dither method is an independent determination type dither method which uses a binary-coding threshold independent of the input pixel, and the conditioned determination dither method varies the threshold level taking into consideration the values of pixels around the pixel in interest. The conditioned determination dither method, represented by error diffusion method, is advantageous in that gradation and resolution are made compatible at high levels and in that generation of unwanted moiré patterns in the image recorded from a printed image is greatly reduced. This method, however, suffers from a disadvantage in that coarseness of recording dots is noticeable particularly in bright regions of the recorded image, thus degrading the quality of the image. This problem is serious particularly when the recording density is low.

In order to make the coarseness of dots less noticeable, a recording method has been proposed which employs a pair of recording heads: namely, one for discharging an ink having a low dye concentration, i.e., an ink which is of a comparatively light color and which produces an image of a comparatively low thickness on the recording medium (referred to as "thin ink", hereinafter) and one for discharging an ink having a high dye concentration, i.e., an ink which is of a comparatively dark or thick color and which produces an image of a comparatively thick image on the recording medium.

According to this multi-level tone recording method using plural types of ink having different levels of thickness of the same color, the gradation is improved particularly in the highlighted region of the recorded image when the number of levels is increased, with the result that the coarseness of dots becomes less noticeable, thus improving the image quality. This is because the highlighted portion of the image is formed by light color ink dots which are inconspicuous.

FIG. 1A is a schematic perspective view of an example of a conventional ink jet recording apparatus which relies upon the above-mentioned multi-level tone method.

Referring to FIG. 1A, a carriage 706 carries eight ink tanks 701 containing, respectively, thin and thick ink of black, cyan, magenta and yellow colors. The carriage 706 also carries a multi-head 702 having eight heads for discharging these different types of ink.

FIG. 1B illustrates the discharge openings of one of the heads on the multi-head 702, as viewed in the direction of the arrow Z, i.e., from the reverse side of the drawing sheet, of FIG. 1A.

The thick and thin inks of black, cyan, magenta and yellow are represented here by Kk, Ku, Ck, Cu, Mk, Mu, Yk and Yu. These discharge openings are arranged in parallel arrays in the direction of the arrow Y. These arrays, however, may be slightly inclined within the X-Y plane. In such a case, the discharge of inks from the respective discharge openings is conducted with predetermined time lags or delay, while the head 702 travels in the direction of the arrow X.

Referring again to FIG. 1A, a sheet feed roller 703 rotates in the direction of the arrow to cooperate with an auxiliary roller 704 in feeding a recording paper sheet 707 in the direction of the arrow y while imparting a certain level of tension to the sheet 707. Numeral 705 denotes another sheet feed roller which feeds the recording paper sheet 707 and functions to impart a certain level of tension to the recording sheet 707 in a manner similar to the roller pair 703, 704. The carriage 706 is stationed at a home position "h" illustrated by broken line when recording is not conducted and when a discharge recovery operation is being conducted. A recovery mechanism (not shown) such as capping means holds the multi-head in a predetermined condition.

The carriage 706 stationed at the home position "h" commences its movement in the direction of the arrow X along a carriage guide shaft 798, in response to a record start instruction. During the movement of the carriage, thick and thin inks of four colors are selectively discharged from the n discharge openings 801 of the multi-head 702, based on a carriage position signal which is produced by a linear encoder 709 in accordance with the travel of the carriage, whereby an image fraction of a width corresponding to the width D of the arrays of the discharge openings on the recording head. As a result of this scanning operation, ink droplets reach the recording sheets in such an order or sequence of colors that begins with the thick black ink, followed by thin black ink, thick cyan ink, light cyan ink, thick magenta ink, thin magenta ink, thick yellow ink and then by the thin yellow ink, whereby dots of these inks are formed on the recording paper sheet. When the recording is finished down to the end of the recording paper sheet, the carriage 706 is returned to the home position "h" and then again commences travelling in the direction of the arrow X. In the period between two successive passes of the head for recording, the sheet feed roller 703 rotates in the direction of the arrow so that the sheet is fed in the direction of the arrow y by a distance corresponding to the above-mentioned recording width. Thus, recording over the above-mentioned recording width and sheet feed by a distance corresponding to the recording width are executed in each reciprocating scanning motion of the carriage 706, whereby the data is recorded on the recording paper sheet.

The above-described recording method, which utilizes thick and thin inks, suffers from the following problems to be solved.

Firstly, it is to be pointed out that the described recording method requires the use of two types of ink, i.e., thick and thin inks, for each of the colors to be used. For instance, eight types of inks, as well as eight ink tanks, are needed when recording with four colors. This undesirably increases the size of the recording apparatus, and poses troublesome complications in the production and administration of the inks. In addition, the user is obliged to prepare and store a large number of ink storage and supply means such as ink tank cartridges.

The second problem is as follows.

In general, an ink jet recording apparatus cannot provide image density which is higher than that of a silver salt photograph. Therefore, when the ink jet recording apparatus is used in a copying machine or the like, it cannot reproduced with sufficient accuracy an original image if a silver salt photograph is used as the original. In recent years, performance of host computers connectable to an ink jet recording apparatus has been much improved, and there is an increasing demand for directly printing the image displayed on the display unit of the host computer. Known ink jet recording apparatuses cannot satisfactorily cope with this demand because the dynamic range of printed images printed by an ink jet recording apparatus is narrower than that of the image displayed on the computer display.

Ink jet recording apparatuses also suffer from a disadvantage in that, when a thick ink is used in order to attain a high density of recorded image, the ink discharge openings tend to be clogged with the ink which has become viscous or solidified due to evaporation of the solvent, resulting in ink discharge failure. Consequently, there is a practical limit in the increase of the ink thickness.

Thus, an ink jet recording system is required to record image with high levels of gradation and resolution within a restricted range of density, because this type of recording system can provide only a narrow range of recorded image density. This problem also is encountered in the aforementioned method which employs thick and thin inks.

It is also to be pointed out that the image quality tends to be degraded according to the composition of the solvent used in the ink.

It has been recognized that the quality of print of characters printed by an ink jet recording apparatus also varies largely depending on factors such as the type of the ink, type of the recording sheet and the combination thereof. When the ink jet recording method is used for color recording, it is necessary to use expensive special paper in order to obtain a color image of high quality having no bleeding at the boundary between regions of different colors. To obviate this problem, a study has been made in recent years to develop inks with which color printing can be done on ordinary paper sheet such as bond paper sheets or copies paper. Despite such a development, however, the quality of color printing by ink jet recording method is still unsatisfactory and further improvement in required.

Penetration and spreading of ink droplets on copies or bond paper, as well as some degree of bleeding of colors at the boundary region, can be varied by changing the composition of the solvent used in the ink.

In general, an ink which exhibits a small degree of spreading provides a high density of the dots and, hence, can suitably be used in printing sharp images such as those of characters, thin lines and so forth. This type of ink, however, exhibits only a low rate of penetration into the paper, allowing undesirable blurring at the boundary between regions of different colors. Conversely, an ink which exhibits a large degree of spreading of dots cannot produce sharp images so this type of ink is not suitable for use in printing characters and thin lines. This type of ink, however, is suitable for printing color image because of its lower tendency to blur at the boundary region.

In general, sharpness of characters and thin lines and suppression of blurring at the boundary region are incompatible with each other in the recording on an ordinary paper sheet. Namely, an ink which provides high quality of print of character exhibits a large tendency toward blurring at the boundary, whereas an ink which provides clear distinction between colors at the boundary region cannot provide high quality of print of characters.

Thus, no ink has been proposed and used which would enable recording of color images with a high degree of sharpness of characters and thin lines without substantial blur at the boundary between regions of different colors.

It would be possible to prepare two ink tanks: one containing an ink suitable for printing characters and one containing an ink suitable for recording color image, to enable the user to selectively use one of these ink tanks according to the recording purpose. Such a solution, however, inconveniently causes user confusion.

Installation of such plural ink tanks in a signal recording apparatus undesirably increases the number of the recording heeds, as well as the number of tanks and associated parts, particularly when a plurality of colors are to be used as in color recording, as is the case of the multi-color printing with thin and thick inks of each color described before.

The above-described problems are serious, especially in a recording apparatus which, in order to improve gradation, uses plural inks of different dye concentrations for each of plural colors, because such an apparatus requires troublesome work for producing and maintaining inks and ink tanks and undesirably burdens the users due to the necessity of preparing many ink tanks containing different types of inks.

SUMMARY OF THE INVENTION

In view of the problems of the known art as described, it is an object of the present invention to provide an ink jet recording apparatus and an ink jet recording method of the type which use a plurality of type of inks which are different in nature such as levels of thickness, improved to achieve high gradation of the recorded image with reduced number of type of inks which are prepared beforehand.

To this end, according to one aspect of the present invention, there is provided an ink jet recording apparatus for performing recording by means of a recording head having ink discharge opening arrays each having a plurality of ink discharge openings, comprising: ink storage means for separately storing a plurality of types of inks; mixing and supplying means for mixing inks selected from the plurality of types of inks to form an ink blend and for supplying the ink blend to the recording head; and mixing ratio setting means for setting the ratio of mixing of the inks performed by the mixing and supplying means.

The invention in its aspect provides, as means of mixing inks, an ink tank for supplying inks to a recording head having arrays of ink discharge openings each having a plurality of ink discharge openings, comprising: partitioning means provided in the ink tank to divide the space inside the ink tank into a plurality of ink chambers for separately storing a plurality of type of inks; and ink supply holes formed in the bottom of the ink tank for supplying the plurality of types of inks therethrough, the ink supply holes being separated and divided by the partition means so that different ink chambers have different areas of opening of the ink supply holes so that the ratio of rates of supply of inks from the ink chambers is determined in accordance with the ratio of areas of openings of the ink supply holes associated with the ink chambers.

According to the invention, by virtue of the features stated above, it is possible to obtain and use greater number of thickness levels or colors of inks than those of the inks which are initially prepared, in accordance with the parameters such a image density distribution of the image to be recorded.

It is also an object of the present invention to provide an ink jet recording apparatus which, with a simple arrangement, enables blending of inks having different compositions so as to enable the user to select the optimal ink compositions for the particular use.

To this end, the invention in its further aspect provides an ink jet recording apparatus which performs recording by means of a recording head having a plurality of ink discharge openings, comprising: a plurality of ink storage means for storing different types of inks auxiliary ink storage means associated with the recording head; ink mixing means for mixing inks selected from the plurality of types of inks to form an ink blend and for supplying the ink blend to the auxiliary ink storage means; and mix control means for controlling the mixing of the inks performed by the ink mixing means.

These and other objects, features and advantages of the present invention will become clear from the following description of the preferred embodiments taken in conjunction with the accompanying drawings.

DESCRIPTION OF THE PREFERRED EMBODIMENTS

Embodiments of the present invention will be described in detail with reference to the accompanying drawings.

(First Embodiment)

Figure 1A:
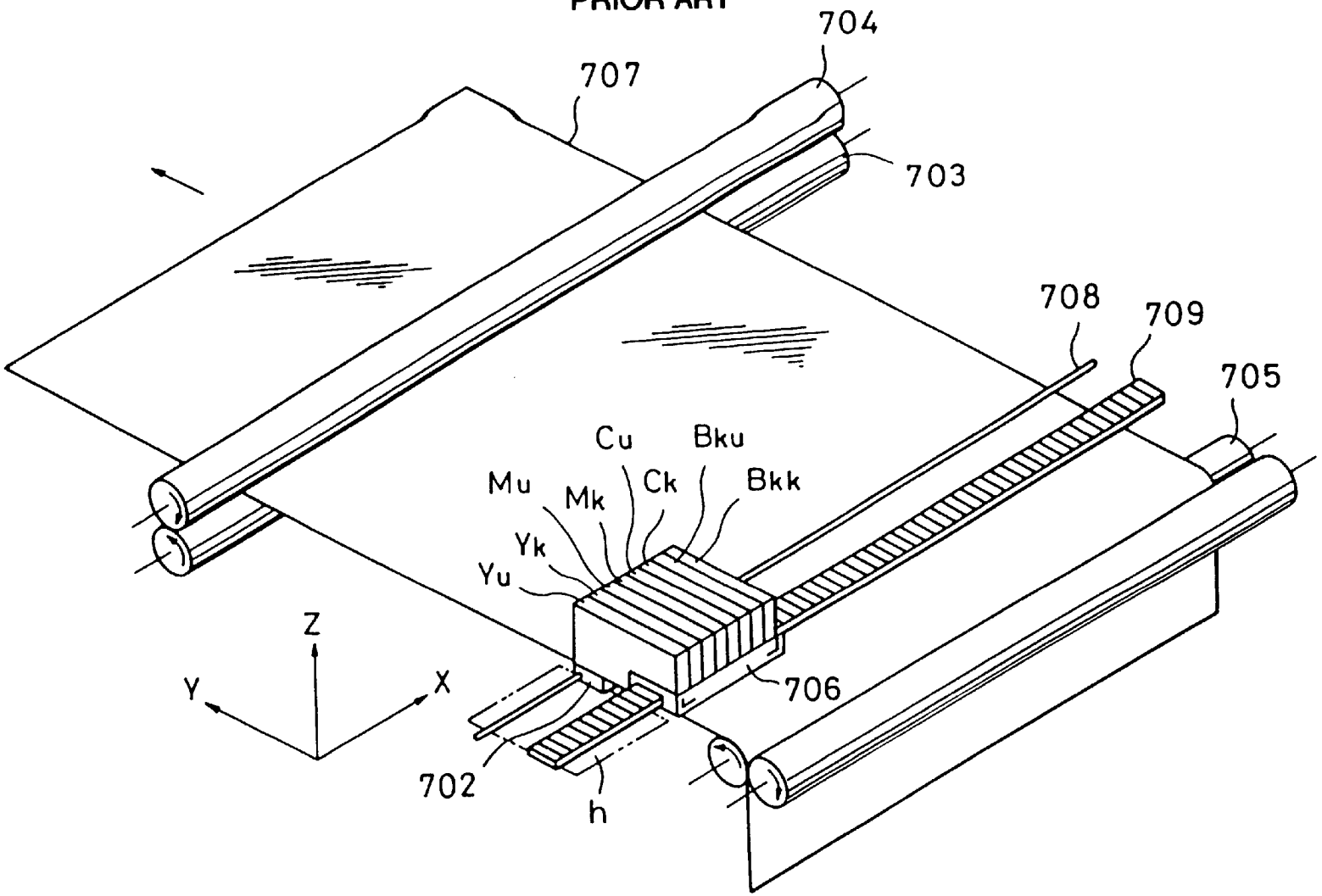
FIG. 1A PRIOR ART
FIG. 1A is a schematic perspective view of a conventional ink jet recording apparatus.
Figure 1B:
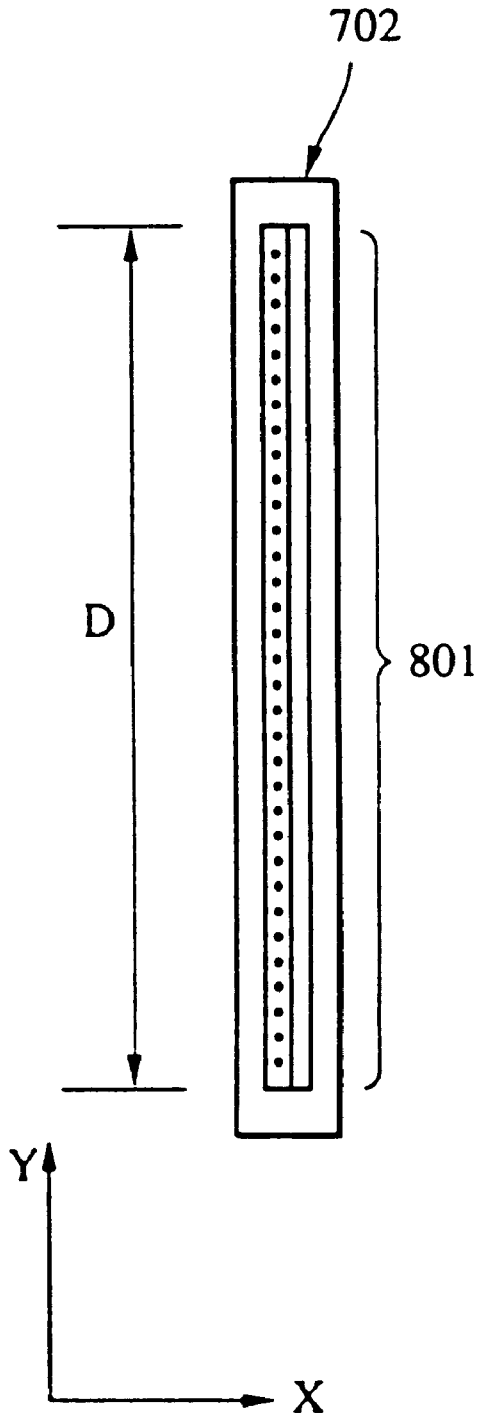
FIG. 1B PRIOR ART
FIG. 1B is a bottom plan view of a portion of the apparatus shown in FIG. 1, illustrating particularly an array of ink discharge openings formed in one of the heads of a multi-head unit used in the apparatus shown in FIG. 1.
Figure 2:
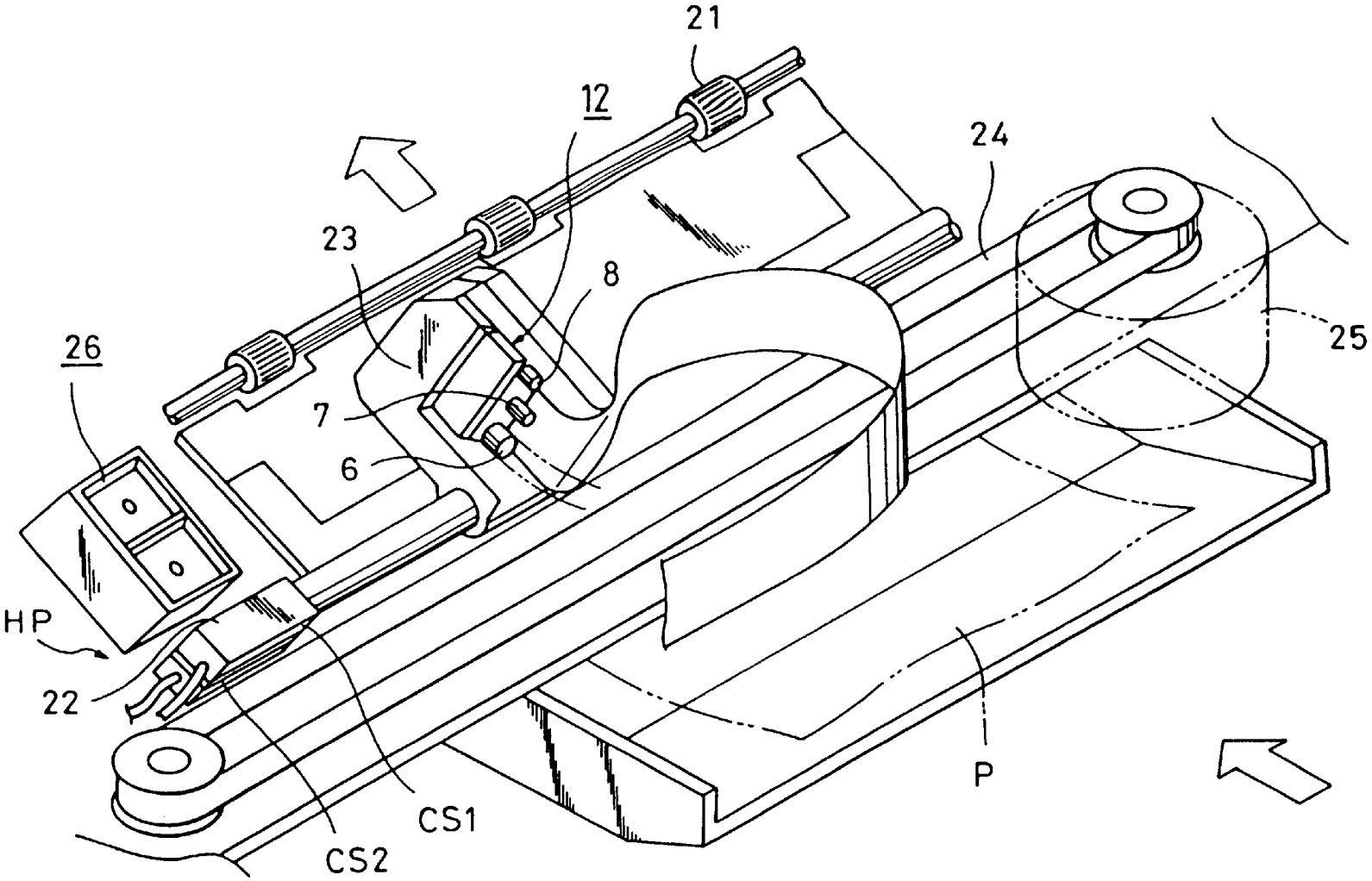
FIG. 2 is a perspective view of a first embodiment of the ink jet recording apparatus in accordance with the present invention.
Figure 3:
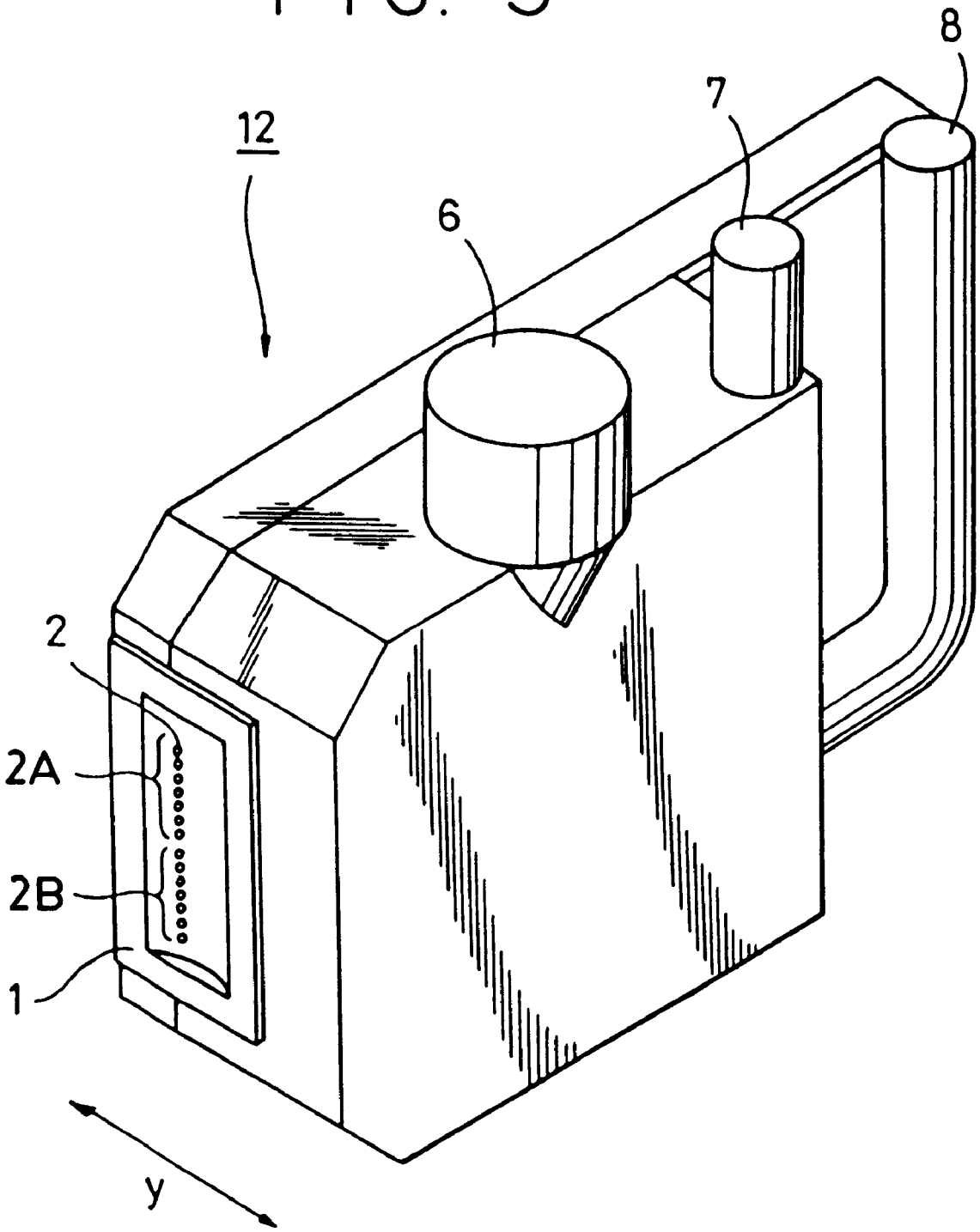
FIG. 3 is a schematic perspective view of a recording head used in the apparatus shown in FIG. 2.

FIG. 2 is a perspective view of an embodiment of the ink jet recording apparatus of the present invention, showing critical portions of the same, while FIG. 3 is a schematic perspective view of a recording head used in this embodiment.

As shown in FIG. 3, a recording head 12 has an array of thick ink discharge openings 2A and an array of thin ink discharge openings 2B. The recording head 12 is carried by a carriage 23. A recording member P such as a recording paper sheet, shown in FIGS. 2 and 5, or a thin plastic sheet is fed onto a surface opposing the recording head 12 by the operation of a feed roller (not shown), and is moved in the direction of an arrow by the cooperation between the feed roller and paper. The carriage 23 is adapted to move while being guided by a guide shaft 22. More specifically, the carriage 23 is driven by a carriage motor 25 through a drive belt 24 so as to reciprocally move along the guide shaft 22. Heat-generating elements (referred to also as electrothermal transducers) are arranged in ink channels which are provide in the recording head in communication with respective discharge openings.

The heat-generating elements are driven in accordance with timing read by an encoder (not shown) which is laid along the path of movement of the carriage 23, whereby inks are discharged onto the recording member P thereby performing recording. As will be explained later, ink discharge is conducted such that thick and thin inks are adjusted in real time.

A recovery unit having a cap 26 is disposed at a home position HP which is provided outside the region in which the carriage 23 move during the recording. When recording is not conducted, the carriage 23 is moved to the home position HP so that the surface 1 of the recording head 12 in which the discharge openings 2 are formed (see FIG. 3) is capped with the cap 26, whereby the evaporation of solvent is suppressed to prevent clogging of the discharge openings 2 due to thickening of the ink, as well as introduction of foreign matter.

At the same time, purging discharge may be conducted from the recording head 12 against the cap 26, thereby preventing discharge failure or clogging of a discharge opening or openings which are used comparatively infrequently. A suction recovery operation also may be conducted by applying a vacuum between the recording head surface 1 and the cap 26 on the surface 1, thereby sucking and removing thickened ink. A wiping blade may be disposed adjacent to the cap 26 so that the surface 1 of the recording head 12 is rubbed and wiped by the blade so as to be cleaned when the recording head 12 is moved.

Supply control units CS1 and CS2 for controlling the ratio of supply of the inks are disposed in the vicinity of the home position HP, in order to control the ratio between the rate of supply of a clear ink containing no colorant and an ink containing a colorant, as will be described later. The recording head 12 has supply ports 8 and 7 which are adapted to be connected to certain portions of the supply ratio control units CS1 and CS2 in accordance with the movement of the recording head 12.

Figure 4:
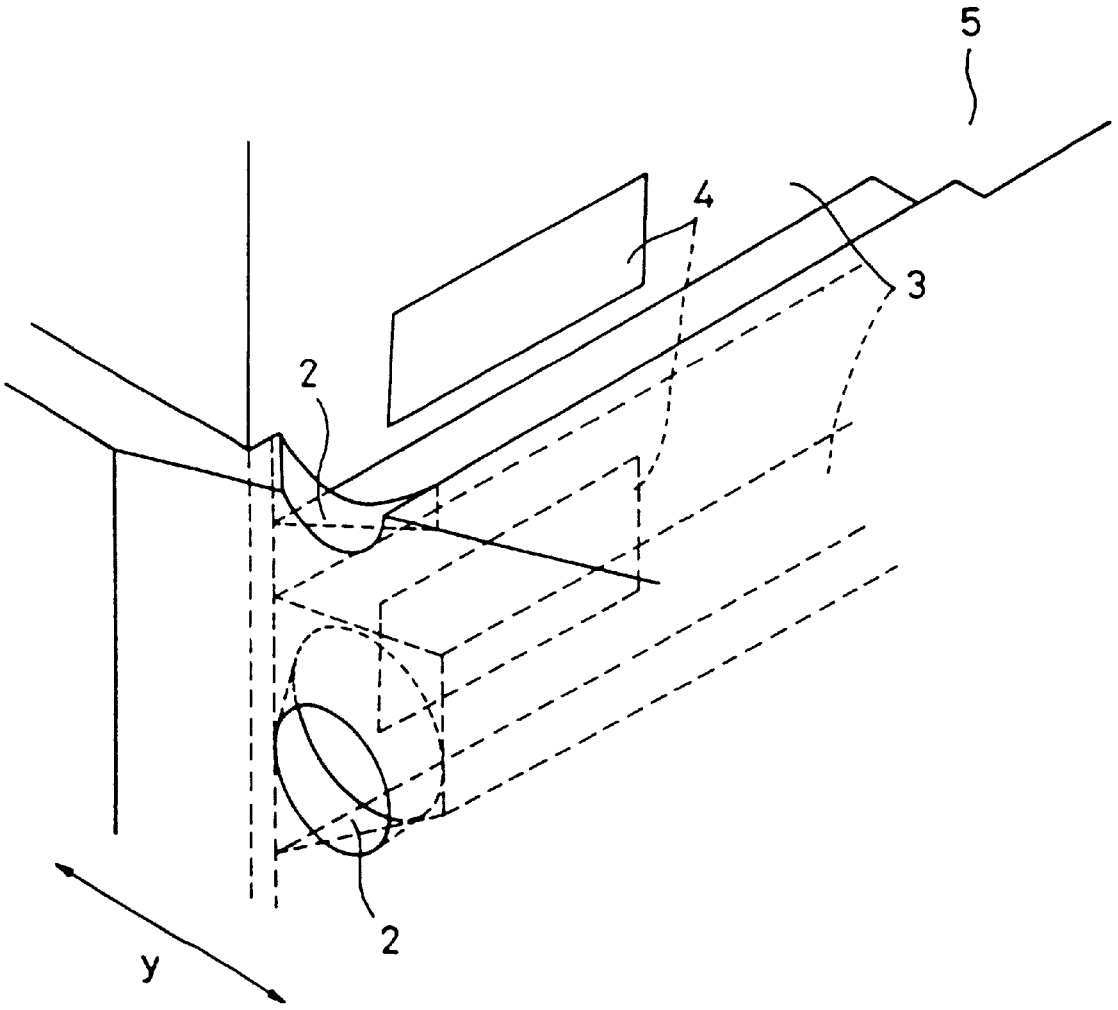
FIG. 4 is a schematic fragmentary perspective view of the construction of an ink discharge portion of the recording head shown in FIG. 3.

FIG. 3 is a schematic perspective view of the recording head 2 as viewed from the underside, i.e., from the same side as the surface 1 having the discharge openings, while FIG. 4 is a fragmentary perspective view schematically showing the construction of the portion of the recording head near a discharge opening.

As will be seen from these Figures, a plurality of discharge openings 2 are formed in the surface 1 of the recording head and ink channels 3 are formed to communicate with the respective discharge openings 2. The aforementioned heat-generating elements 4 are disposed in each of the ink channels 3. In FIGS. 3 and 4, a symbol "y" indicates the direction of the scanning movement of the carriage 23.

The ink channels 3 communicate with a common ink chamber 5 at their ends opposite to the discharge openings 2. Separate ink chambers 5 are used for thick and thin inks.

Each common ink chamber 5 is supplied with an ink or inks directly from plural ink tanks (not shown), or indirectly through the supply ratio control units CS1 and CS2, via the ink supply ports 6, 7 and 8. In the illustrated embodiment, ink containing a colorant (dye) is supplied through the supply port 6, while ink containing the colorant and a clear ink free of colorant are supplied through the supply ports 7 and 8. The ink supplied through the supply port 6 is a thick ink, while the inks supplied through the supply ports 7 and 8 are mixed and stirred in the ink chamber 5 so as to form a thin ink.

The control of the mixing ratio between the ink containing the colorant and the ink free of the colorant conducted by the control units CS1 and CS2 is effected by using manual valves so that the user can mix these inks at any desired mixing ratio. This arrangement is advantageously used particularly when the levels of thickness of the thick and thin inks are to be maintained for a predetermined period. The supply ports 8 and 7 are brought to positions near the home position in accordance with the scanning movement of the carriage, so as to be jointed to the supply control units CS1 and CS2, respectively. During the recording operation, the supply port 6 is held in connection with an ink tank which contains the ink (not shown) containing a colorant. Although in the illustrated embodiment the supply of the ink through the supply port 6 is conducted from an ink tank which is mounted separately from the ink tank, the ink tank for supplying the ink via the supply port 6 may also be carried by the carriage.

By recording with the thick and thin inks supplied in the manner described, it is possible to obtain a record image of density levels which satisfies the user's demands or provides an image of the quality required.

(Modification of First Embodiment)

A description will now be given of application of the described first embodiment to a color ink jet recording apparatus, with specific reference to FIGS. 5 to 11.

Figure 5:
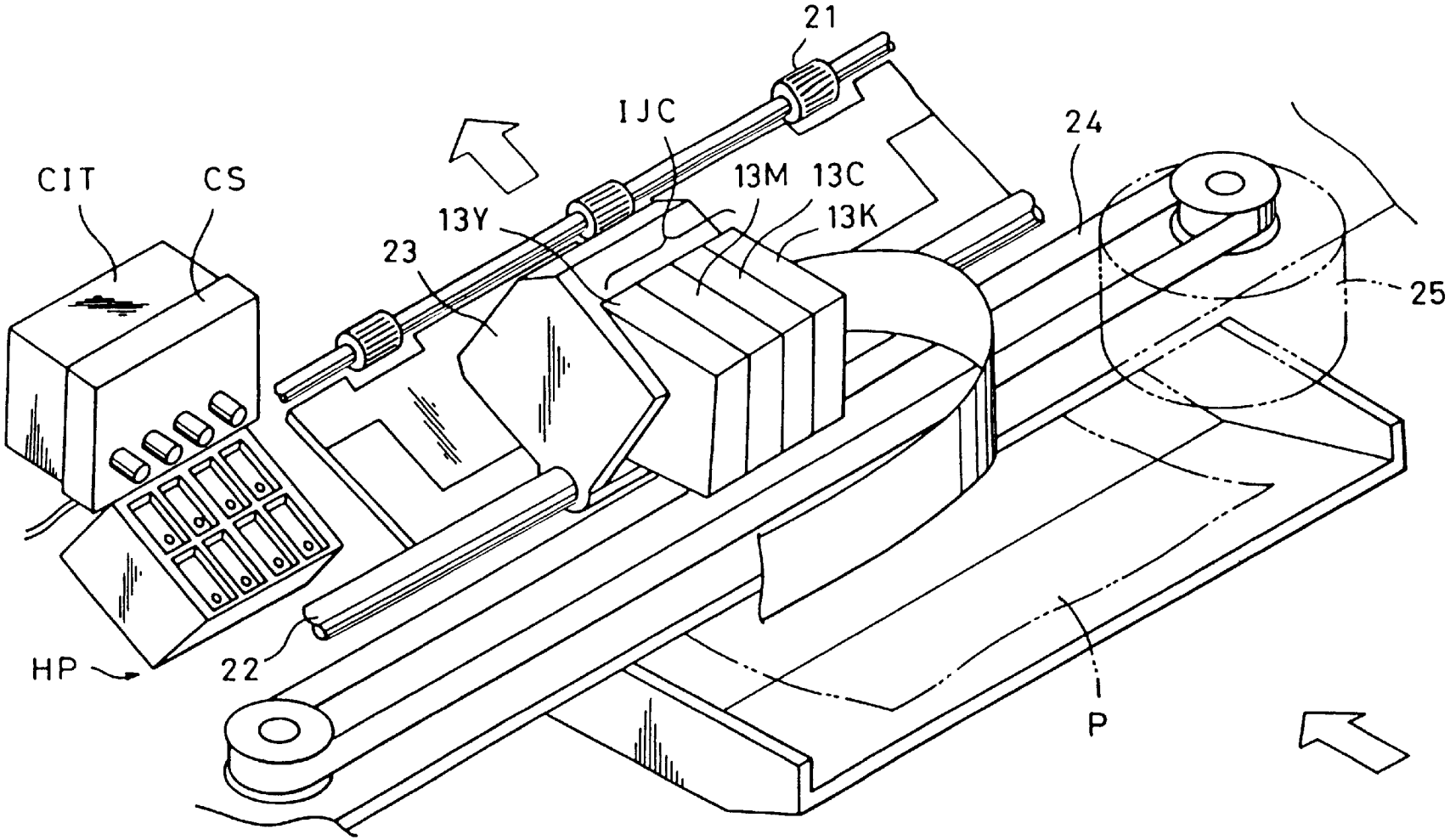
FIG. 5 is a schematic perspective view of a color ink jet recording apparatus as a modification of the first embodiment.

FIG. 5 is perspective view illustrating the critical portion of a color ink jet recording apparatus as a modification of the first embodiment. This apparatus operates basically in the same manner as the first embodiment as described.

Figure 6:
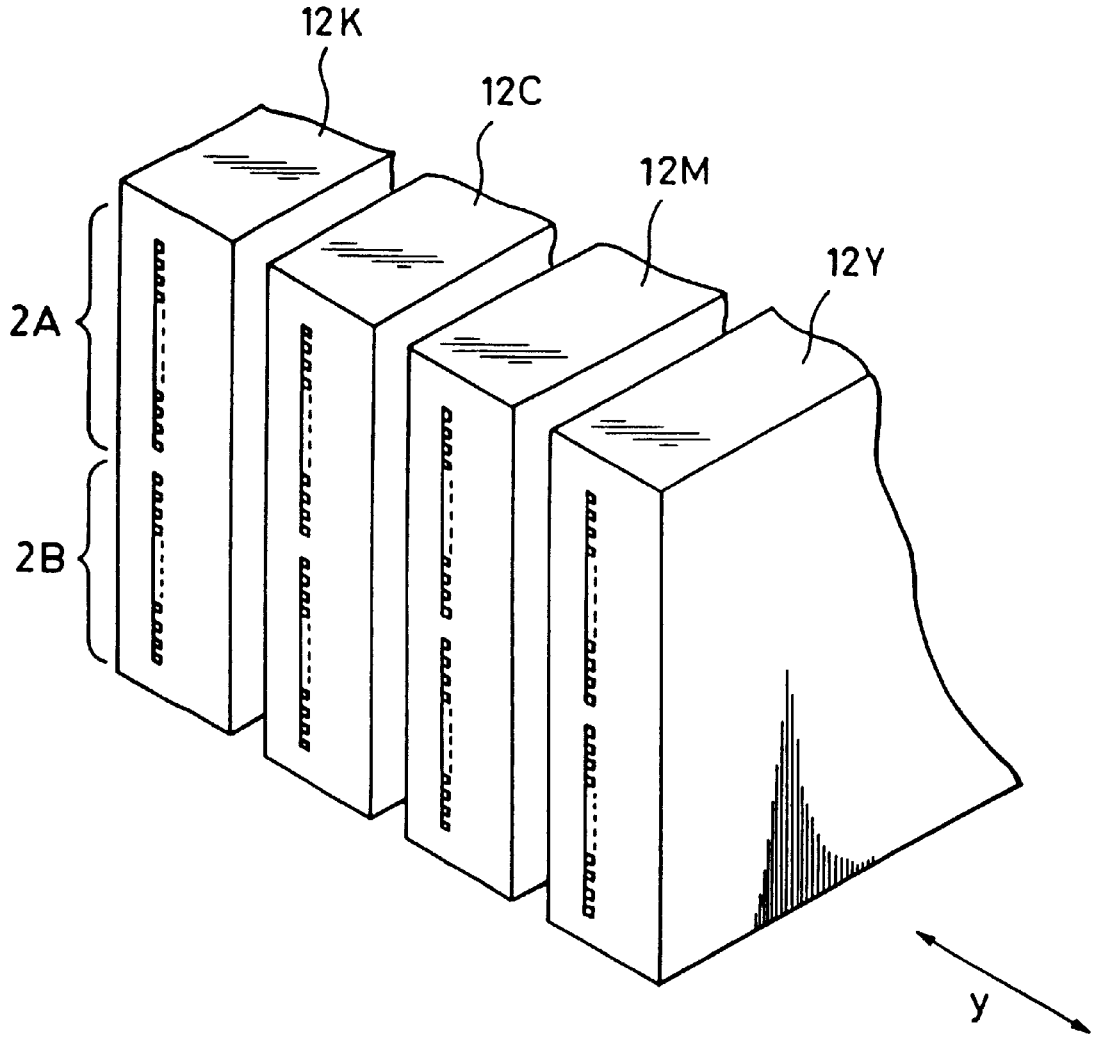
FIG. 6 is a schematic perspective view of arrays of ink discharge openings in the recording head as viewed from the same side of the recording head as a recording paper sheet.

FIG. 6 is a schematic perspective view of a recording head used in the apparatus shown in FIG. 5, as viewed in the direction opposing the surface in which ink discharge openings are formed.

The carriage 23 carries four recording head 12C, 12M, 12Y and 12K of four colors, i.e., cyan (C), magenta (M), yellow (Y) and black (K), which are illustrated in FIG. 6. Each of the recording heads are provided with an array of discharge openings 2A for discharging thick ink and an array of discharge openings 2B for discharging thin ink of each color. The carriage 23 also carries ink tanks 13Y, 13M, 13C and 13K which store inks to be supplied to the respective recording heads.

In general, when recording with inks of different thickness levels, it is very important that the ink dots of the thick ink and the ink dots of the thin ink are precisely formed with high positional accuracy. The density of the image may undesirably deviate when the droplets of the respective inks do not precisely hit the target positions. In the first embodiment, as well as in the modification which is being described, discharge openings for inks of different thickness levels of a color are formed in a common recording head so that thick and thin inks are handled in the same recording head. This arrangement eliminates miss-registration of ink dots both in vertical and horizontal directions, thus preventing any deviation of density gradation which otherwise may be caused due to offset of the ink droplets from target positions.

Figure 7:
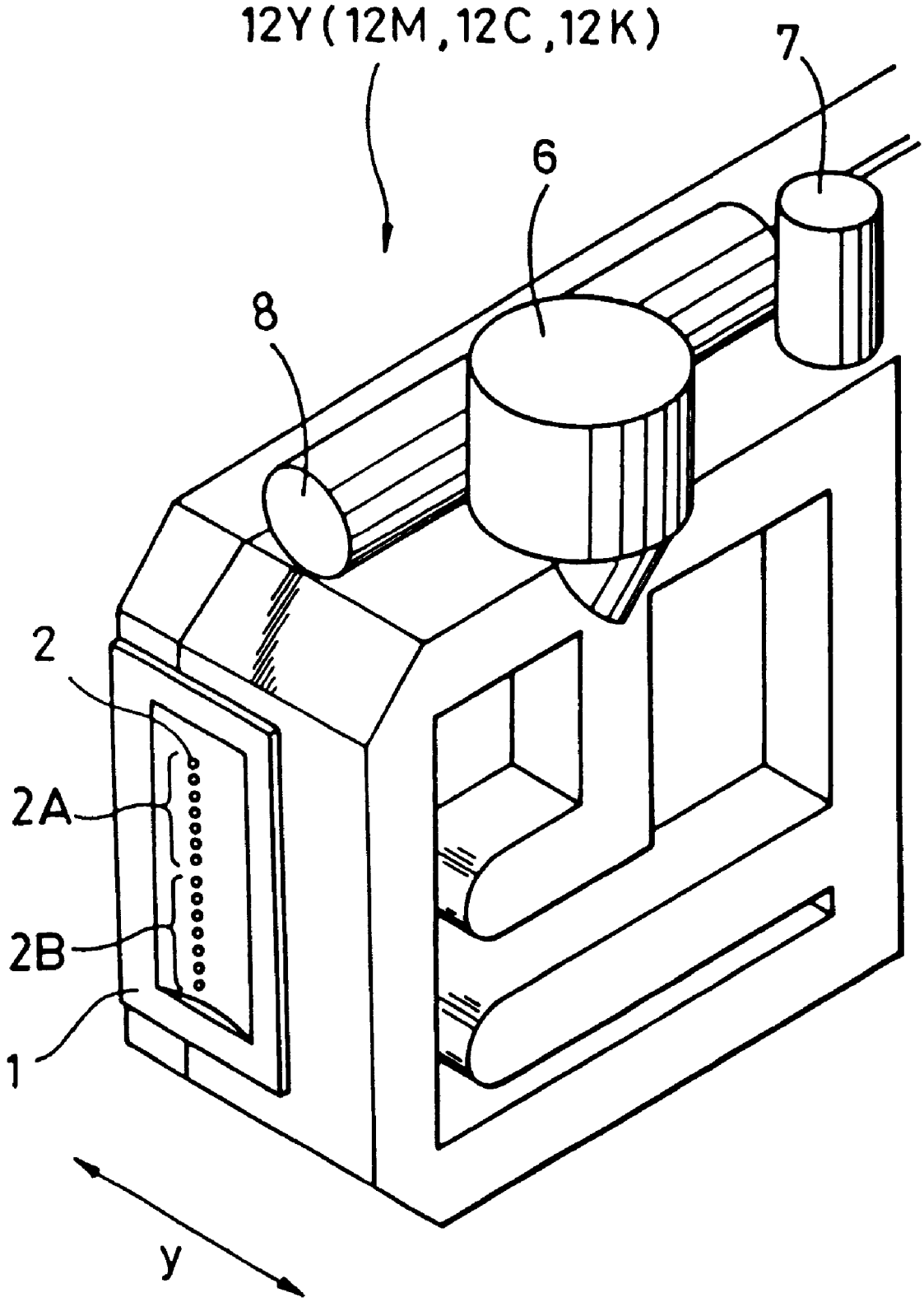
FIG. 7 is a schematic perspective view of the recording head used in the modification shown in FIG. 5.
Figure 8:
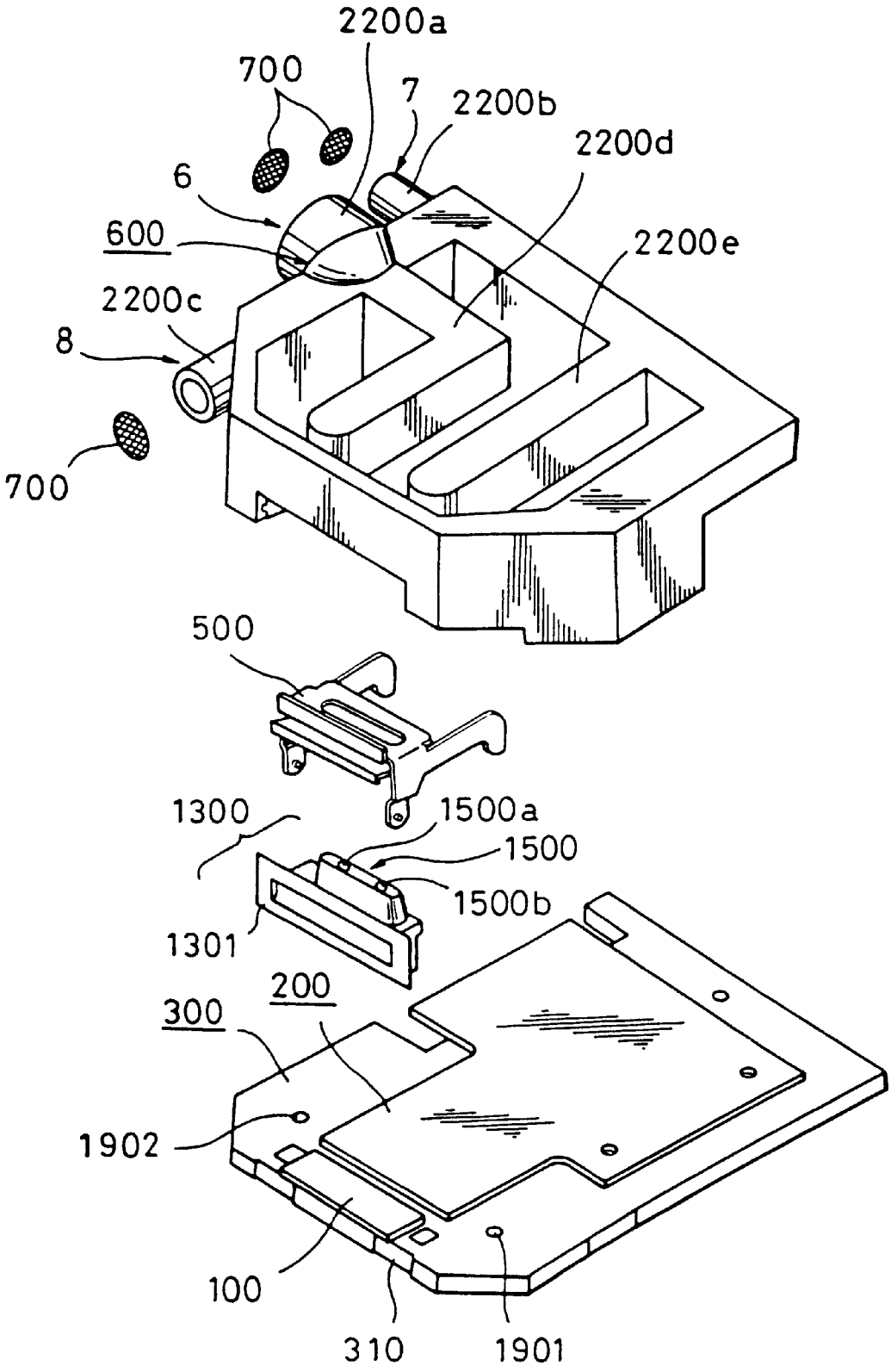
FIG. 8 is an exploded perspective view of the recording head shown in FIG. 7.

FIGS. 7 and 8 are a perspective view and an exploded perspective view showing the detail of the recording head shown in FIG. 6.

Referring to FIG. 7, as in the first embodiment, an ink containing a colorant is supplied through an ink supply port 6 so a to be used as the thick ink, and the ink containing colorant and an ink free of colorant are supplied through the supply ports 7 and 8, respectively. The thick ink supplied through the ink supply port 6 is introduced into the common ink chamber for the thick ink, whereas the inks introduced through the supply ports 7 and 8 are mixed and stirred in the thin ink common chamber. Consequently, the thick and thin inks are discharged from the openings 2A, 2B in the respective arrays.

In this modification, the ink tank CIT for colorant-free ink supplied through the supply port 8 is disposed above the home position HP for the carriage 23 as shown in FIG. 5. Therefore, when the carriage 23 is at the home position HP, the ink supply port 8 is connected to the ink tank CIT, so that the colorant-free ink is introduced via the supply port 8 at a rate controlled by the supply ratio control unit CS. As stated before, the ink tanks for the colorant-containing ink are carried by the carriage 23 together with the recording heads.

The above-described arrangement of ink tanks can effectively be used when two or more ink tanks are used for colorant-containing inks. The recording head is connected by so-called pit-in type connection to the colorant-free ink tank CIT when the head is at the home position, so as to enable a colorant-free ink to be supplied through the supply port 8 for the purpose of adjusting the density level of the thin ink. The arrangement, however, may be such that the colorant-containing ink is supplied from an ink tank which is separate from the carriage, through a flexible tube or the like. Such an arrangement effectively reduces the mass carried by the carriage.

Referring to FIG. 8, a circuit board 200 is connected at its one end to a wiring portion of a heater board 100 on which the electro-thermal transducers are mounted. The other end of the circuit board 200 is provided with a plurality of pads for receiving electrical signals from the main part of the apparatus. With this arrangement, electrical signals from the main part of the apparatus are supplied in the form of driving pulses to the respective electro-thermal transducers.

A metallic support 300 which supports the circuit board 200 at its reverse side serves as a bottom plate of the ink jet unit. A pressing spring 500 has a portion which is bent in a substantially U-shaped form to resiliently press a region of a grooved top plate 1300 along a line near the ink discharge openings, claws which are to be retained in holes in a base plate, and a pair of rear legs through which the force acting on the spring is borne by the base plate. The heater board 100 and the grooved top plate 1300 are resiliently pressed to each other by the force produced by this spring. The grooved top plate has an integral orifice plate portion 1301 and channel members 1500 which define channels leading from the ink supply ports. The mounting of the circuit board 200 on a support member 300 is by adhesive, using an adhesive or the like.

An ink supplying member 600 is provided above the grooved top panel 1300. The ink supplying member 600 is formed by molding to have a pair of pins (not shown) on the reverse side thereof. These pins are received and thermally fused in holes 1901, 1902, thus fixing the ink supplying member 600 to the support member 300. The ink supplying member 600 has integral supply ducts 2200*a*, 2200*b* and 2200*c* which correspond to the above-mentioned supply ports 6, 7 and 8, respectively. The supply duct 2200*a* communicates with a central supply duct 2200*d* of the ink supplying member 600, while supply ducts 2200*b* and 2200*c* are commonly connected to the supply duct 220*e*. The supply duct 2200*d* communicates with a supply port 1500*a* of the channel member 1500 of the top plate 1300, while the supply duct 2200*e* communicates with a supply port 1500*b*. Reference numerals 700 denote filters attached to the supply ports 6, 7 and 8 for the purpose of preventing foreign matter and thickened or solidified ink from entering into the respective supply ducts.

A uniform gap is formed between the orifice plate portion 1301 and the ink supplying member 600. A sealant is injected from an upper sealant injection port in the ink supplying member 600 so as to seal wire bonds, while sealing the gap between the orifice plate portion 1301 and the ink supplying member 600. The sealant then flows through a groove 301 formed in the support member 300, thereby completely sealing the gap between the orifice plate portion 1301 and the front end of the supporting member 300.

Figure 9:
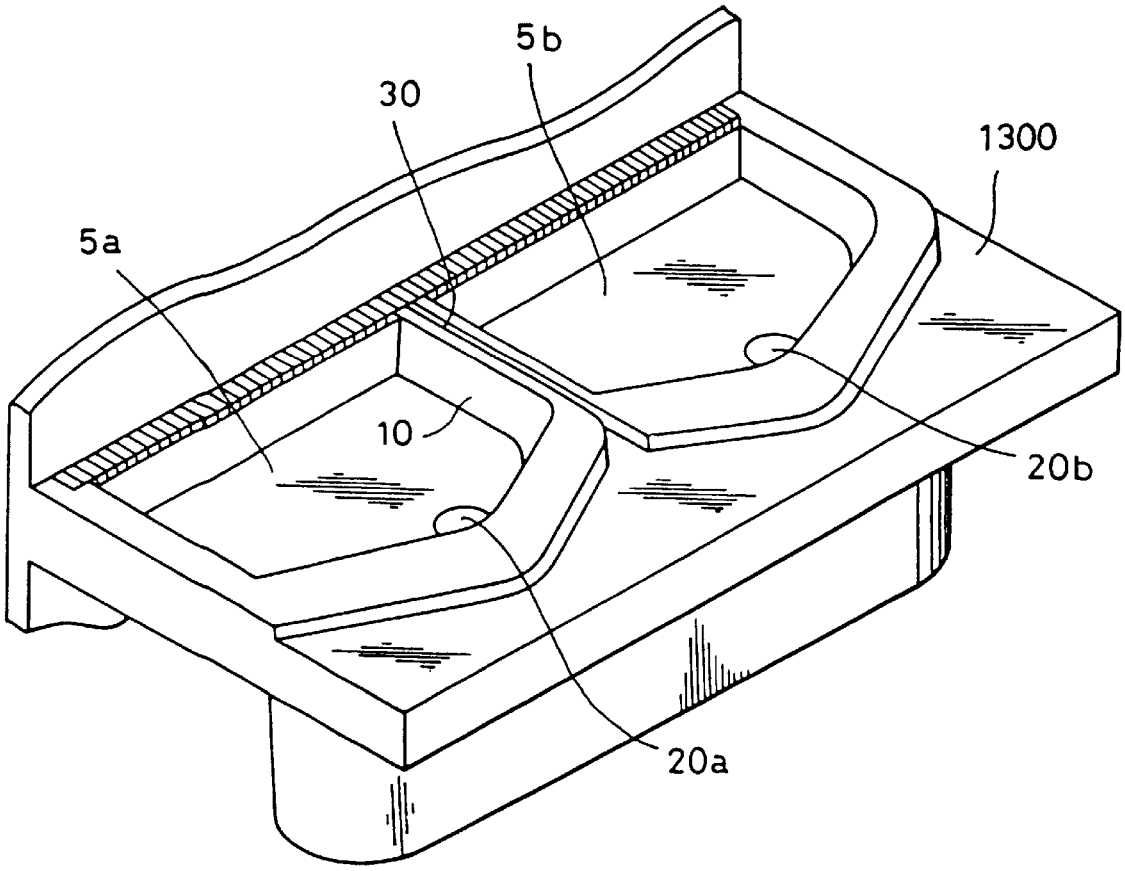
FIG. 9 is a perspective view of the recording head illustrative of a grooved top panel.

FIG. 9 is a perspective view of the grooved top plate 1300 as viewed in a direction opposing the surface to be bonded to the heater board 100.

As stated before, two common ink chambers are formed: one for the thick ink and the other for thin ink. These common ink chambers 5*a*, 5*b* are partitioned by a partition wall 10. The ink chambers 5*a*, 5*b* are provided with supply ports 20*a*, 20*b* through which these ink chambers are supplied with inks.

A groove 30 is formed in the joint surfaces of the partition wall 10 and the heater board 100. This groove 30 makes it possible to seal the peripheral part of the grooved top plate 1300 after it is pressed into close contact with the heater board. Namely, the sealant is allowed to flow and spread along the groove 30 so as to fill the gap between the grooved top plate and the heater board. It is thus possible to separate completely the common ink chambers from each other by using ordinary technique used in the production of conventional recording head. The construction of this groove should vary according to the properties of the sealant. It is thus possible to form separate common ink chambers to enable supply of different types of inks to the respective arrays of ink discharge openings.

Figure 10:
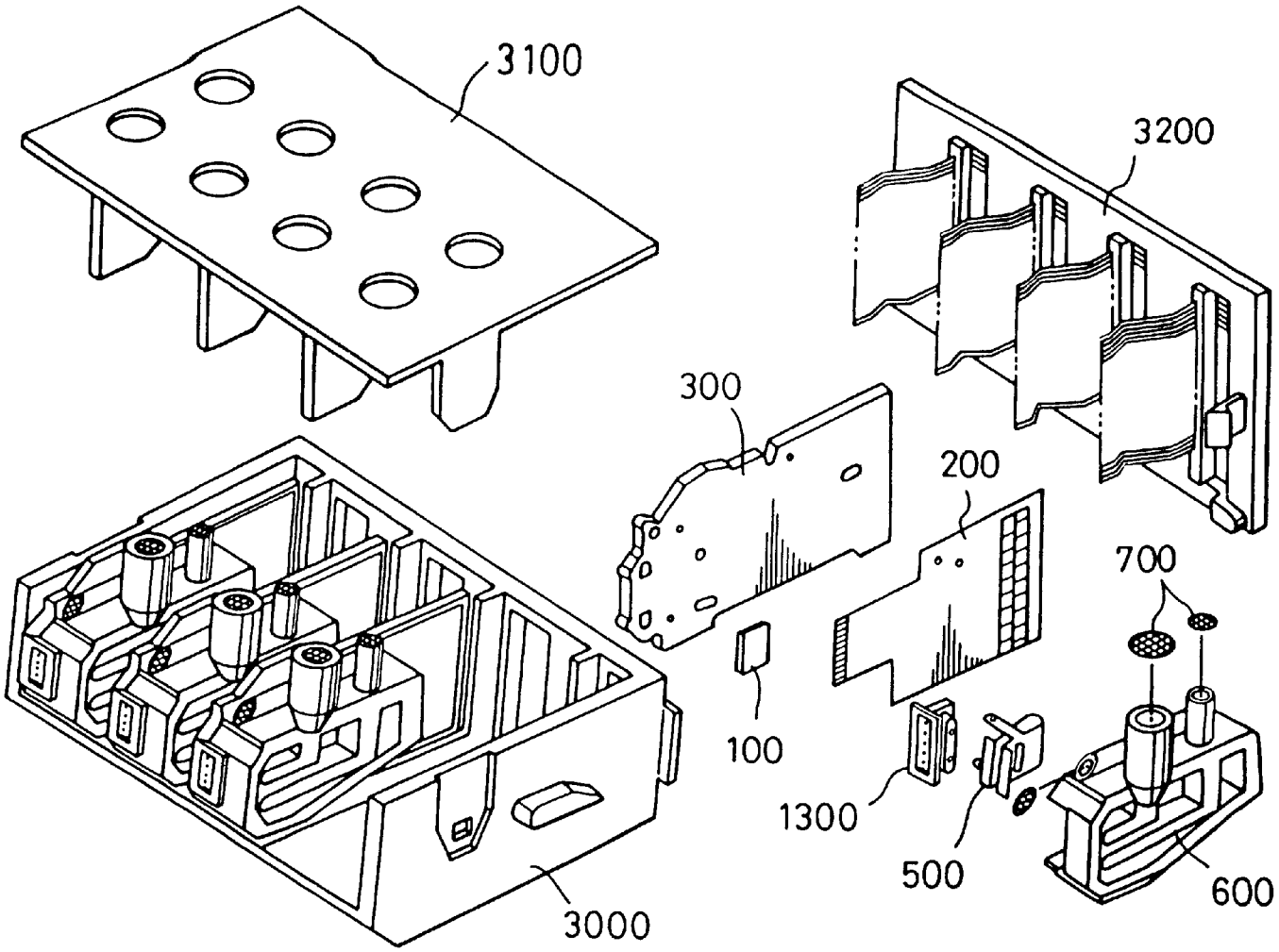
FIG. 10 is an exploded perspective view of an ink jet unit having four recording heads formed as a unit.
Figure 11:
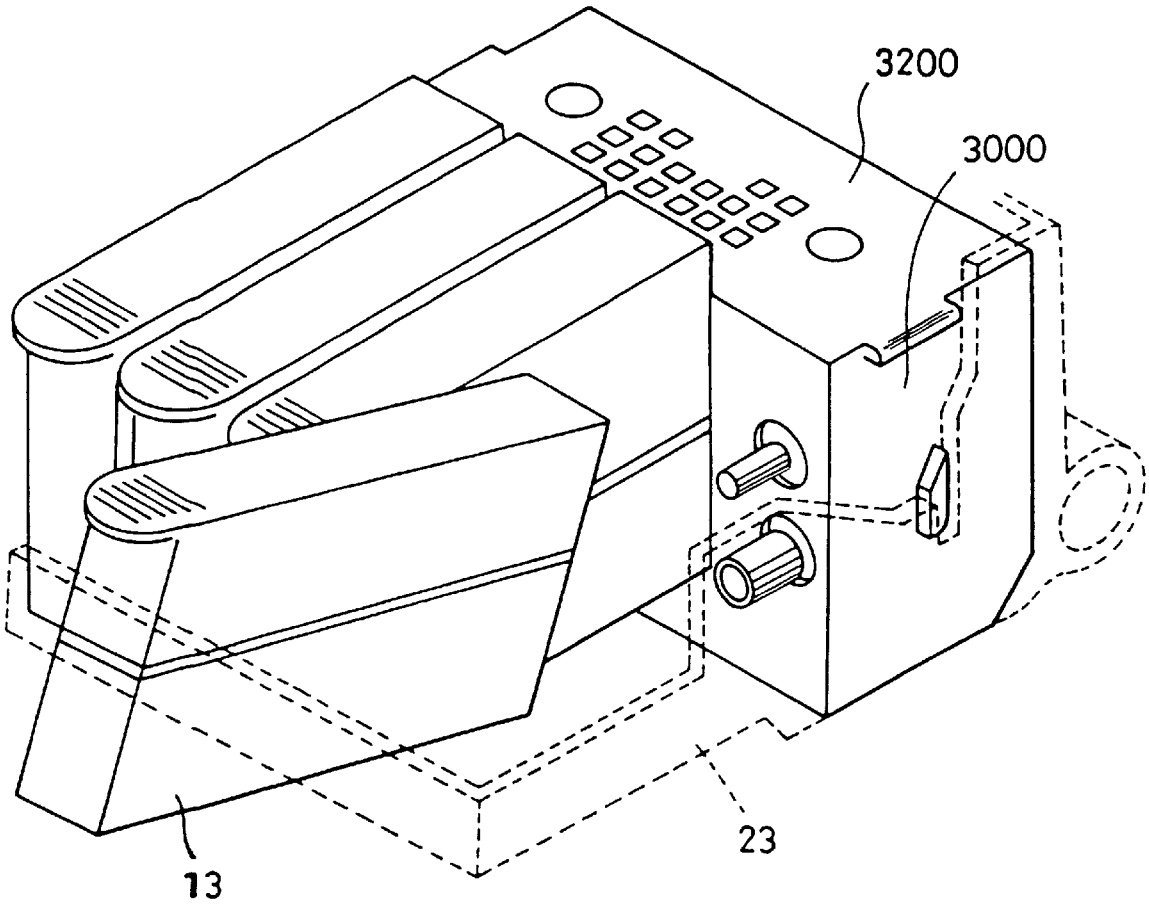
FIG. 11 is a perspective view of the four-head ink jet unit and ink tanks mounted on a carriage.

FIGS. 10 and 11 illustrate another example of the arrangement which is adopted when four recording heads are used.

More specifically, FIG. 10 is an exploded perspective view of a four-head ink jet cartridge (IJC) in which four recording heads for four colors, i.e., C, M, Y and K, are integrally assembled by means of a frame 3000. The four recording heads are mounted and fixed in the frame 3000 at a constant spacing, with the arrays of discharge openings in registration, i.e, such that the arrays extend exactly in parallel with one another. Numeral 3100 denotes a cover of the frame, while 3200 denotes covers which serve also as electrical connectors between the pads provided on the circuit boards of four recording heads and the electrical signal sources provided in the main part of the apparatus.

FIG. 11 illustrates the manner in which the four-head ink jet cartridge is mounted on the carriage together with the ink tanks containing the inks of the respective colors.

In the first embodiment as described, the color recording apparatus uses two types of inks, i.e., thick and thin inks, for each of four colors such as cyan, magenta, yellow and black. This, however, is not exclusive and the color recording apparatus may employ three or more types of inks for each color. When a greater number of types of ink are used for each color, the difference in density between the dots of different type of ink of each color is reduced, so that the generation of a false profile, which tends to appear in the boundary region between the thin and thick inks due to non-linear reproduction of gradation, is suppressed. The use of three or more types of inks, e.g., thin ink, half-thick ink and thick ink, provides more natural changes in the color tone at the boundaries between the regions of different thickness levels.

Although the first embodiment has been described to use a manual valve type ink supply ratio control unit CS, this unit may be formed by a solenoid valve. With this arrangement, it is possible to effect a real-time control, i.e, quicker control, of the ink supply ratio, making it possible to correct thickness of the thin ink during recording, i.e., during movement of the carriage.

(Second Embodiment)

A second embodiment of the present invention will now be described. The second embodiment also uses a thin ink which is prepared by mixing an ink containing a colorant and an ink which is free of colorant.

Figure 12:
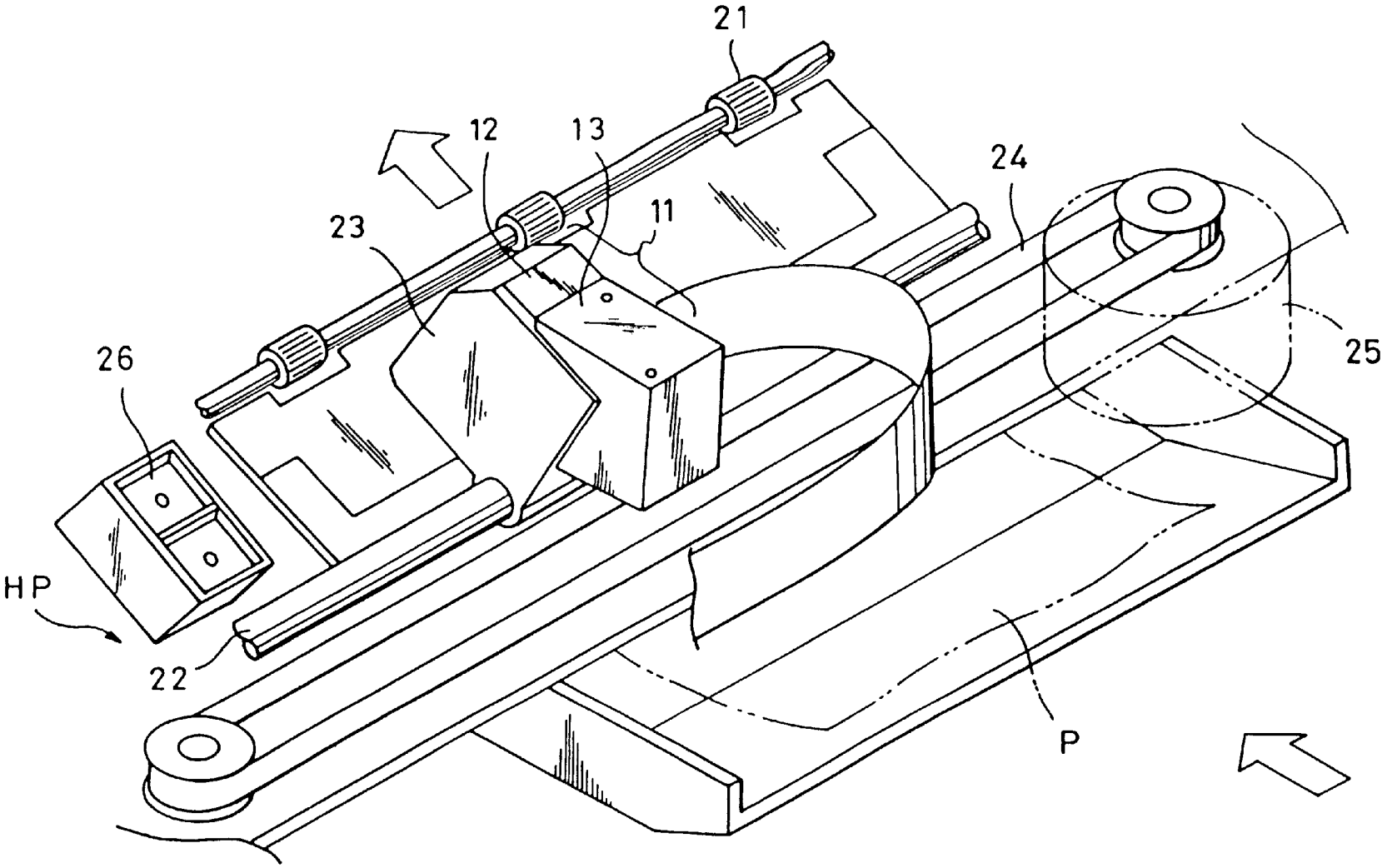
FIG. 12 is a schematic perspective view of a second embodiment of the ink jet recording apparatus of the present invention.

FIG. 12 shows an ink jet recording apparatus as the second embodiment. In this Figure, components which are the same as those of the first embodiment are denoted by the same reference numerals and detailed description of such components is omitted.

Referring to this Figure, a carriage 23 carries a recording head 12 and ink tanks 13 which will be described later with reference to FIGS. 23 and 24, respectively. In this embodiment, therefore, inks are supplied to the recording head 12 from ink tanks carried by the carriage.

Figure 13:
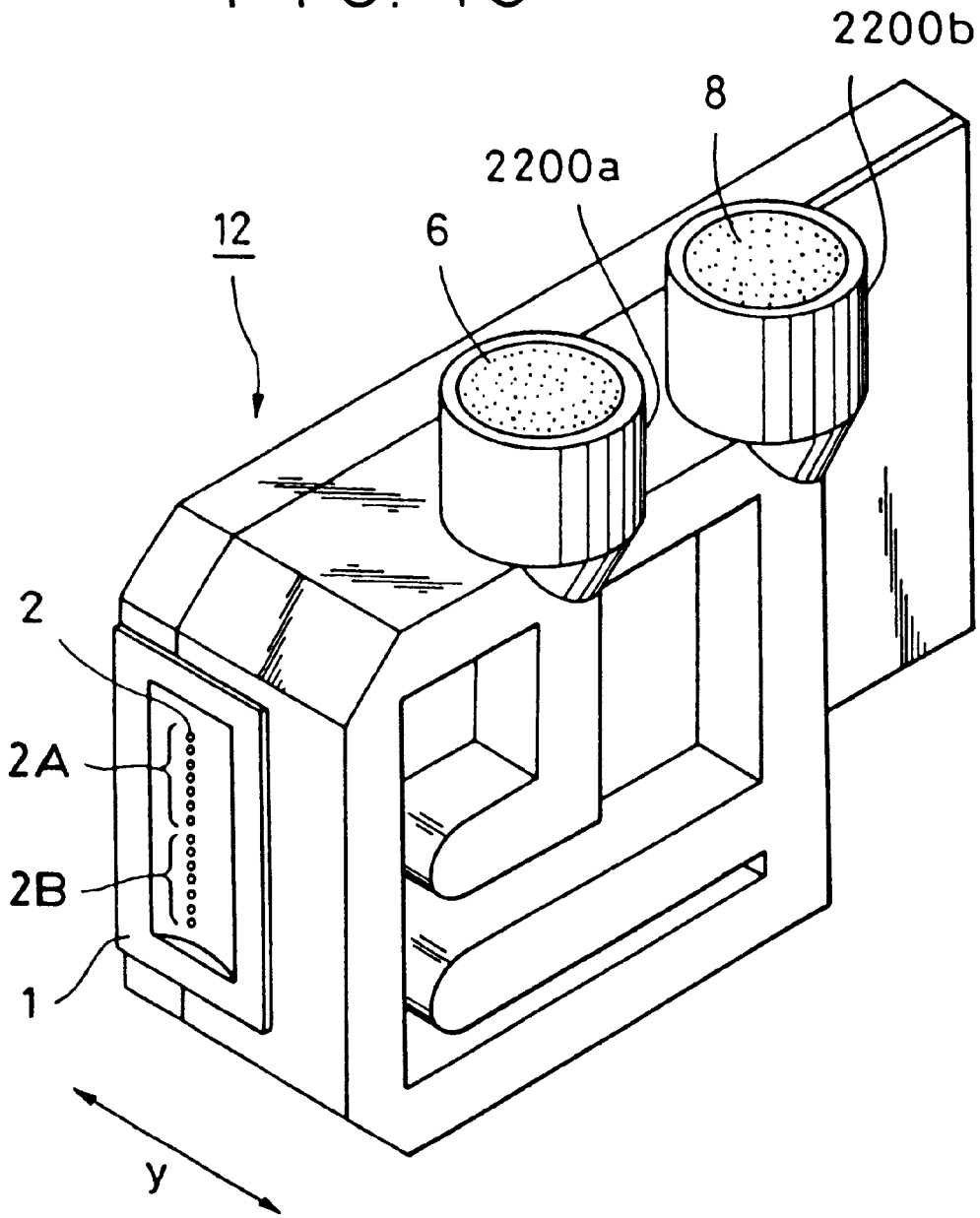
FIG. 13 is a schematic perspective view of a recording head used in the second embodiment.

FIG. 13 is a perspective view of the recording head used in the second embodiment.

The recording head of this embodiment is substantially the same as those which are shown in FIGS. 3 and 7, which are used in the first embodiment and modification of the first embodiment described before. This recording head, however, differs from those shown in FIGS. 3 and 7 in that it employs only two ink supply ducts, i.e., a thick ink supply duct 2200*a* and a thin ink supply duct 220*b*, in contrast to the recording heads of the first embodiment and the modification, which employ three ink supply ducts. Namely, in the second embodiment, the thin ink is generated by mixing two types of inks in the ink tank as will be described below.

Figure 14:
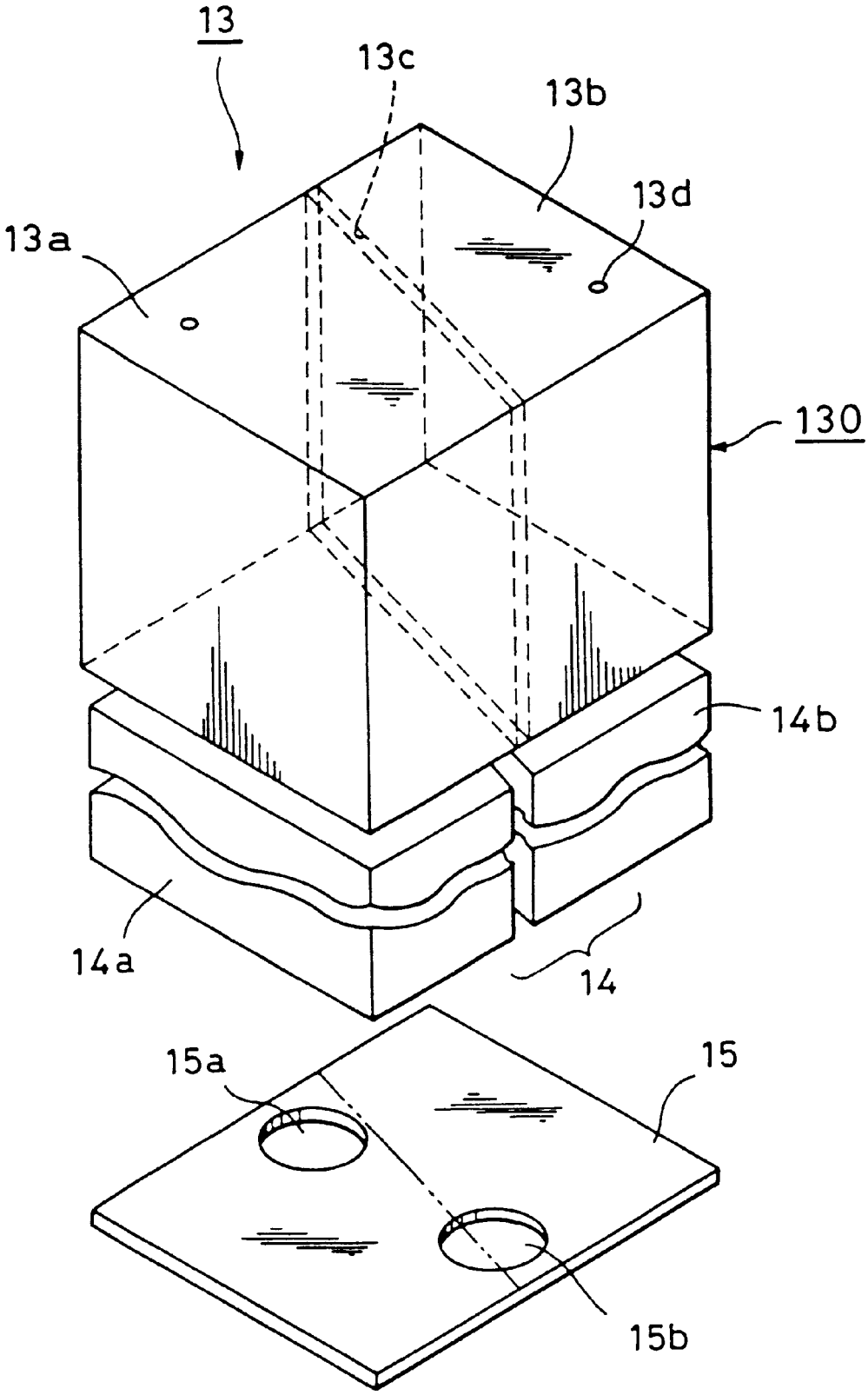
FIG. 14 is a schematic exploded perspective view of the apparatus of FIG. 12, illustrating particularly the construction of an ink tank used therein.

FIG. 14 is an exploded perspective view schematically showing the construction of the ink tank used in this embodiment.

The ink tank has a vessel 130 which is provided substantially at the mid portion thereof with a partition wall 13C so that the space inside the ink tank vessel 130 is divided into a first ink chamber 13*a* and a second ink chamber 13*b*. The first and second ink chambers 13*a* and 13*b* receive ink absorption members 14*a* and 14*b* for retaining and supplying inks. Foam material such as urethane foam, typically sponge, is used as the material of the ink absorption members 14*a,* 14*b*. The ink tank 13 is completed by pressing ink absorption members 14*a,* 14*b* in the vessel 130 and then pressing and fixing a lid 15 to the vessel 130. Preferably, the fixing of the lid 15 to the ink tank vessel 130 is conducted by such a technique which fuses materials of both members, e.g., thermal welding, ultrasonic welding or high-frequency welding, in order to attain required tightness of seal, as well as productivity.

The lid 15 is provided with holes 15*a,* 15*b* for receiving the thick ink supply ducts 2200*a,* 2200*b* for supplying respective inks to the recording head. Numerals 13*a,* 13*b* denote atmospheric pressure ports for maintaining atmospheric pressure inside the first and second ink chambers 13*a,* 13*b*.

Figure 15:
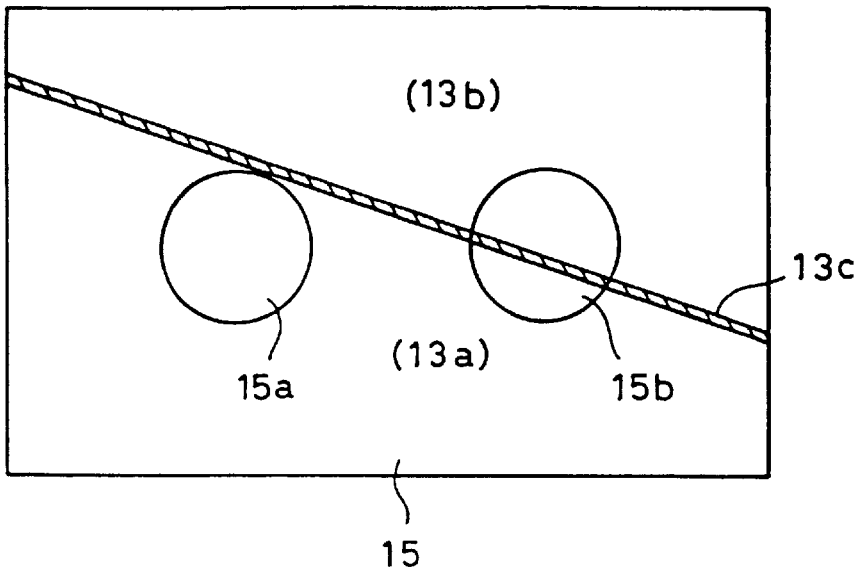
FIG. 15 is a schematic illustration of an ink supply port of the ink tank shown in FIG. 14.

FIG. 15 is a top or bottom plan view of the lid 15, with the partition plate 13*c* combined therewith. As will be seen from this Figure, hole 15*b* of the aforementioned two holes 15*a,* 15*b* is divided by the partition plate 13*c* into two portions which open into the first and second ink chambers 13*a,* 13*b,* respectively. The areas of the two portions opening into the first and second ink chambers 13*a,* 13*b* are different.

Although the hole 15*b* is divided by the oblique straight partition wall 13*c,* this arrangement is only illustrative and a partition means which has a stepped cross-section may be used in place of the straight partition wall, as means for dividing the hole 15*b*.

The first ink chamber 13*a* of the ink tank 13 is charged with a thick ink, while the second ink chamber 13*b* is charged with a colorless ink free of colorant (clear ink).

The ink tank 13 is then connected to the recording head 12 by means of the ink supply ducts 2200*a,* 2200*b*.

Figure 16:
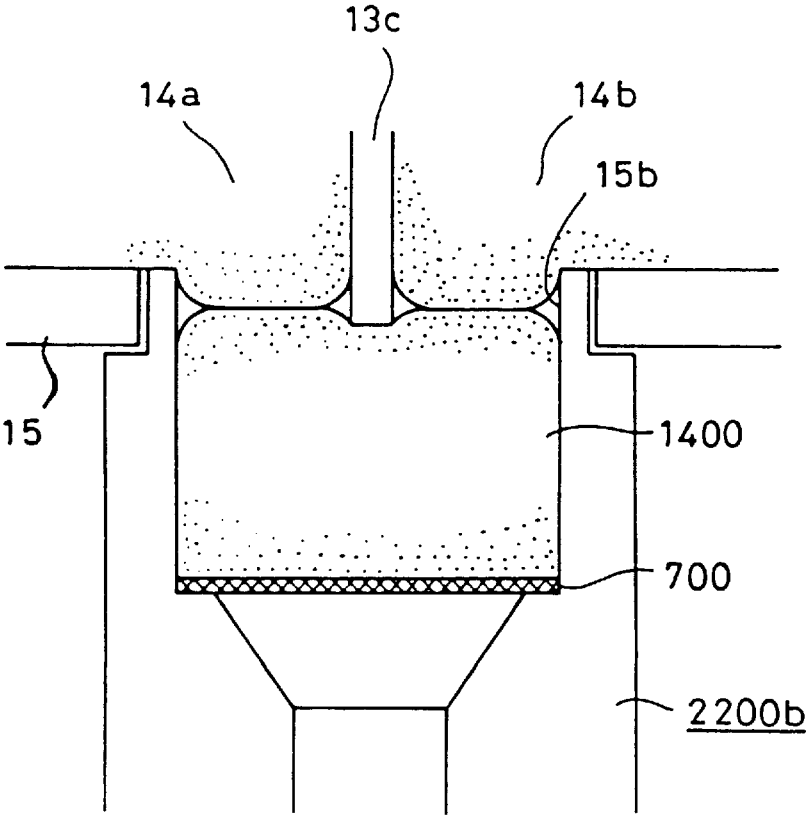
FIG. 16 is a fragmentary sectional view of the joint portion between the recording head and the ink tank.

FIG. 16 is a sectional view showing the detail of the structure where the recording head 12 and the ink tank 13 are connected within the hole 15*b*.

A sponge member 1400, similar to the ink absorption members used in the ink tank, is attached to the connecting end of the ink supply duct 2200*b* of the recording head 12. This sponge member 1400 is held in contact with the ink absorption members (sponge) 14*a* and 14*b* in the respective ink chambers of the ink tank. The surface of the sponge member 1400 adjacent to the recording head is held in contact with a mesh filter 700 which serves to prevent any foreign matter from coming into the recording head. When the recording head 1 and the ink tank 13 are joined together, thick ink is supplied into the recording head through the ink supply duct 2200*a* which is received in the hole 15*c,* whereas a thin ink, which is formed from the thick ink mixed and the clear ink at a mixing ratio of 1:2, is supplied to the recording head 12 through the ink supply duct 2200*b* connected in the hole 15*b* shown in FIG. 16.

More specifically, the thick ink and the clear ink are supplied from the first ink chamber 13*a* and the second ink chamber 13*b,* respectively, into the connecting region provided in the hole 15*b* shown in FIG. 16, at a ratio which is determined by the ratio of the opening areas of two portions of the hole 15*b* defined by the partition wall 13*c*. Both inks are mixed with each other within the sponge member 1400 in the connecting portion so as to form the thin ink having a predetermined uniform thickness. This thin ink is then introduced into the common ink chamber inside the recording head 12 through the ink supply duct 2200*b*.

In the second embodiment as described, the first hole 15*a* is not divided so that it supplies only the thick ink. This arrangement, however, is only illustrative and may be modified such that the first hole 15*a* is traversed by the partition plate so that inks from both ink chambers are mixed and supplied through the first hole 15*a,* as is the case of the second hole 15*b*.

The ink supply structure describe hereinbefore supplies two types of inks: namely, a thick ink and a thin ink. This arrangement may be modified such that three or more supply holes, having different values of ratios of the area of the openings to both ink chambers 13*a,* 13*b,* are used to provide different types of inks having different thickness levels.

During recording with the thick and thin inks supplied by the described ink supply mechanism, the inks are gradually consumed so that the amount of ink remaining in the ink tank is reduced. The user can easily recognize when only small amounts of inks are left in the ink tanks, because under such a condition the color tone is drastically changed. Thus, the user can know exactly when to change the ink tank 13. Namely, when the amount of the thick ink left in the tank has been reduced, the density of images recorded with the thin ink is lowered, whereas, when the amount of the clear ink remaining in the tank has been reduced, the density of the image recorded with the thin ink is raised. Thus, a shortage of the either ink can produce a noticeable change in the density of the recorded image. It is therefore possible to avoid dangerous "dry heating", i.e., driving of the electrothermal transducer 4 with no ink remaining thereon, and this will extend the life of the recording head 12. In addition, the cost of the whole recording apparatus can be lowered because there is no need for any means which would be used for electrically or mechanically sensing amounts of ink remaining in the ink tanks.

Although the embodiment has been described with specific reference to a monochromatic recording which uses inks of a single color, it will be clear that the embodiment also can be applied to a color recording apparatus which use thick and thin inks for each of cyan, magenta, yellow and black colors.

Such a color recording apparatus can be realized substantially in the same manner as that of the modification of the first embodiment which was described before with reference to FIGS. 5, 6, 8, 9, 10 and 11, although the construction of the ink tank and the ink supply mechanisms are varied in accordance with the features of the second embodiment described above. Such an application of the second embodiment to a color recording apparatus will be described briefly.

Figure 17:
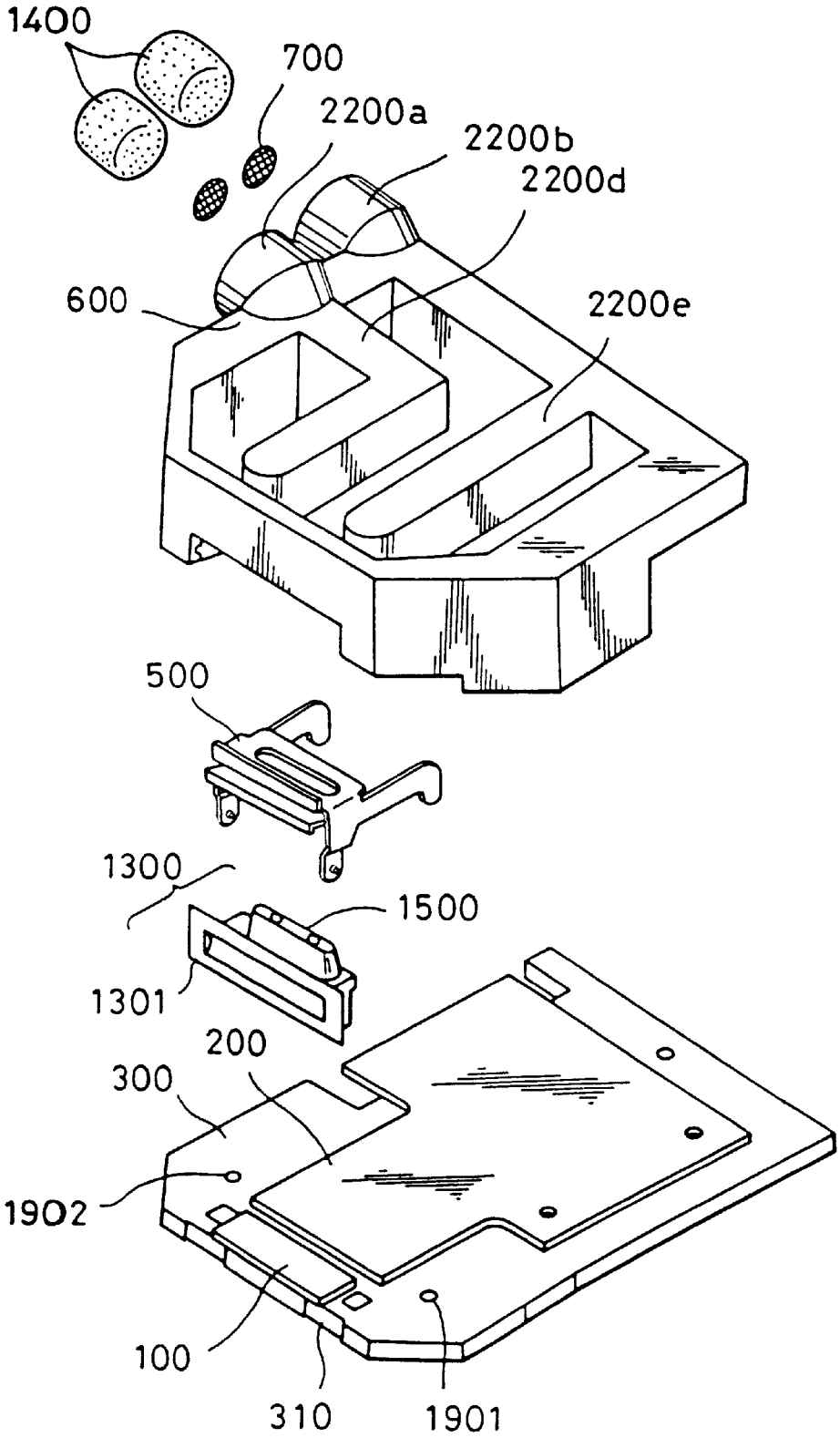
FIG. 17 is an exploded perspective view of the recording head shown in FIG. 13.

FIG. 17 shows a construction similar to that shown in FIG. 8.

Referring to this Figure, filters 700 are installed in the ink supply ducts 2200*a,* 2200*b,* and sponge members 1400 are set on the outer side of the filters 700. An ink supply member 600 integral has supply ducts 2200*d,* 2200*e* which correspond to the supply ducts 2200*a,* 2200*b*.

Figure 18:
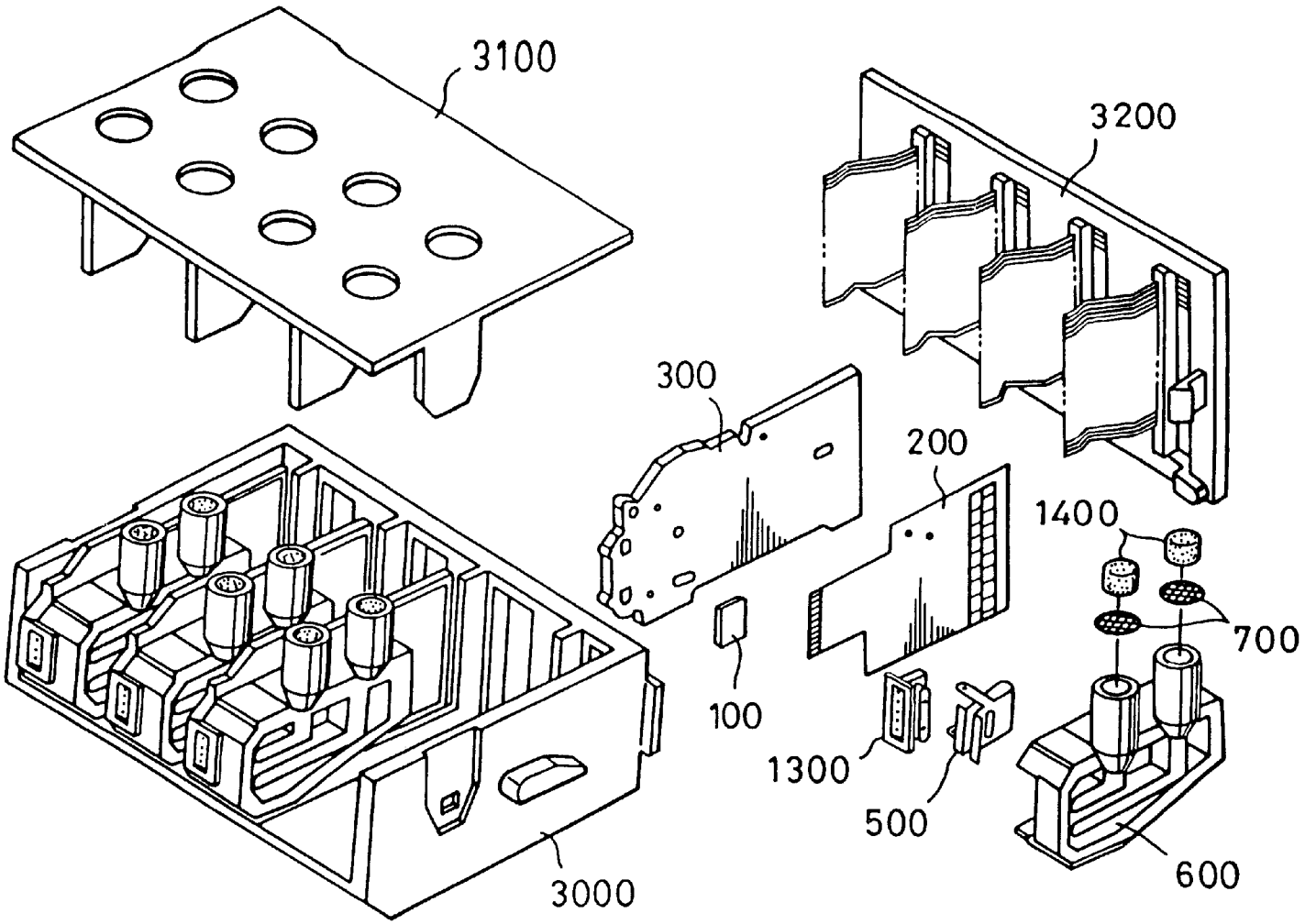
FIG. 18 is an exploded perspective view of an ink jet unit integrating the recording head.

Four recording heads corresponding to four colors of C, M, Y and K, each having the construction shown in FIG. 17, are assembled together by means of a frame 3000 so as to form a four-head type ink jet cartridge (IJC) as shown in FIG. 18. Thus, the construction shown in FIG. 18 is substantially the same as that shown in FIG. 10.

Figure 19:
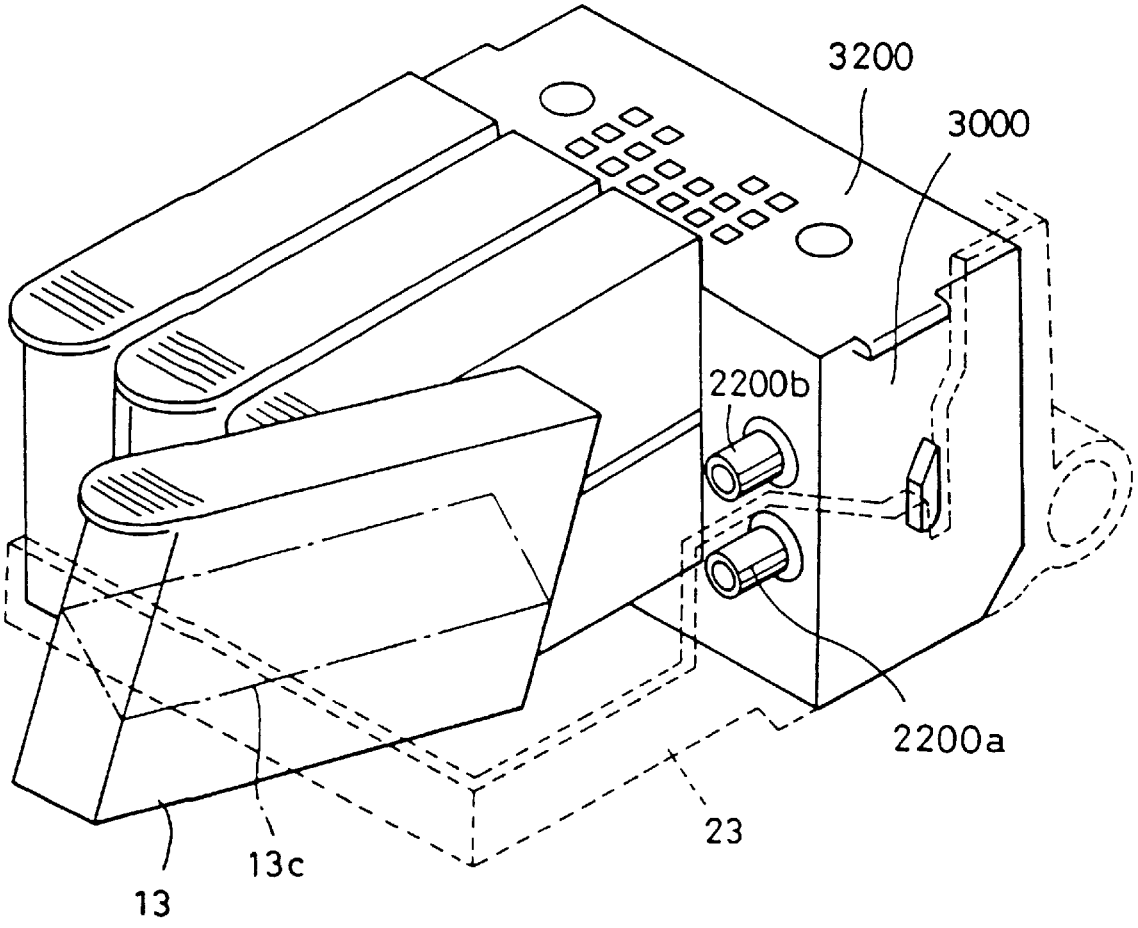
FIG. 19 is a perspective view of the four-head ink jet unit and ink tanks mounted on a carriage.

FIG. 19 shows the manner in which the above-mentioned four-head ink jet cartridge is carried by a carriage, and shows a construction similar to that shown in FIG. 11. Thus, the arrangement shown in FIG. 19 is substantially the same as that shown in FIG. 11. In this arrangement, however, each of the ink tanks has a partition plate 13*c* similar to that used in the monochromatic ink tank described before.

With this arrangement, it is possible to determine the thickness level of the thin ink in accordance with the ratio opening areas of the hole formed in the tank between the portion through which the thick ink is supplied and the portion through which the thin ink is supplied.

(Modification of Second Embodiment)

Figure 20:
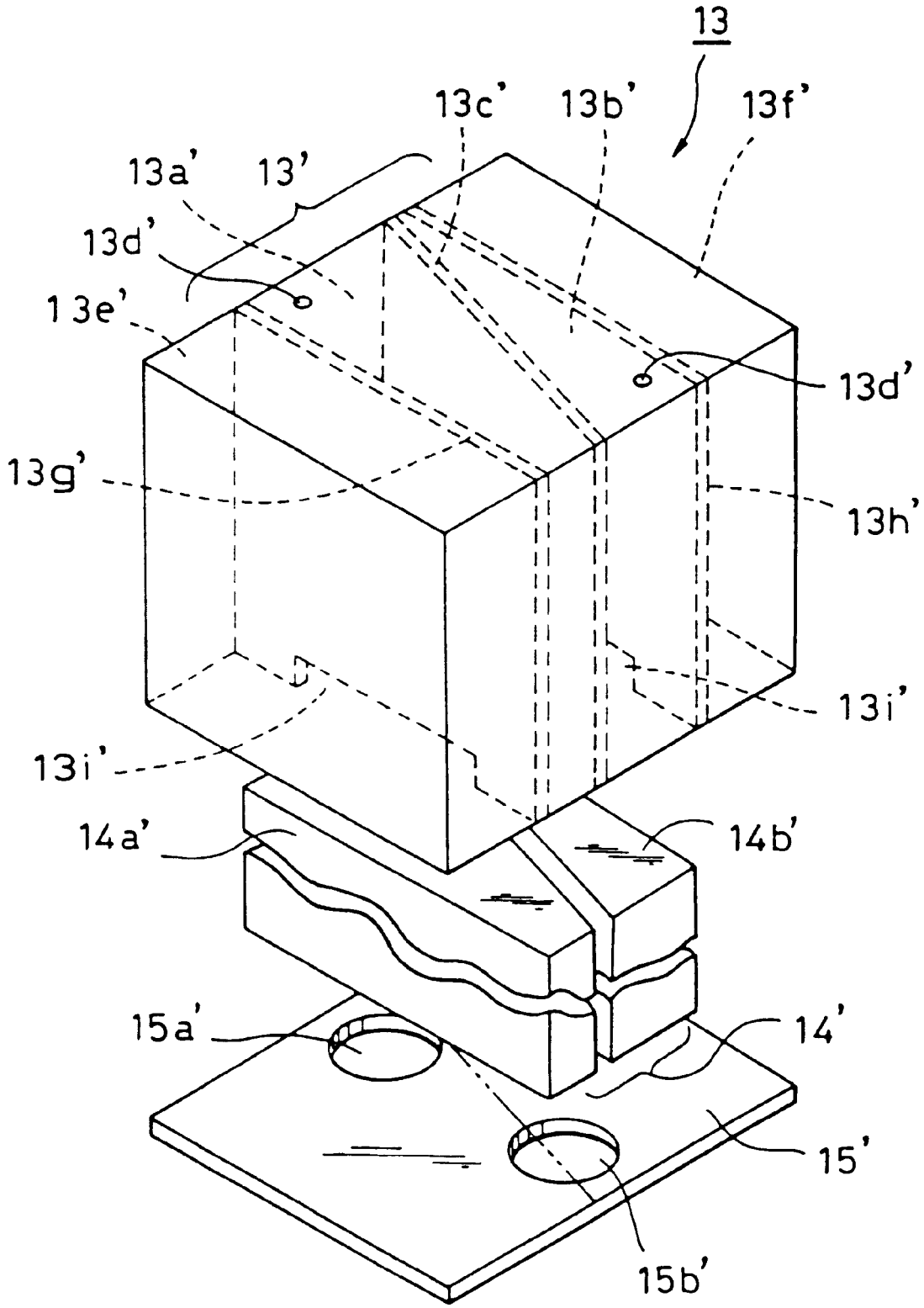
FIG. 20 is a schematic exploded perspective view of an ink tank used in a modification of the second embodiment.

FIG. 20 is an exploded perspective view of an ink tank used in a modification of the second embodiment.

The ink tank 13 used in this modification has a negative-pressure generating section which is composed of a pair of ink chambers 13*a*', 13*b*' provided with ink absorption members, and ink containing portions 13*e*', 13*f*' which are separated from the negative pressure generating section by partition plates 13*g*', 13*h*' and communicating with the negative-pressure generating section through notches or slits 13*i*' formed in the lower ends of the partition plates 13*g*', 13*h*'. This ink tank allows a more efficient use of the inks. Supply of ink from the ink containing sections 13*e*', 13*f*' is commenced after the inks in the ink absorption members 14*a*', 14*b*' have been consumed. Since the inks are supplied by the static pressure or heads, supply and mixing of inks are achieved more uniformly. By setting the level of the gas-liquid exchanging slit 13*i*' above the level of the ink supply holes 15*a*', 15*b*', it is possible to apply a positive pressure to the recording head when the carriage is not used, while ensuring that negative pressure is exerted during operation of the carriage, whereby mixing of inks due to diffusion in both in the first and second ink tanks is prevented.

An experiment showed that when the level of the slit 13*i*' is set to range between 2 mm and 10 mm, a water head of 0 to 10 mm Aq is maintained at the ink discharge openings of the recording head. This water head or pressure allows an ink meniscus to be maintained in the region near the discharge openings, thus preventing wasteful leakage of the ink from the discharge openings when the recording is not conducted.

There is no restriction in the number of ink colors in this embodiment, as is the case of the first embodiment described before.

(Another Modification of Second Embodiment)

Figure 21:
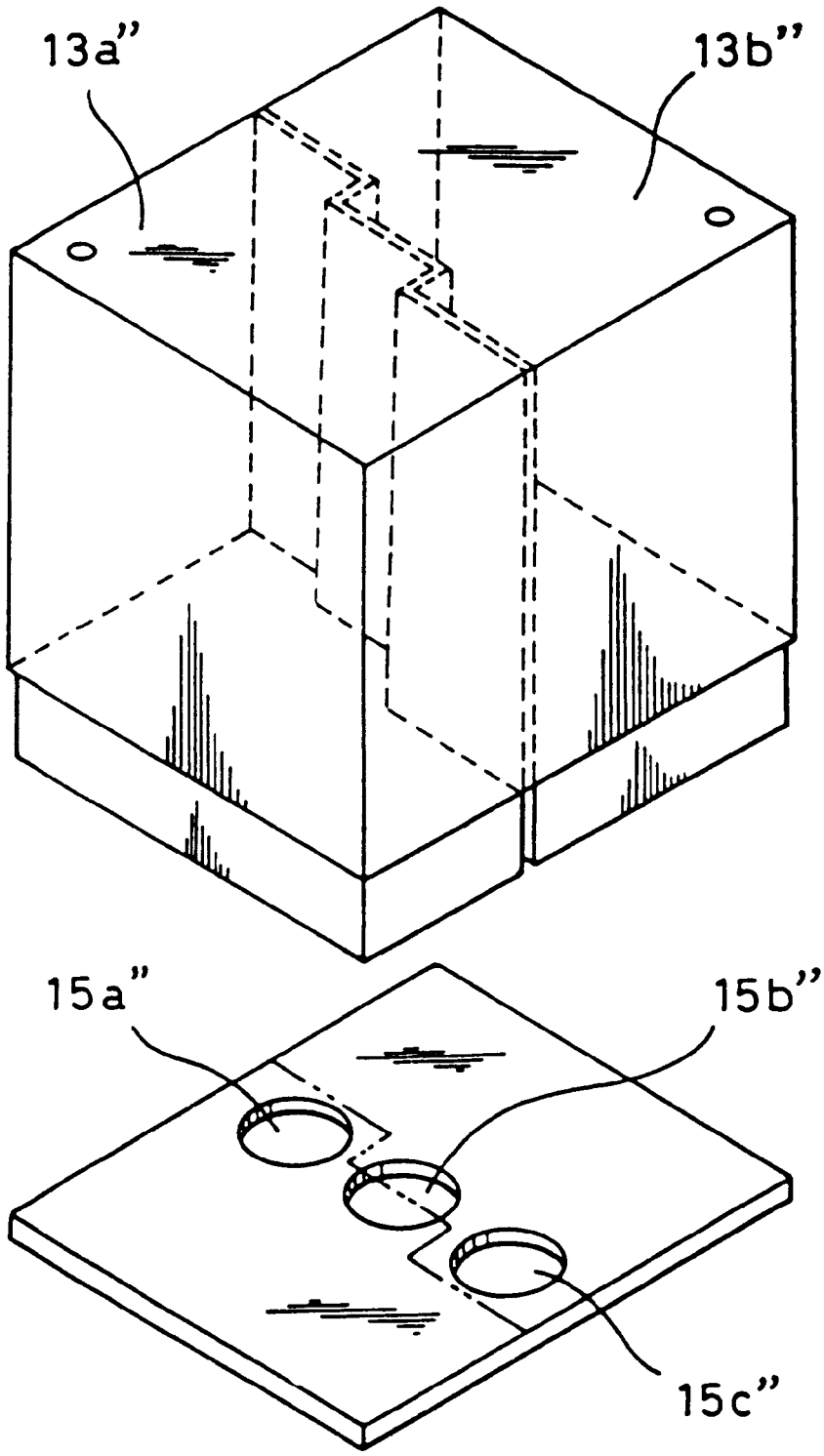
FIG. 21 is an exploded perspective view of an ink tank used in another modification.

In the second embodiment and the modification described above, the thick and thin inks of the same color are obtained by suitably selecting the area ratio of ink supply holes provided by partition wall installed in the tank. The mixing of the inks, however, can be conducted in various manners. FIG. 21 shows another modification of the second embodiment in which the first ink chamber 13*a*" and the second ink chamber 13*b*" of the ink tank are respectively charged with yellow and red inks, and three ink supply holes 15*a*", 15*b*" and 15*c*" are arranged in the illustrated manner. With this arrangement, inks of yellow color, orange color and red color can be supplied through the first, second and third ink supply holes 15*a*", 15*b*" and 15*c*", respectively.

It is thus possible to obtain an ink of a color tone intermediate between two colors, by charging the two ink chambers with inks of these two colors, instead of obtaining thick and thin inks of the same color. Any desired intermediate color tone can be obtained by suitably determining the positions of the partition wall. It is thus possible to obtain an additional ink color without increasing the number of the ink tanks.

(Third Embodiment)

A description will now be given of a third embodiment in which the ratio of supply rate between inks of different thickness levels is varied in accordance with the detected density of recorded image, so as to control automatically the levels of thickness of the discharged inks.

(Construction of the Recording Apparatus)

Figure 22:
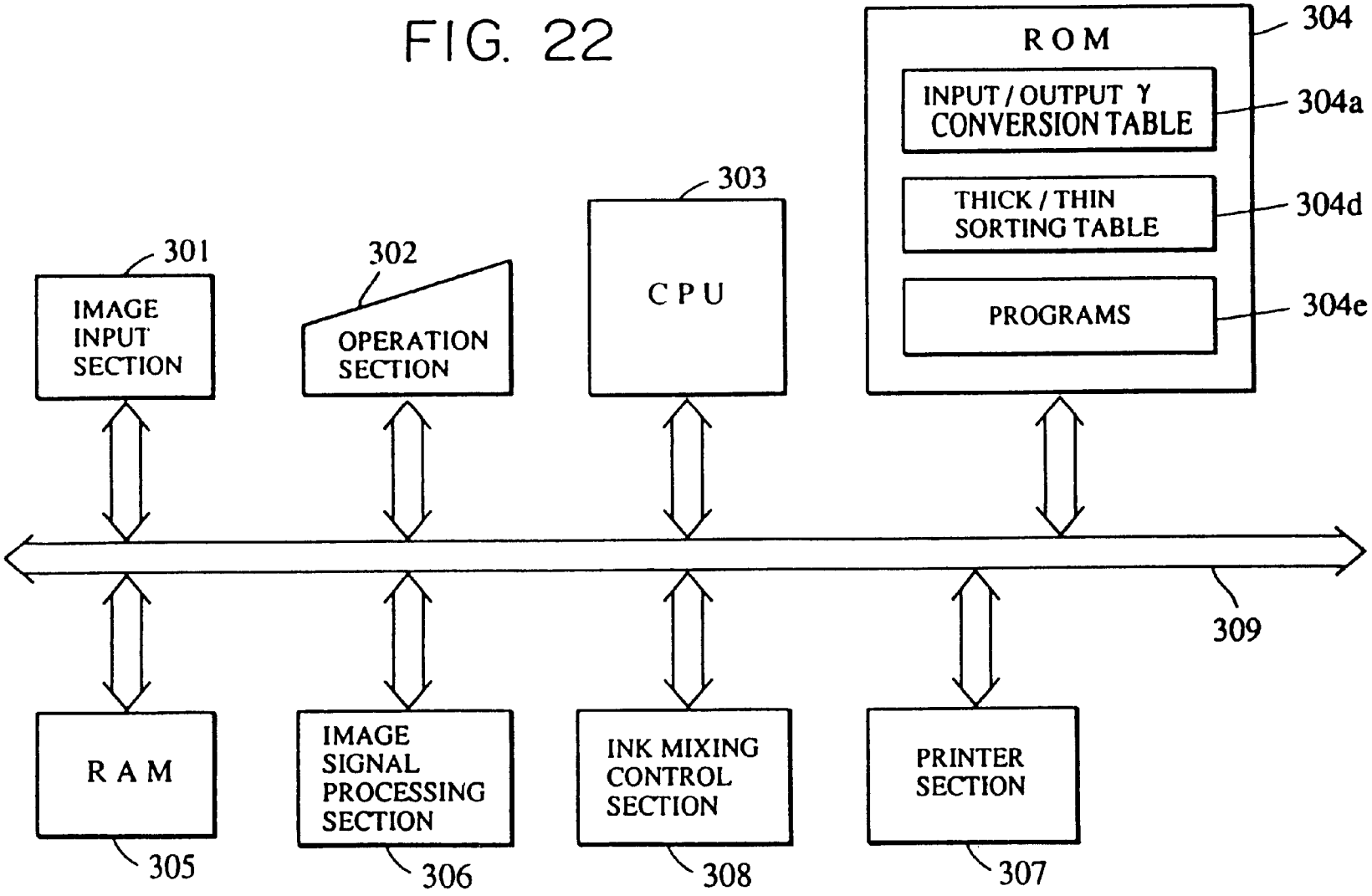
FIG. 22 is a block diagram of a third embodiment of the ink jet recording apparatus of the present invention.

FIG. 22 is a block diagram of an ink jet recording apparatus capable of recording a gray scale image.

Referring to this Figure, an image input section 301 inputs an image optically read by, for example, CCD or image luminance signals (RGB) derived from, for example, a host computer or a video device. An operation section 302 has keys for setting various parameters, as well as keys for commanding the recording operation. A CPU 303 controls the whole recording apparatus in accordance with programs stored in a ROM. The ROM 304 stores programs used in the control of operation of this recording apparatus, such as a control program, error processing program and so forth. More specifically, the ROM 304 has an input/output γ conversion table 304*a* which is referred to in a later-mentioned input/output γ conversion, a thick/thin sorting table 304*d* which is refereed to in a process performed by a later-mentioned thick/thin sorting circuit, and a program section which contains various programs explained above. Numeral 305 denotes a RAM which provides a work area for various programs stored in the ROM, as well as a shelter area which is used in error processing operation. A printer section 307 forms a dot image in accordance with image signals processed by the image processing section during recording. Numeral 308 designates an ink mixing control section for controlling the ink mixing ratio and the supply of ink in the later-mentioned ink mixing and supplying processes. Address signals, data control signals and other signals used in this apparatus are transmitted through a BUS line 309.

(Image Signal Processing Section)

A description will be given of the detail of the image signal processing section 306 shown in FIG. 22.

Figure 23:
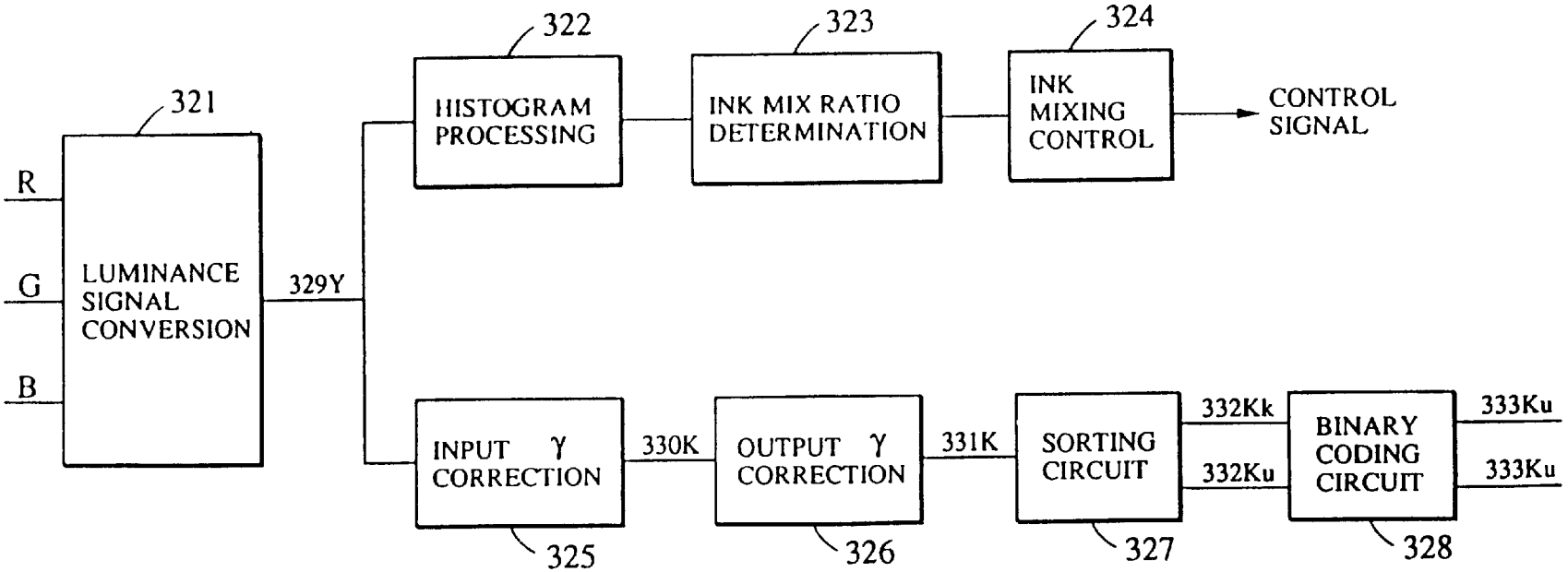
FIG. 23 is a block diagram showing the detail of an ink mixing control section of the embodiment shown in FIG. 22.

FIG. 23 is a block diagram of an example of the image signal processing circuit used in the third embodiment.

A red image density signal R, green image density signal G and blue image density signal B are converted into a luminance signal 329Y by a luminance signal conversion circuit 321. The conversion from the RGB image signals into the luminance signal is conducted in accordance with the following formula:

$$Y=0.30R+0.59G+0.11B$$

A histogram processing circuit 322 determines the luminance distribution on the basis of the luminance signal 329Y, and the ink mixing ratio is determined by a mixing ratio determining circuit 323 based on the luminance distribution. A control signal is formed and output from the ink mixing control circuit 324 on the basis of the thus determined mixing ratio.

Meanwhile, the luminance signal 329Y is converted into an image density signal 330K by means of the input γ correction circuit 325, and g correction is effected by an output γ correction circuit 326. Image luminance signals 331K obtained through this operation are sorted by a thick/thin sorting circuit 327 into thick black image density signals 332$K_k$ corresponding to high dye concentration and light black image density signals 332$K_u$ corresponding to low dye concentration.

Figure 24:
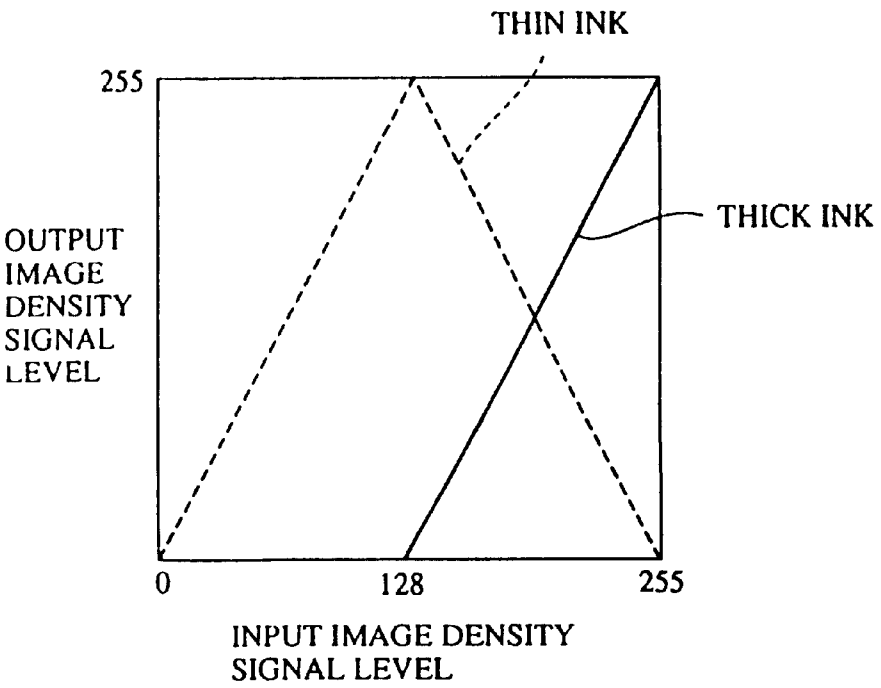
FIGS. 24(*a*) and 24(*b*) are schematic illustrations of a thick-thin sorting table.
Figure 24:
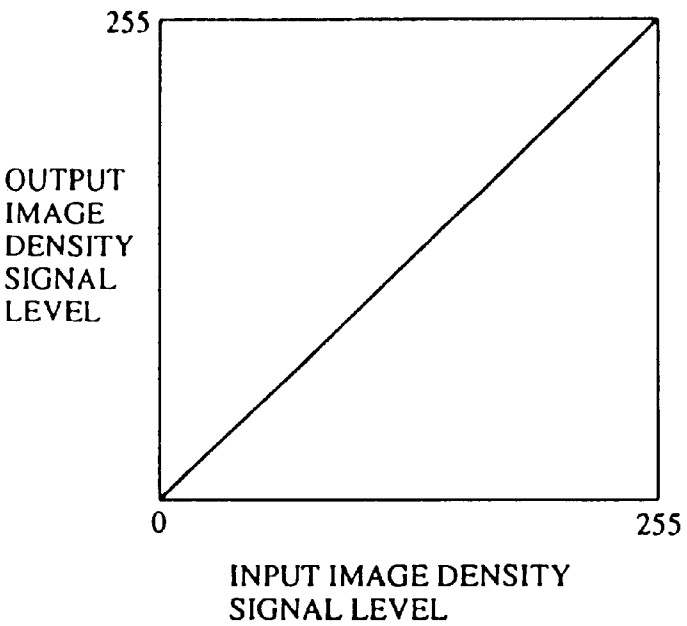

The above-describe sorting operation is conducted by making reference to a table shown in FIGS. 24(*a*) or 24(*b*).

More specifically, FIG. 24(*a*) shows a table which is used in ordinary binary recording employing an ink of a fixed density level, while FIG. 24(*b*) shows a conversion table which is used when thick and thin inks are used.

These tables are so formed as to provide a linear proportional relation between the image density signal values and the image density levels measured by optical reflection. The thick/thin sorting circuit produces a thick/thin signal by making reference to the thick/thin sorting signal. The sorted image density signals 332$K_k$ and 332$K_u$ are binary-coded by binary-coding circuits so as to be used as discharge signals in the respective ink jet units.

Figure 25:
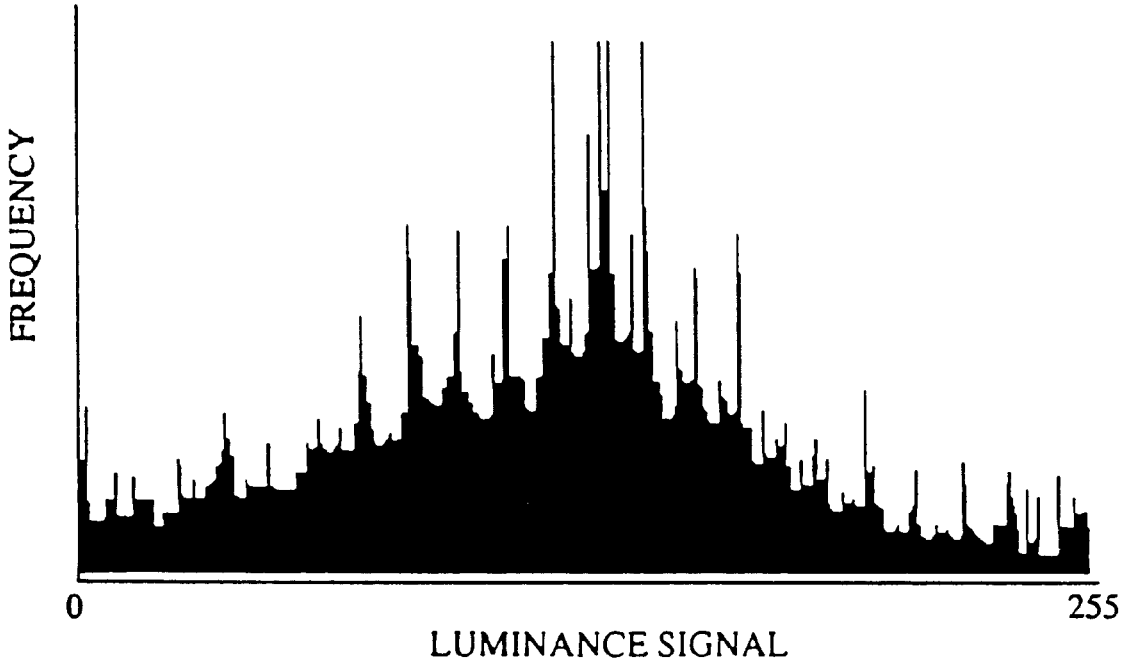
FIG. 25 is an illustration of a distribution of luminance signals of record data.
Figure 26A:
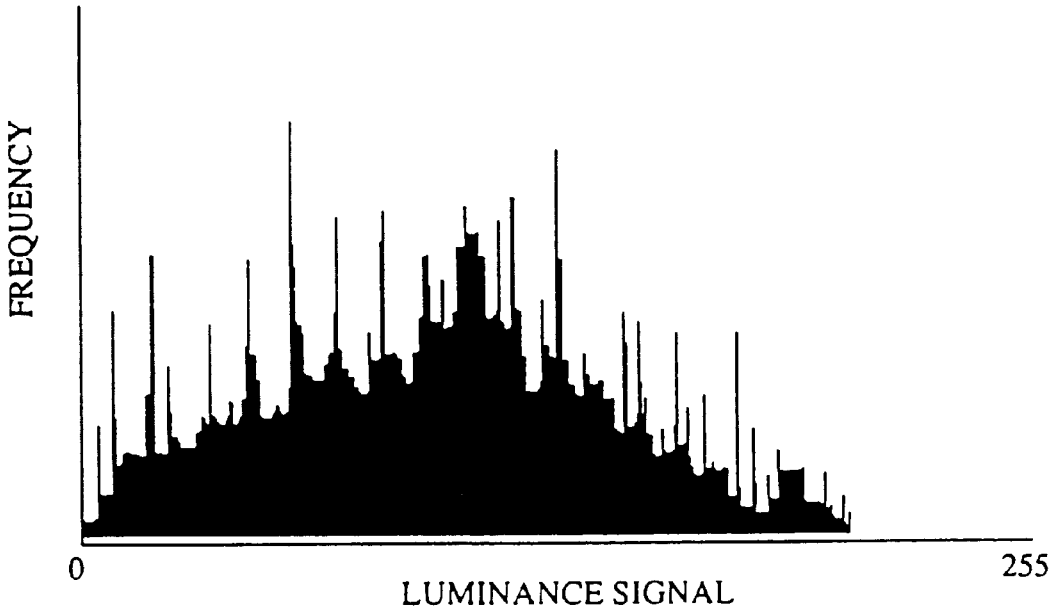
FIGS. 26(*a*) and 26(*b*) are charts showing a distribution of luminance signals of record data.
Figure 26B:
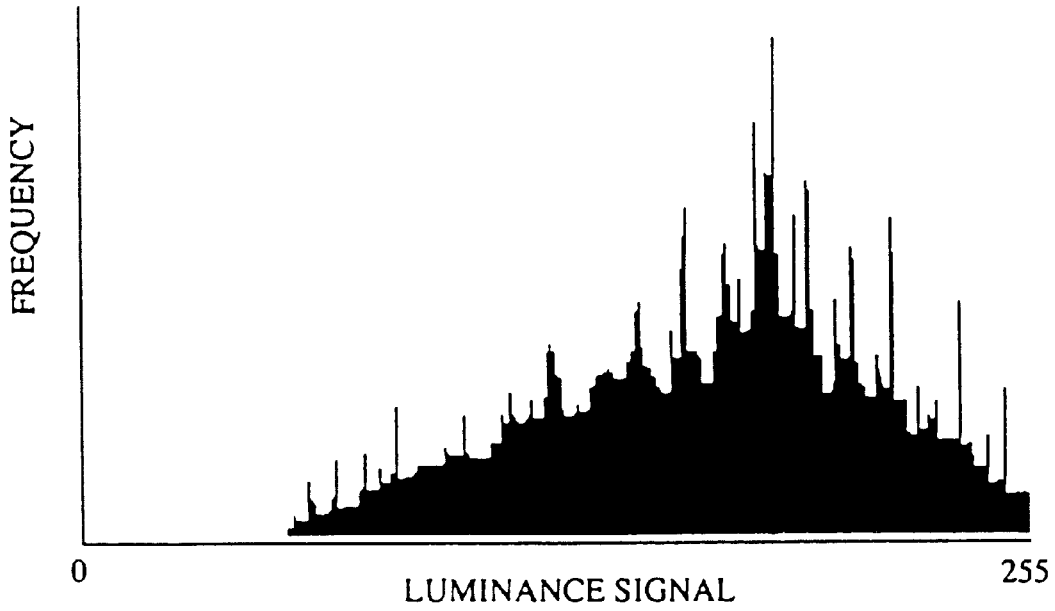

FIGS. 25, 26(*a*) and 26(*b*) are illustrations of image luminance distributions.

More specifically, FIG. 25 shows a luminance distribution as obtained when image data is widely distributed from a low-luminance region to a high luminance region, while FIGS. 26(*a*) and 26(*b*) respectively show luminance distributions as observed when data are concentrated to the low-luminance side and high-luminance side, respectively.

Figure 27:
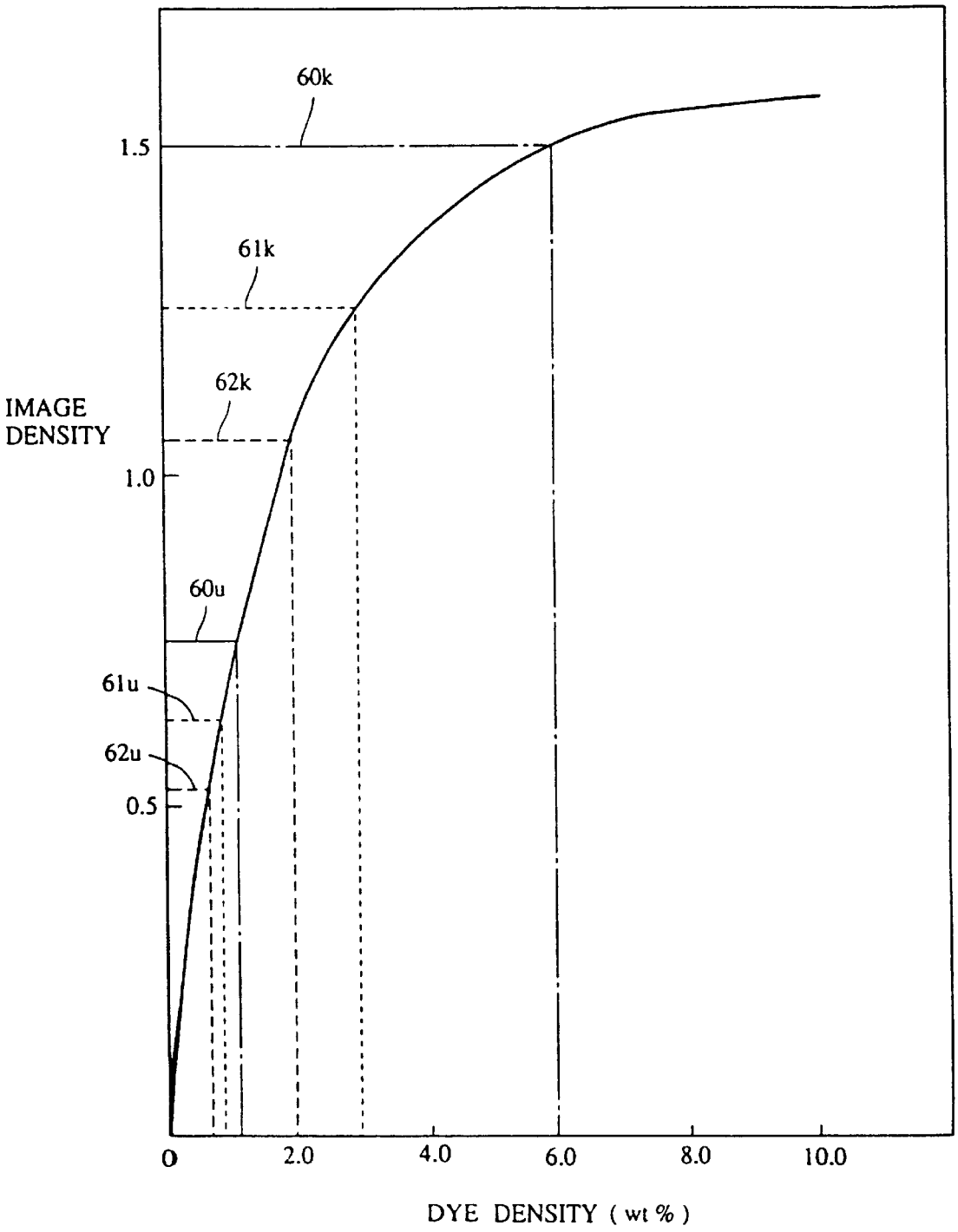
FIG. 27 is a diagram showing the relationship between dye concentration and image density.

FIG. 27 is a diagram illustrative of the relationship between dye concentration in the ink and the reflected image density of the recorded image.

Figure 28:
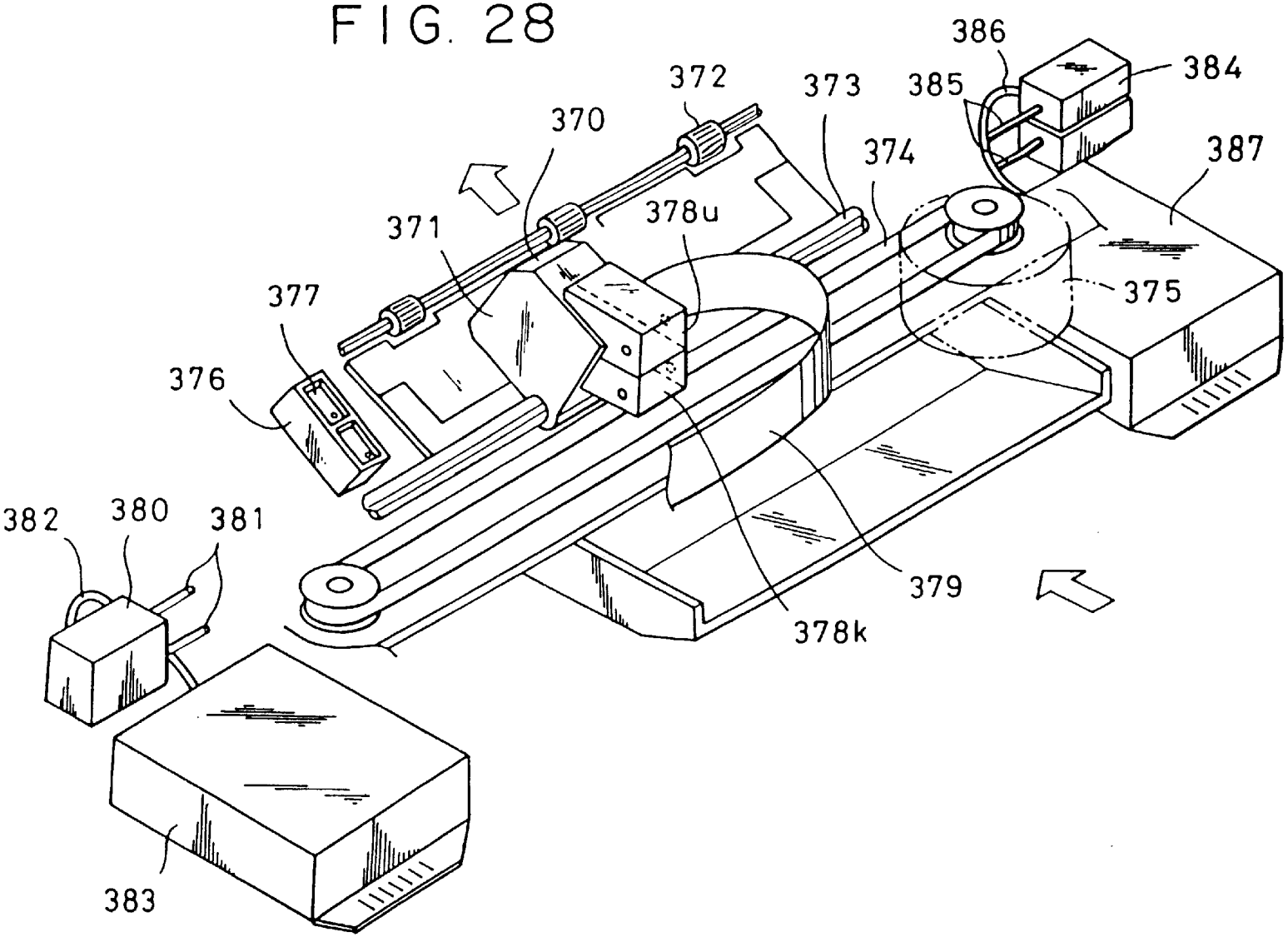
FIG. 28 is a schematic perspective view of a third embodiment of the ink jet recording apparatus of the present invention.

FIG. 28 is a perspective view of a critical portion of the ink jet recording apparatus which is included in the printer section 307. An ink jet unit 370 has an array of ink discharge openings for discharging thin or light black ink and an array of ink discharge openings for discharging thick black ink, and is carried by a carriage 371. The above-mentioned two types of inks are supplied to the respective arrays of discharge openings from sub-ink tanks 378*u* and 378*k*. Delivery of control signals and other signals to the ink jet unit 370 is conducted via a flexible cable 379.

Operations such as feed of the recording member, scanning movement of the carriage 371 and so forth are not described because they are materially the same as those explained before in connection with FIGS. 2 and 5. Ink filling pumps 380 and 384 and main ink tanks 383, 387 (ink cartridges) for supplying these ink pumps with respective inks are disposed on the left and right sides of the apparatus. At the home position side, i.e., left aide as viewed in FIG. 28, the sub-ink tanks 378*u* and 378*k* carried by the carriage 371 are supplied with clear ink by the ink filling pump 380 via a supply tube 381, whereas, at the opposite side of the stroke of the carriage, i.e., at the right side of the carriage stroke as viewed in FIG. 28, the same sub-ink tanks are supplied with the ink by the operation of the ink filling pump 384, via the ink supply tube 385.

(Construction of Ink Filling Pump)

Figure 29:
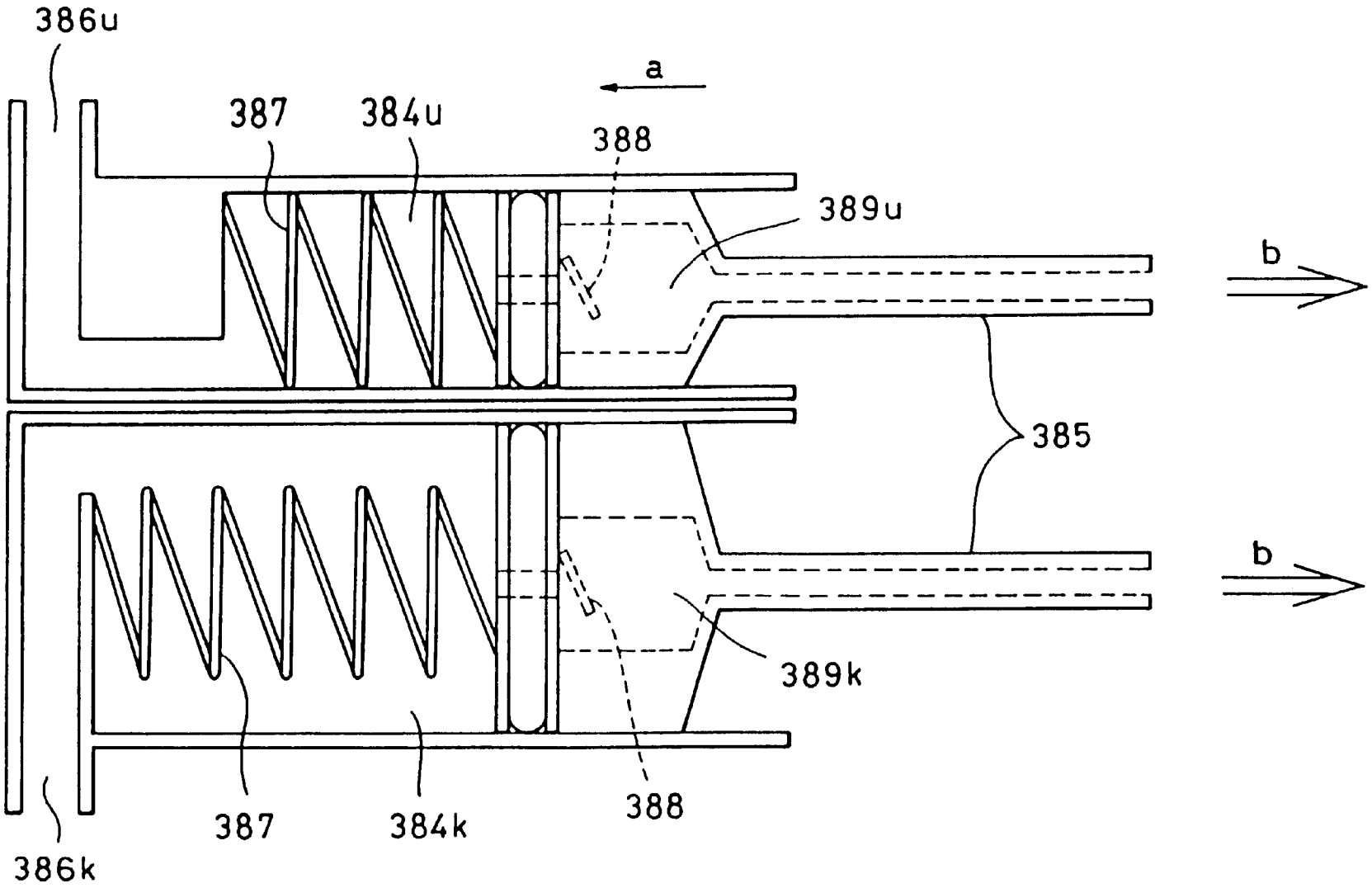
FIG. 29 is a schematic sectional view of an ink filling pump used in the embodiment shown in FIG. 28

FIG. 29 illustrates the construction of the ink filling pump for filling the sub-ink tank with the ink. More specifically, this figure shows the construction of the ink filling pump 384 which is installed on the right side of the carriage stroke as viewed in FIG. 28.

The pump 384 has pump structures for thick and thin inks, respectively. When the carriage has been brought to the ink supply position, ink supply tubes 385 integral with pistons 389*u*, 389*k* are connected to the sub-ink tanks 378*u*, 378*k* so as to be pushed in the direction of an arrow a, so that the ink in the ink chambers 384*u*, 384*k* is displaced in the direction of the arrow b through the ink supply tubes 385 so as to be supplied into the sub-ink tanks 378*u*, 378*k*. The rates of supply of the inks can be adjusted by adjusting the length of stroke of the pistons 389*u*, 389*k* in the direction of the arrow a, i.e., the amount of the movement of the carriage 371 carrying the sub-ink tanks.

As will be seen from FIG. 29, the pistons 389*u* and 389*k* have different cross-sectional areas, so that they displace inks at different rates into the sub-ink tanks. In the illustrated embodiment, the arrangement is such that the rate of supply of the ink into the thick-ink sub-ink tank 378*k* is greater than the rate of supply into the thin-ink sub-ink tank 378*u*.

As the carriage moved away from the ink supply position, the pistons are restored to the original positions by the forces of the springs 387, so that inks are introduced into the ink chambers 384*u*, 384*k* through the ink supply tubes 386*u*, 386*k*.

Figure 30:
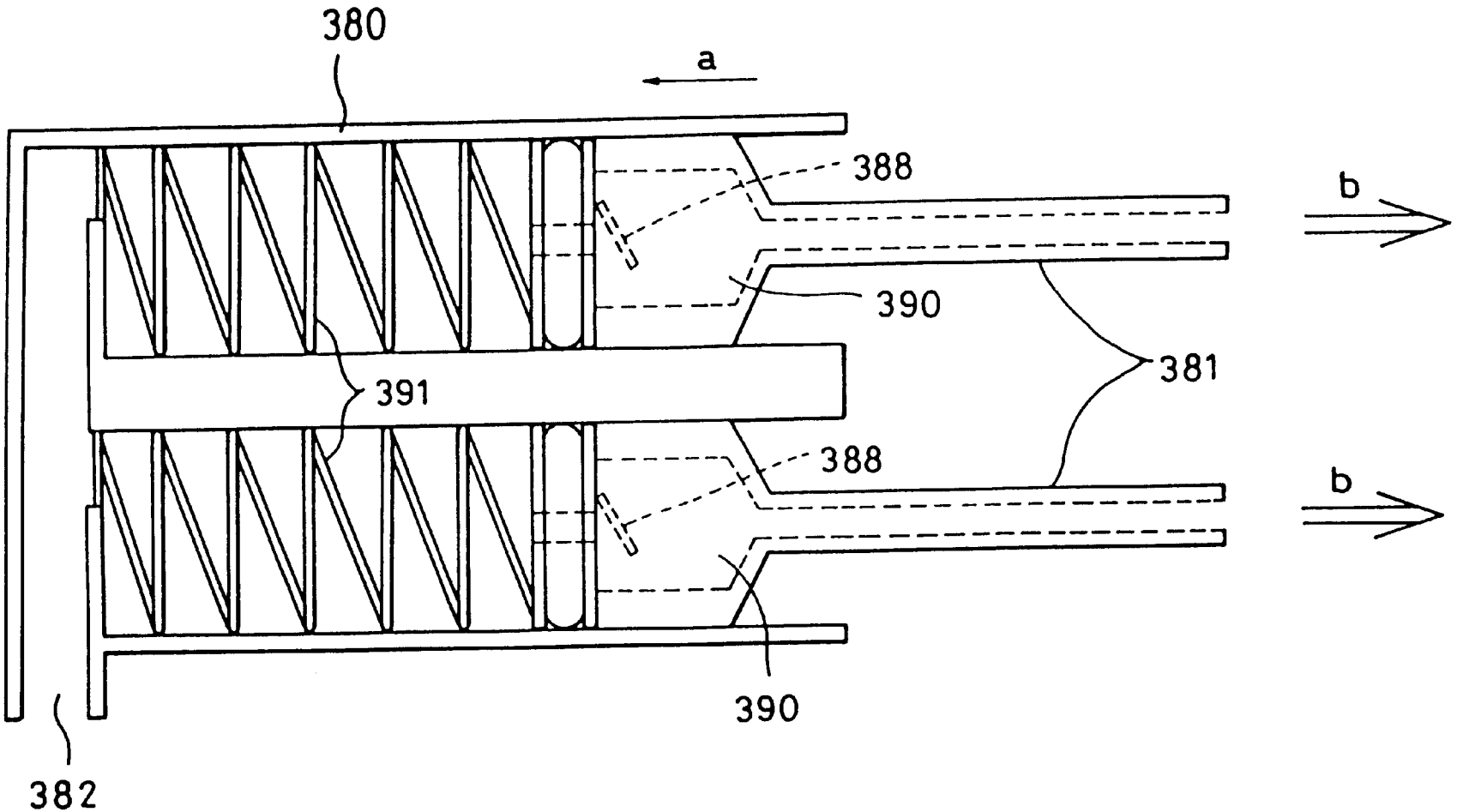
FIG. 30 is a schematic sectional view of the ink filling pump.

FIG. 30 illustrates the construction of the ink filling pump 380 which is positioned at the same side of the carriage stroke as the home position and which supplies a clear ink to the sub-ink tanks. The construction is materially the same as that of the pump shown in FIG. 29 so that detailed description is omitted with regard to this pump. It is to be noted, however, that the rate of supply of the clear ink for a given piston stroke are different from those in the pump shown in FIG. 29.

Figure 31A:
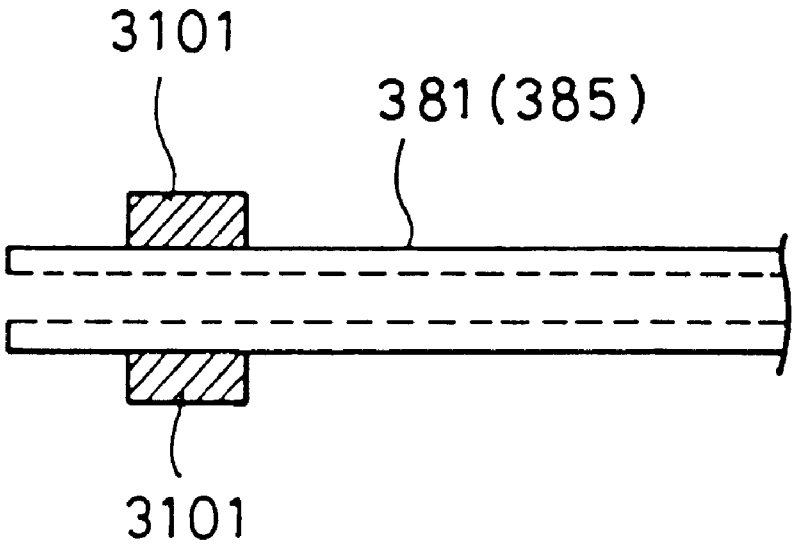
FIGS. 31(*a*) and 31(*b*) are schematic illustrations of two examples of an ink supply tube used in the ink filling pump.
Figure 31B:
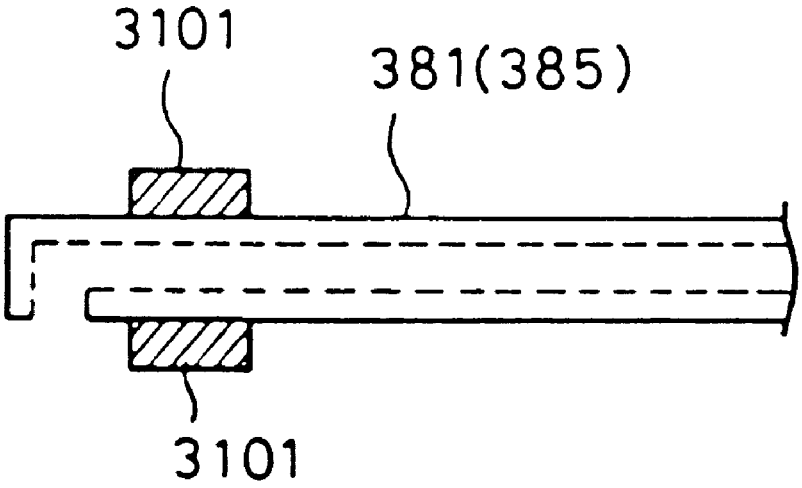

FIGS. 31(*a*) and 31(*b*) are illustrations of the ink supply tubes used in the ink filling pump. In FIG. 31(*a*), an ink passage opens on the end surface of the tube, whereas, in FIG. 31(*b*), the ink passage opens at the peripheral surface of the tube adjacent to the end thereof.

(Construction of Sub-Ink Tank)

Figure 32A:
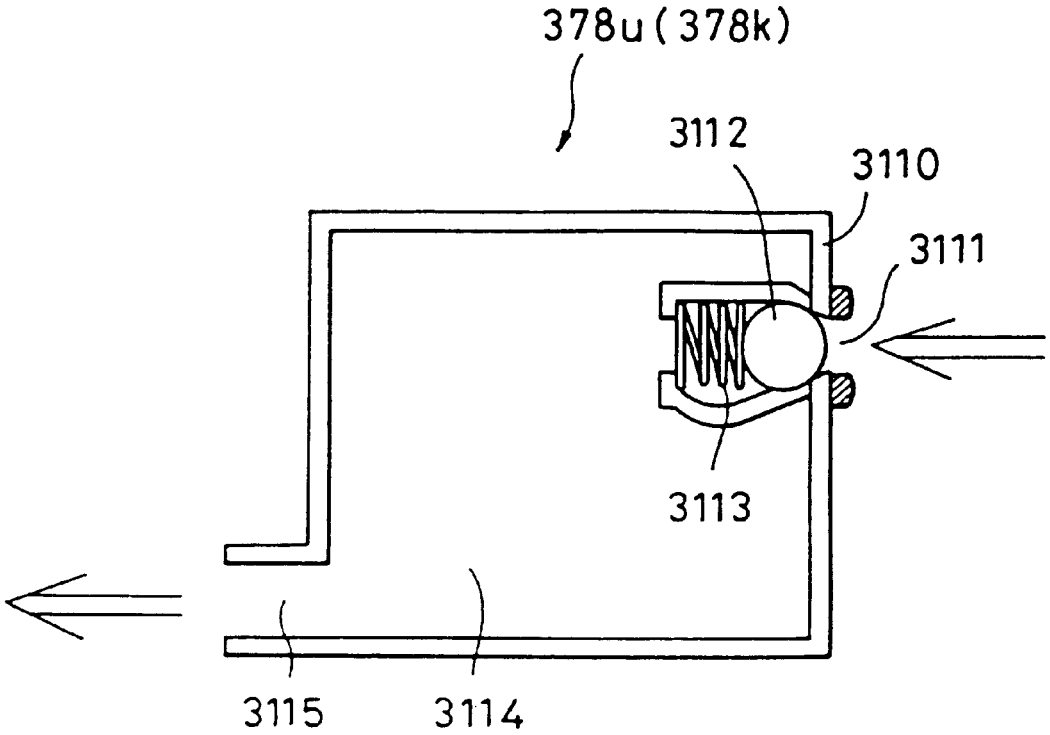
FIGS. 32(*a*) and 32(*b*) are schematic sectional views of a sub-ink tank used in the apparatus shown in FIG. 28.
Figure 32B:
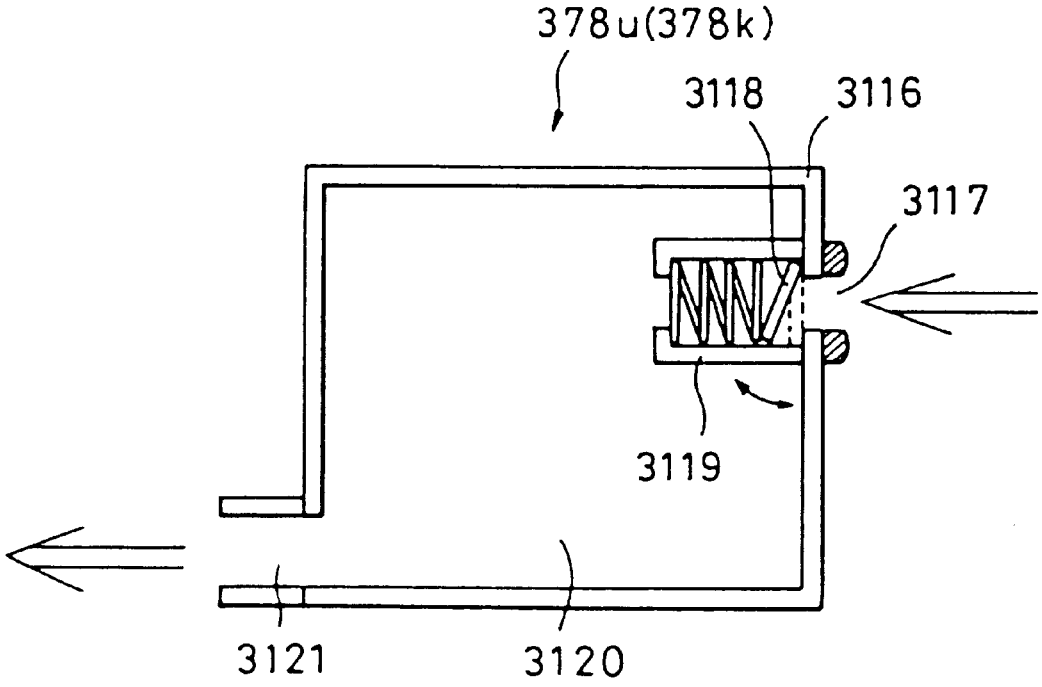

FIGS. 32(*a*) and 32(*b*) are schematic sectional views showing the construction of a critical portion of the sub-ink tank 378. In order to prevent evaporation of the ink from the sub-ink tank 378, the tank structure shown in FIG. 32(*a*) employs a ball valve 3112 which can block the supply port 3111, while the structure shown in FIG. 32(*b*) employs a plate valve 3118 for blocking the supply port 3117.

Referring to FIG. 32(*a*), when the supply tube of the ink filling pump is inserted into the supply port 3111 of the sub-ink tank 378, the ball valve 3112 is pressed by the supply tube so as to open the supply port 3111. Then, as the supply tube is extracted after completion of filling of the ink, the ball valve 3111 is urged by a spring 3119 into contact with the rim of the supply port, thereby closing the latter.

Figure 33A:
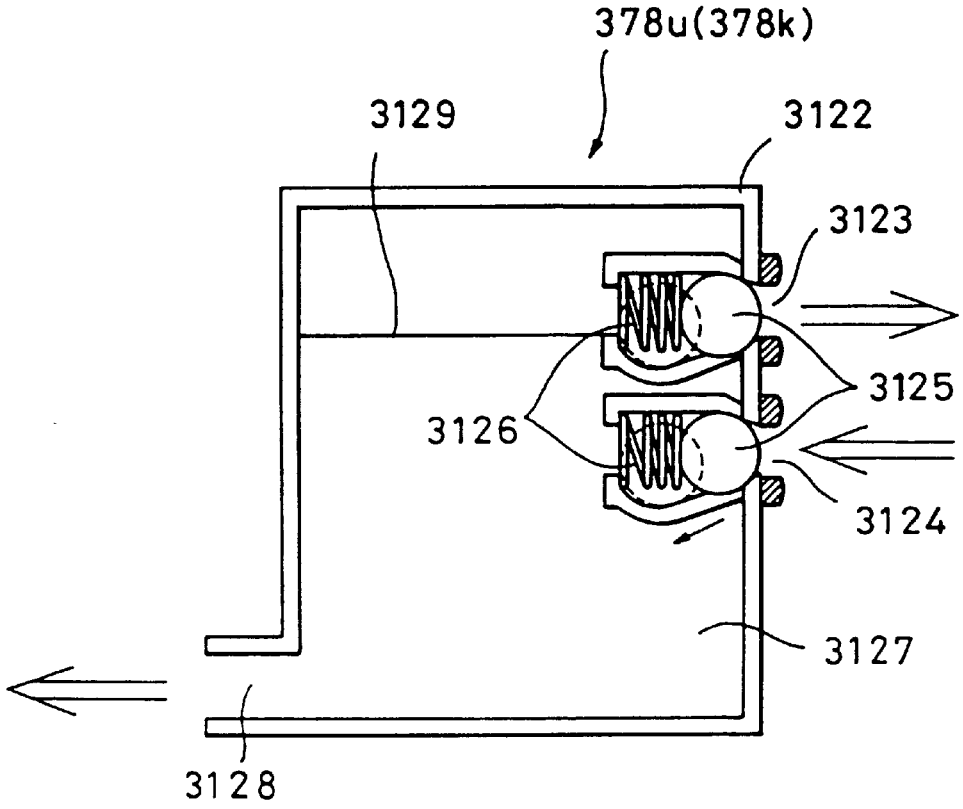
FIGS. 33(*a*) and 33(*b*) are schematic sectional views of other examples of the sub-ink tank.
Figure 33B:
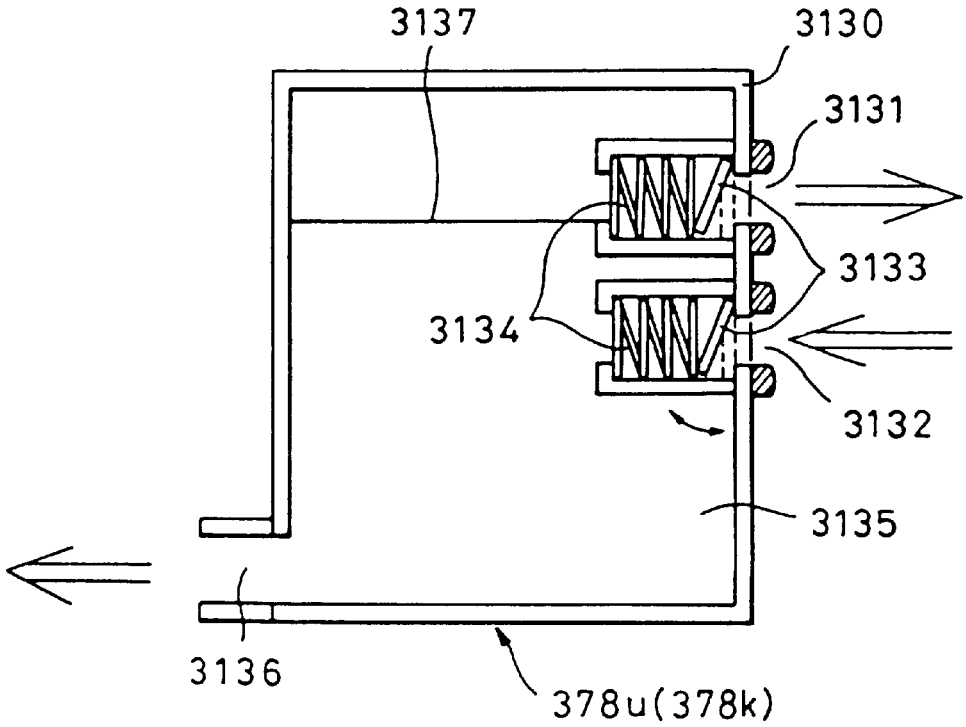

FIGS. 33(*a*) and 33(*b*) show sub-ink structures each of which has an overflow port for maintaining a constant ink level in the sub-tank, in addition to the ink supply port.

This sub-ink structure requires a tube or other means for returning the overflow ink to the filling pump.

In order to prevent evaporation of the ink in the sub-ink tank 378, the structure shown in FIG. 33(*a*) employs ball valves 3125 for closing the supply port 3124 and the overflow port 3123, while the structure shown in FIG. 33(*b*) employs plate valves 3133 for closing the supply port 3132 and the overflow port 3131.

Referring to FIG. 33(*a*), when the ink supply tube and the overflow tube are inserted into an ink supply port 3124 and overflow port 3123, the ball valves 3125 are displaced by these tubes so that the supply port and the overflow port are opened. After the completion of supply of the ink, the supply tube and the overflow tube are extracted from the respective ports, so that the ball valves 3125 are returned by the force of the springs 3126 so as to close the supply and overflow ports again.

Referring now to FIG. 33(*b*), when the supply tube and the overflow tube of the ink filling port are inserted into the supply and overflow ports in the sub-ink tank, the valve member is displaced by these tubes so as to open the supply port 3131 and the overflow port 3132. After the completion of filling of the sub-ink tank, the supply tube and the overflow tube are extracted so that the valves 3133 are returned by the force of the springs 3134 so as to close the supply and overflow ports again.

Considering the manner of contact between the end of the ink supply tube and the valve member, the sub-ink tank structures shown in FIGS. 32(*a*) and 32(*b*) are preferably used in combination with the tube structure shown in FIG. 31(*a*), while the sub-ink tank structures shown in FIGS. 31A and 32(*a*) are used in combination with the tube structure shown in FIG. 31(*b*).

(Recording Head)

The recording head used in this embodiment has, for example, a construction similar to that shown in FIG. 17. The description of the recording head is therefore omitted. The structure of the grooved top plate also is similar to that shown in FIG. 9 having ink chambers or thick and thin inks and, therefore, detailed description is omitted also in this connection.

(Construction of Ink Discharge Opening Array and Example of Image Recorded)

Figure 34:
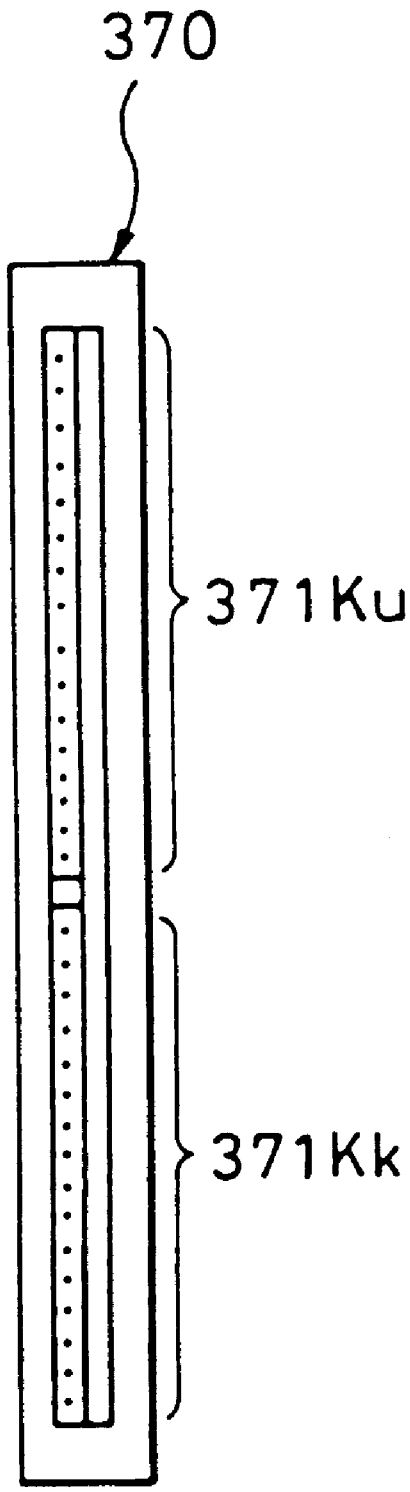
FIG. 34 is a schematic front elevational view of a recording head used in the apparatus shown in FIG. 28, illustrating particularly arrays of discharge openings.

FIG. 34 is a plan view of the recording head as viewed in the direction opposing the surface having arrays of ink discharge openings.

As in the case of each of the preceding embodiments, an array for thick black ink and an array for thin black ink are arranged in series in each recording head.

More specifically, the recording head 370 has an array 371Kк of discharge openings for thick black ink and an array 371$K_u$ of discharge openings for thin black ink. These arrays 371$K_k$, 371$K_u$ are arranged in series and each of these arrays has 32 discharge openings arranged at a pitch of 360 dpi. These arrays are separated from each other by a wall of the ink chamber which has a thickness corresponding to eight pitches of the discharge openings.

Figure 35:
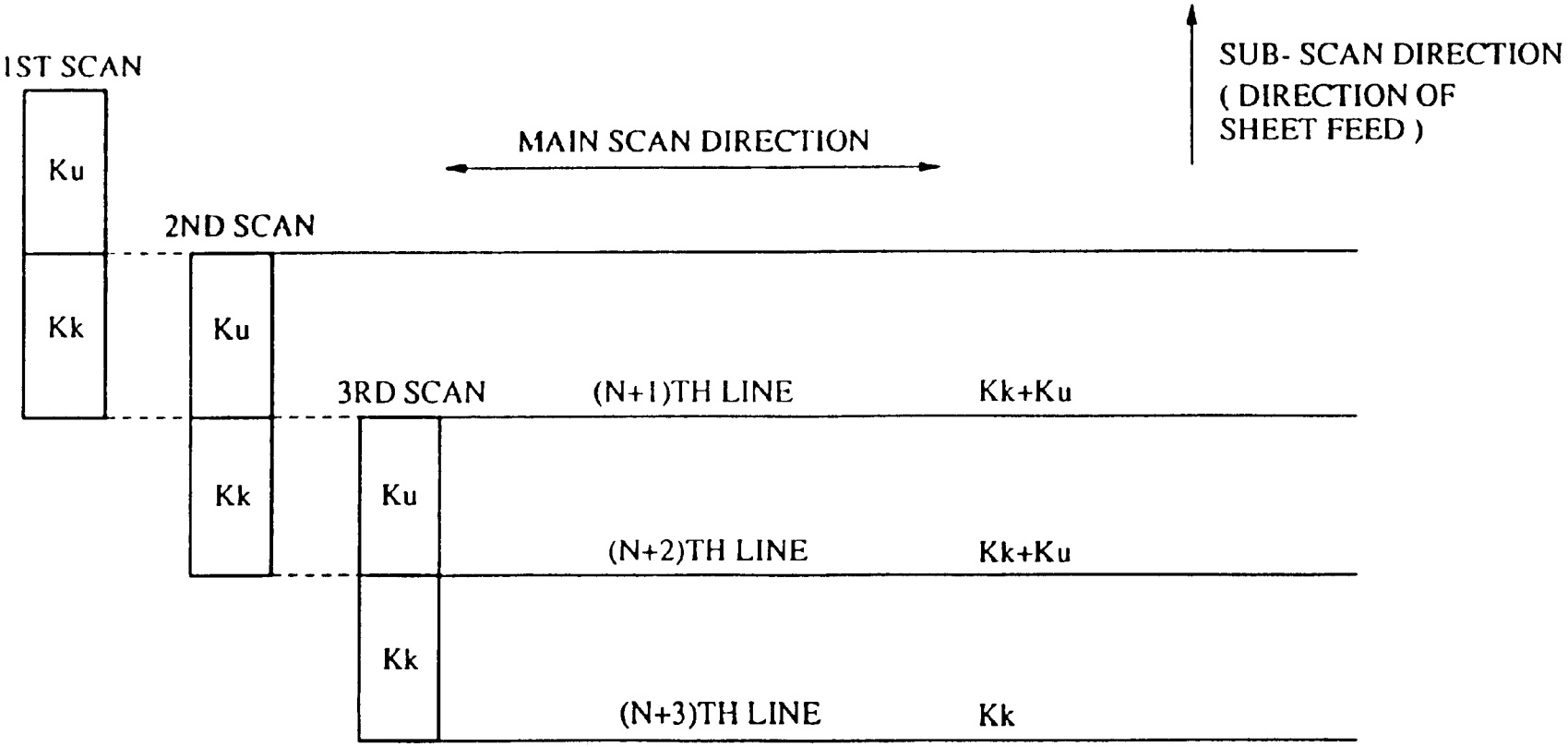
FIG. 35 is a schematic illustration illustrative of a recording method using the recording head shown in FIG. 34.

FIG. 35 is a schematic illustration of the process for forming an image in this embodiment. In the following description of the recording operation, an assumption is made that there is no spacing between the arrays of discharge openings for thick and thin inks.

Recording of the (N+1)h line, for example, is conducted by the following method. In the first scanning operation, recording with the thick black ink is performed followed by a feed of the recording member by a predetermined feed length (referred to as "line feed LF"). In a second scanning, recording is performed with thin black ink, followed by a line feed LF, whereby the image of the (N+1)th line is completely formed. The amount of each line feed LF corresponds to 32 dots. Thus, an image portion having a width corresponding to 32 dots is formed by two successive scanning cycles performed by the recording head.

In the recording operation as described, only one type of ink is used in a single cycle of scanning performed by the recording head, so that image is recorded with excellent quality without being affected by blur which otherwise may occur due to interference between two types of inks.

In the described embodiment, the recording head has ink discharge opening arrays formed in the same surface of the head for discharging inks of different thickness levels supplied from separate common ink chambers. With this arrangement, it is possible to reduce the number of recording heads to be employed, thus contributing to reduction in the size of the recording apparatus. Furthermore, the recording head used in this embodiment eliminates the necessity for a high degree of precision of dot position control or a complicated position correcting operation which hitherto have been necessary, by virtue of the fact that the arrays of discharge openings can be formed with a high degree of positional and dimensional precision, with a reduced cost, thus further contributing to reduction in the cost of production of the apparatus.

From the viewpoint of need for correction of ink discharging timing, it is preferred that the arrays of the discharge openings be arranged on a common straight line. Such an arrangement of the ink discharge openings, however, is not mandatory and the arrangement may be modified such that the arrays of discharge openings for discharging inks of different thickness levels are disposed side by side or in a staggered manner. The arrangement also may be such that the arrays for discharging inks of different thickness levels employ different numbers of ink discharge openings.

(Ink Supply Operation)

Figure 36:
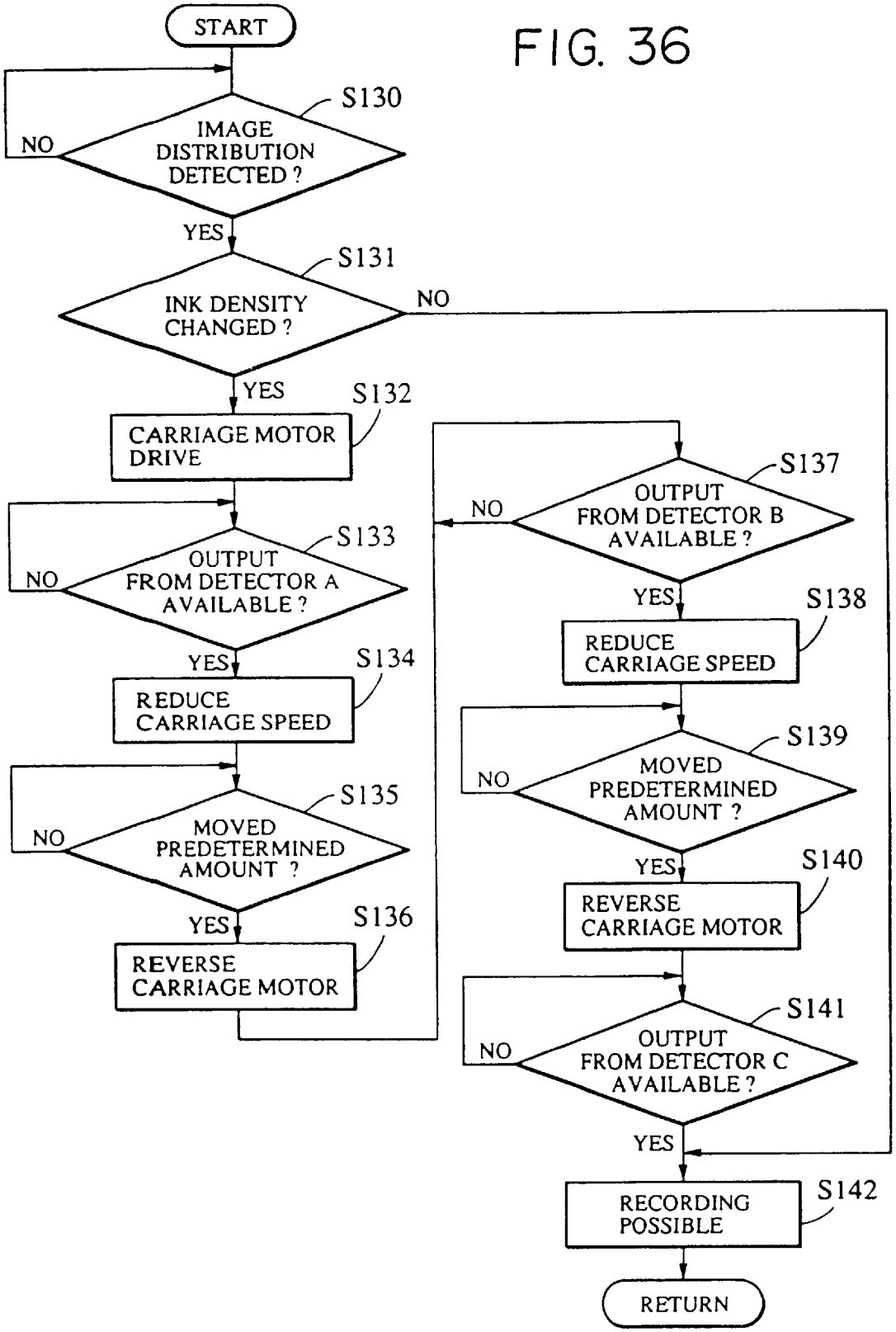
FIG. 36 is a flow chart illustrative of the ink filling process for changing the recording density in the third embodiment.

FIG. 36 is a flow chart illustrating the ink supply process for varying the thickness level of the ink in the described embodiment.

This ink supply process includes histogram processing 322, ink mixing ratio determination 323 and ink mixing control 324, which are shown in FIG. 23.

As the process is started, image distribution is detected from the record data in Step S130. Then, in Step S131, whether the ink thickness level is to be changed is determined by the ink mixing ratio determination function 323, based on the density distribution of an image to be recorded as detected by the histogram processing function 322. When Step S131 has determined that the ink thickness level is to be changed. Steps S132, S133 and S134 are sequentially executed to move the carriage 371 to the left end of the apparatus to bring the supply tubes 381 of the pump into connection with the sub-tanks 378*u,* 378*k.* Then, Step S135 is executed to control the amount of movement of the carriage, in accordance with the amount of the clear ink to be supplied.

After completion of the routine for supplying the clear ink, Steps S136 to S139 are sequentially executed so that the carriage 371 is moved to the right end of the apparatus, where a control similar to that for the supply of clear ink is performed so as to supply thick and thin inks, so that the thin and thick inks are mixed with the clear ink within the sub-ink tanks 378*u,* 378*k,* whereby thick and thin inks are prepared to have desired levels of thickness.

After completion of the thickness changing operation described above, Steps S140 and S141 are executed to bring the carriage 371 back to a predetermined position, followed by execution of Step S142 in which the carriage is stationed for the recording operation.

In the third embodiment of the invention, by virtue of the construction described before, inks of desired thickness levels can be obtained through the mixing, thus attaining an image which excels in gradation. Furthermore, since either one of thick and thin inks is used in each cycle of scan performed by the recording head, any blur which otherwise may be caused by overlap or interference of dots of different inks is avoided, whereby a high quality recorded image can be obtained.

(Modification of Third Embodiment)

As in the first and second embodiments described before, the third embodiment can be applied to a color ink jet recording apparatus which uses four types of inks having different colors.

A color ink jet recording apparatus as a modification of the third embodiment will be described with reference to FIGS. 37 to 42. The following description will be focused mainly on the points which distinguish the modification from the third embodiment.

Figure 37:
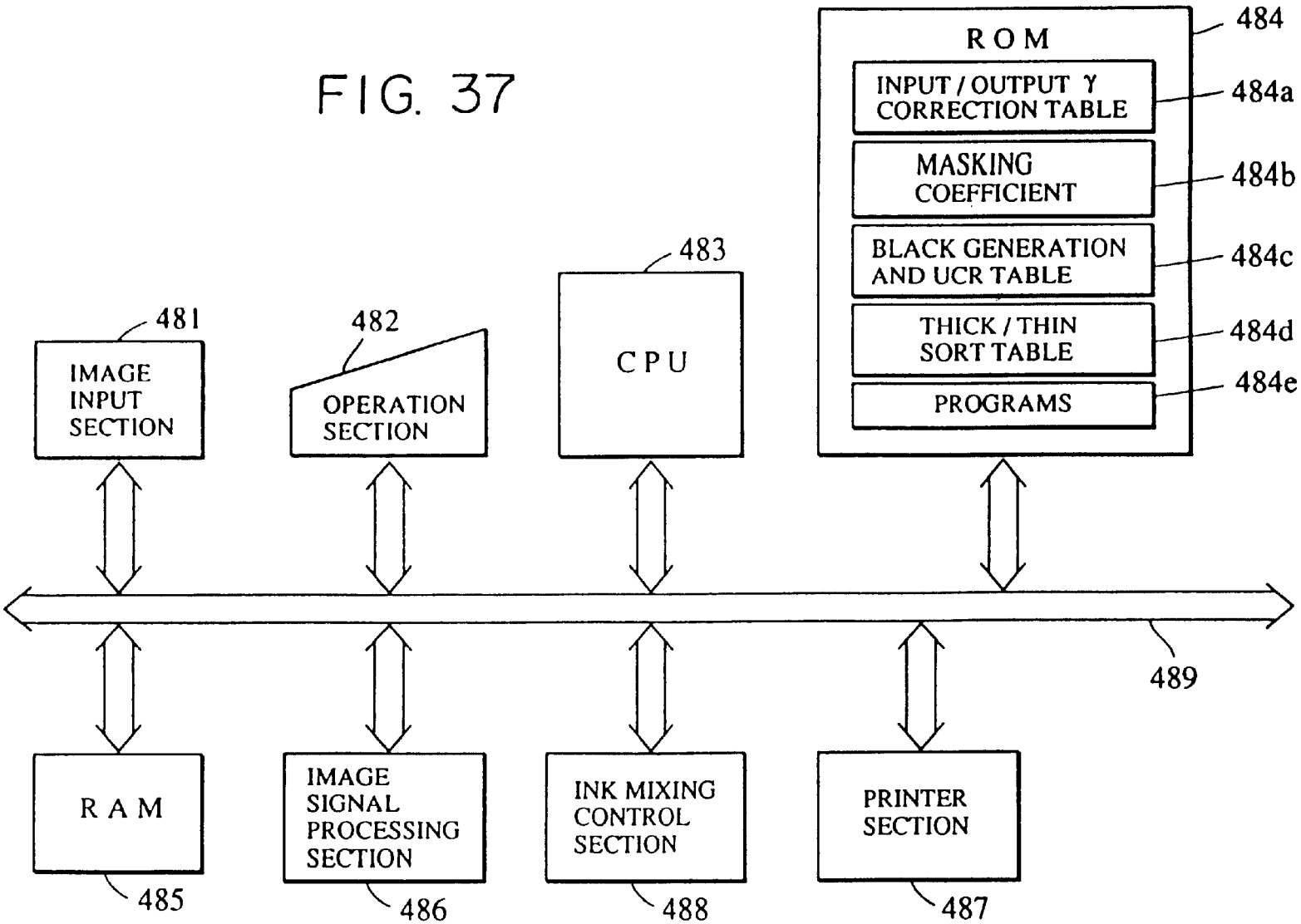
FIG. 37 is a block diagram of an ink jet recording apparatus as a modification of the third embodiment.

Referring to FIG. 37, a ROM 484 includes an input/output γ conversion table 484*a* which is referred to in the processing performed by the input/output γ conversion circuit, masking coefficient table 484*b* which is referred to in the processing performed by a color correction (masking) circuit, black generation and UCR table 484*c* which is referred to in processing performed by black generation and UCR circuits, a thick/thin sorting table 484d which is referred to in the processing performed by the thick/thin sorting circuit, and various programs 484*e.*

Figure 38:
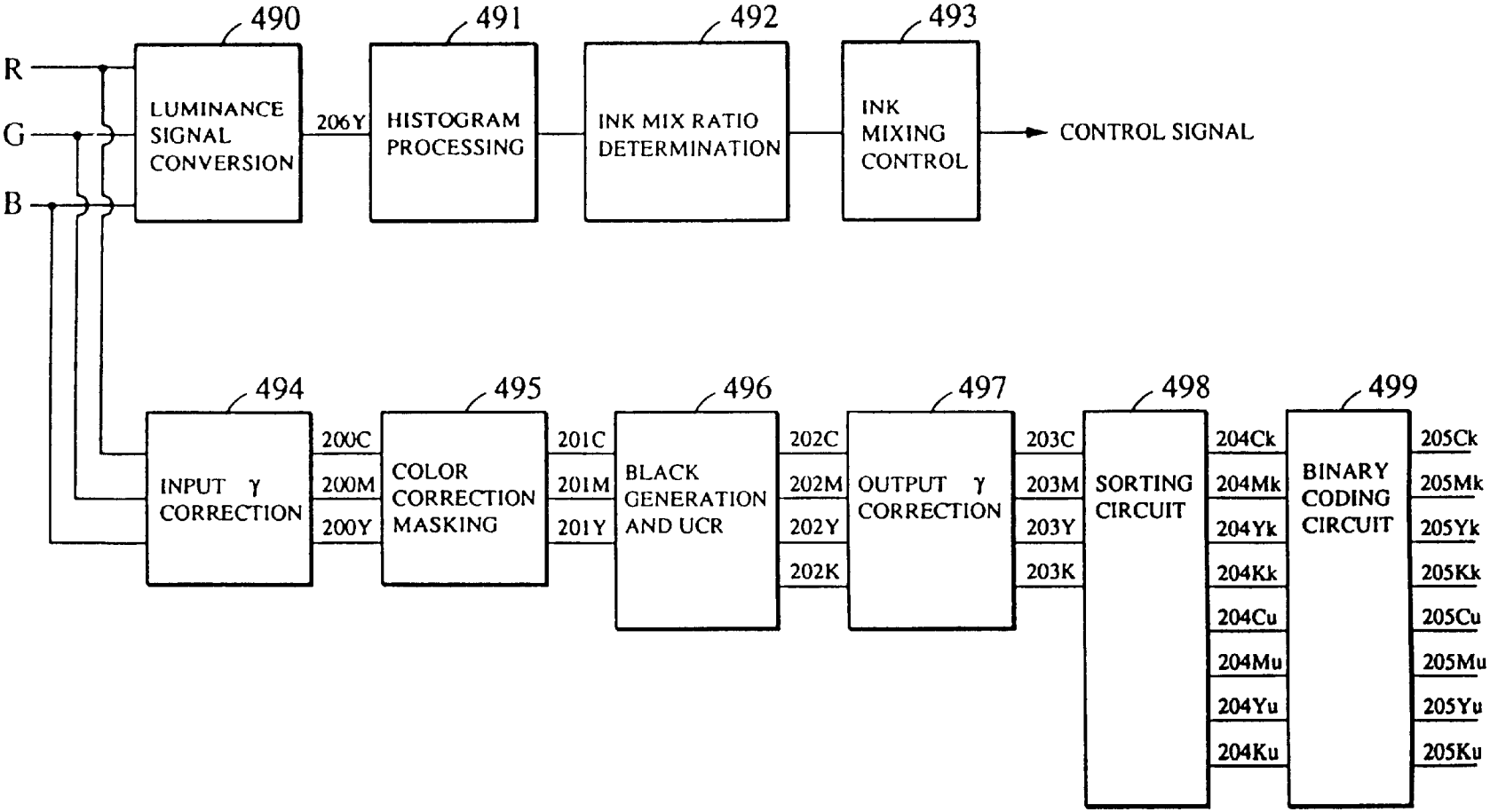
FIG. 38 is a block diagram showing the detail of constructions of an image signal processing section and an ink mixing control section.

FIG. 38 shows the image signal processing section of this embodiment. Image signals R, G and B corresponding to red, green and blue colors are respectively converted into image density signals of cyan, magenta and yellow colors, through the input γ correction circuit 494. After processing through the color correction (masking) circuit 495 and the black generation/UCR (Under Color Removal) circuit 496, the signals are converted into image density signals of cyan, magenta, yellow and black. Then, an output γ correction is effected on these signals through the output γ correction circuit 497. The cyan, magenta, yellow and black image density signals are then processed through the thick/thin sorting circuit 498 so as to be sorted into thick image density signals corresponding to high dye concentration, i.e., thick cyan, thick magenta, thick yellow and thick black and thin image density signals corresponding to low dye concentration, i.e., thin cyan, thin magenta, thin yellow and thin black.

Figure 39:
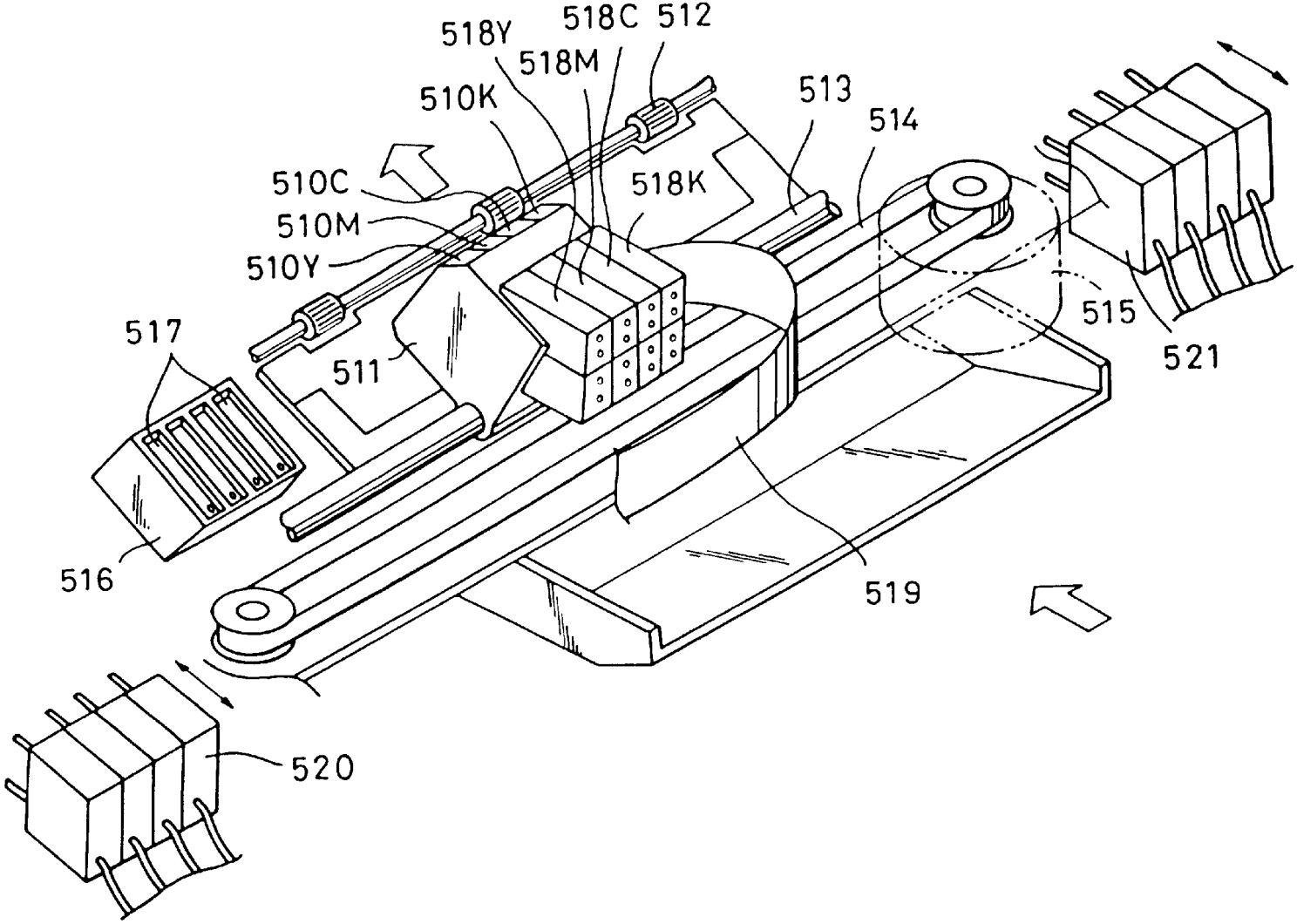
FIG. 39 is a perspective view of the ink jet recording apparatus of the modification shown in FIG. 37.

FIG. 39 is a perspective view showing the critical portions of the color ink jet recording apparatus.

This recording apparatus is distinguished from that shown in FIG. 28 in that the pumps 520 and 521 which are disposed on both sides of the apparatus are movable by moving mechanisms which are not shown, so as to be connected to the sub-tanks 518Y, 518M, 518C and 518K which are carried by the carriage 511.

Figure 40:
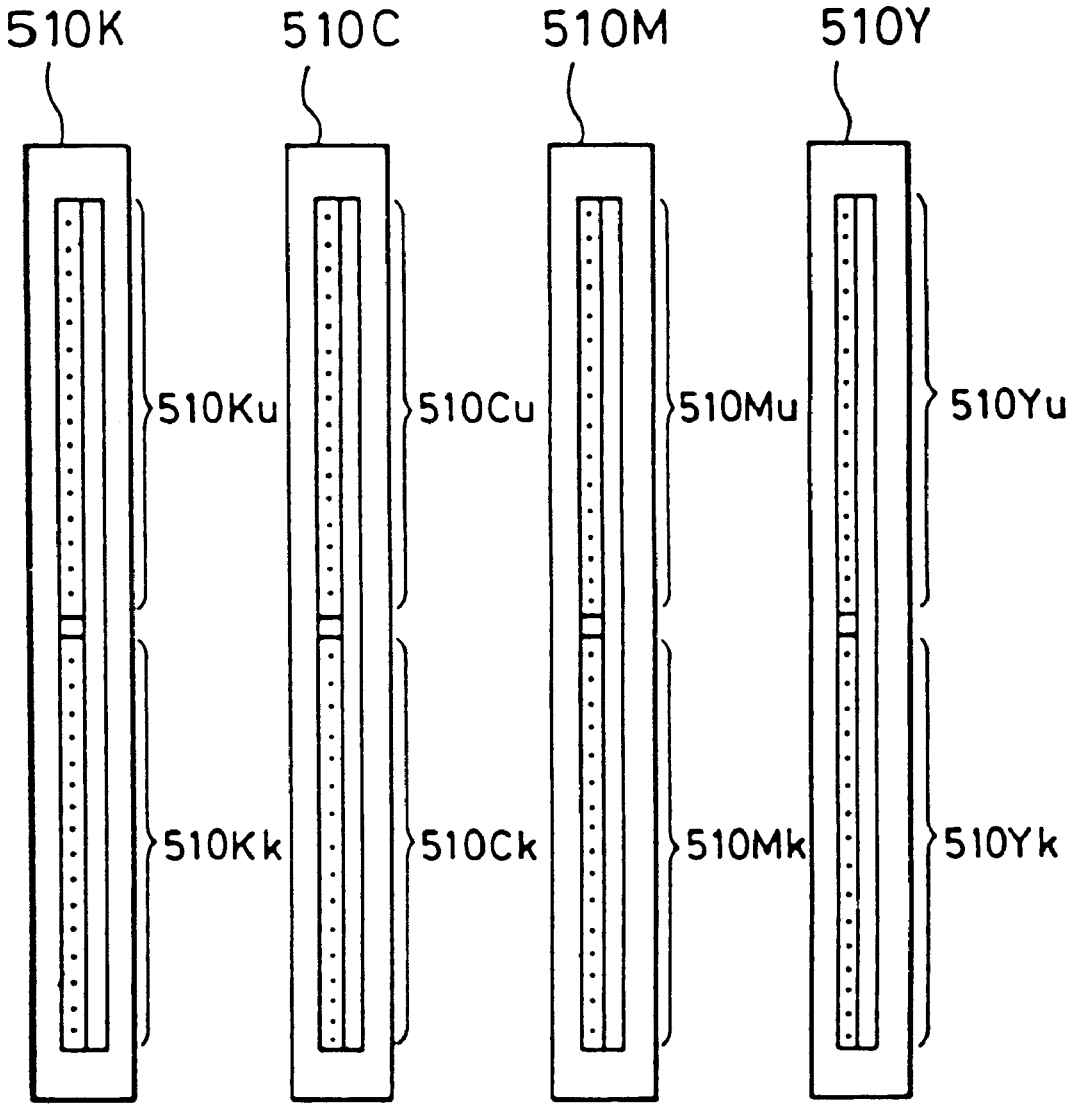
FIG. 40 is a schematic front elevational view of a recording head used in the ink jet recording apparatus of FIG. 39, illustrating particularly arrays of discharge openings.

FIG. 40 illustrates a recording head unit as viewed in the direction opposing the surface having the arrays of ink discharge openings.

In this apparatus, each recording head corresponding to one of the four colors is provided with an array of discharge openings for thick ink and an array of discharge openings for thin ink, and four such recording head are assembled together to form an ink jet unit. The arrangement of the arrays of discharge openings of each head corresponding to one color is the same as that shown in FIG. 34.

Figure 41:
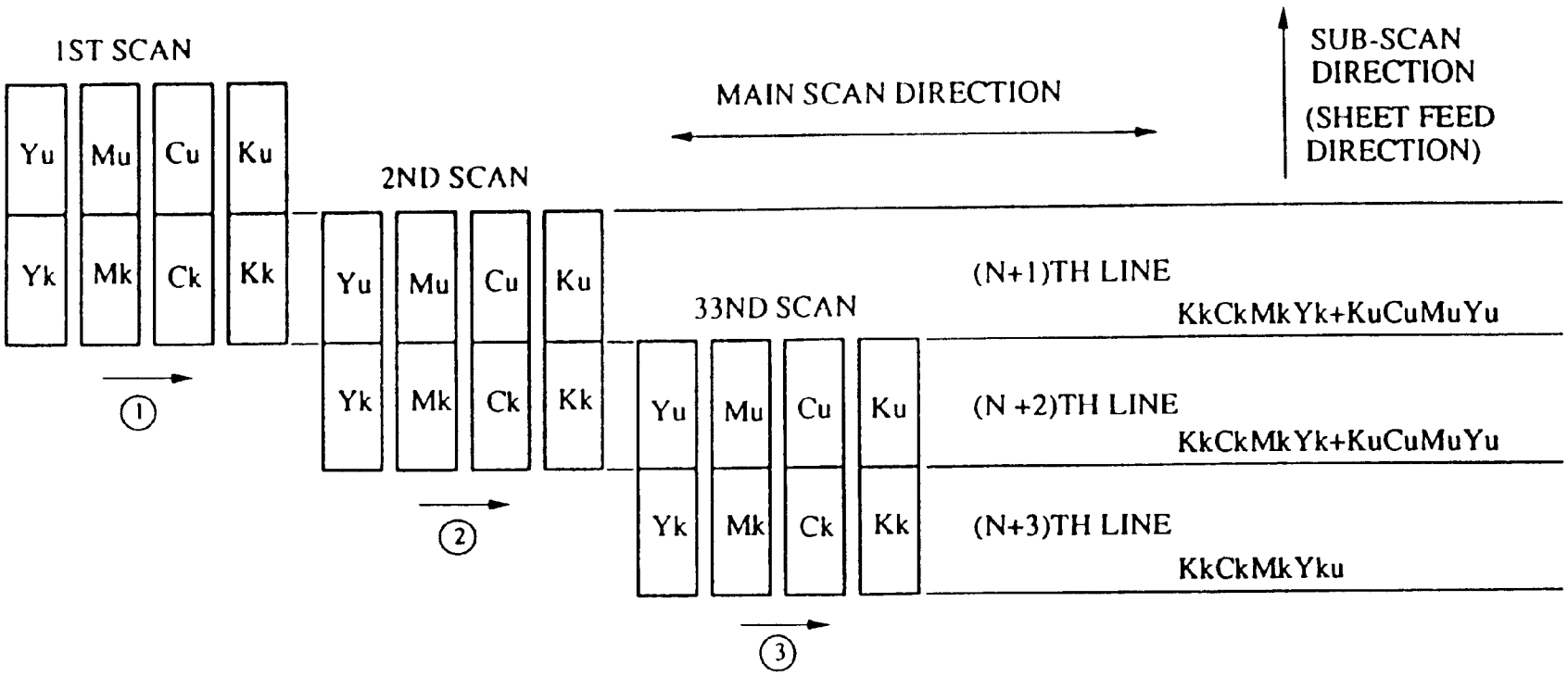
FIG. 41 is a schematic illustration of the recording method conducted by using the recording head of FIG. 40.

A description will now be given of the image forming process performed by this color ink jet recording apparatus, with reference to FIG. 41, which schematically shows this process, based on the assumption that there is no gap between the array of thick ink discharge openings and the array of the thin ink discharge openings, as in the operation which was described before in connection with FIG. 35.

Regarding the recording of data of (N+1) th line, recording with thick inks of black, cyan, magenta and yellow inks is conducted in a first scanning cycle follows by a line feed LF. In a subsequent or second scanning cycle, recording is conducted with thin inks of black, cyan, magenta and yellow inks, followed by a line feed. The amount of line feed LF conducted after each scanning corresponds to 64 dots. Thus, an image is recorded over a width corresponding of 64 dots, through two successive scanning cycles.

As in the case of the preceding embodiments, the described color ink jet recording apparatus can produce an image of high quality without suffering from blur, because thick and thin inks are not simultaneously used in each scanning cycle. Actual ink jet unit operation involves blanks between successive colors, so that the juncture between successive scans of each color appear at different positions, thus suppressing generation of distinctive score lines at the boundary between successive scans.

The described arrangement also is effective in suppressing mixing of colors which tends to occur during discharge recovery operation. In particular, the recording head is preferably constructed such that the array of ink discharge openings for thin inks having lower level of thickness is disposed at the upper side of the array of discharge openings for thick ink. Such an arrangement is effective in preventing mixing of inks due to dragging after a sucking operation for recovering safe discharging condition.

Figure 42:
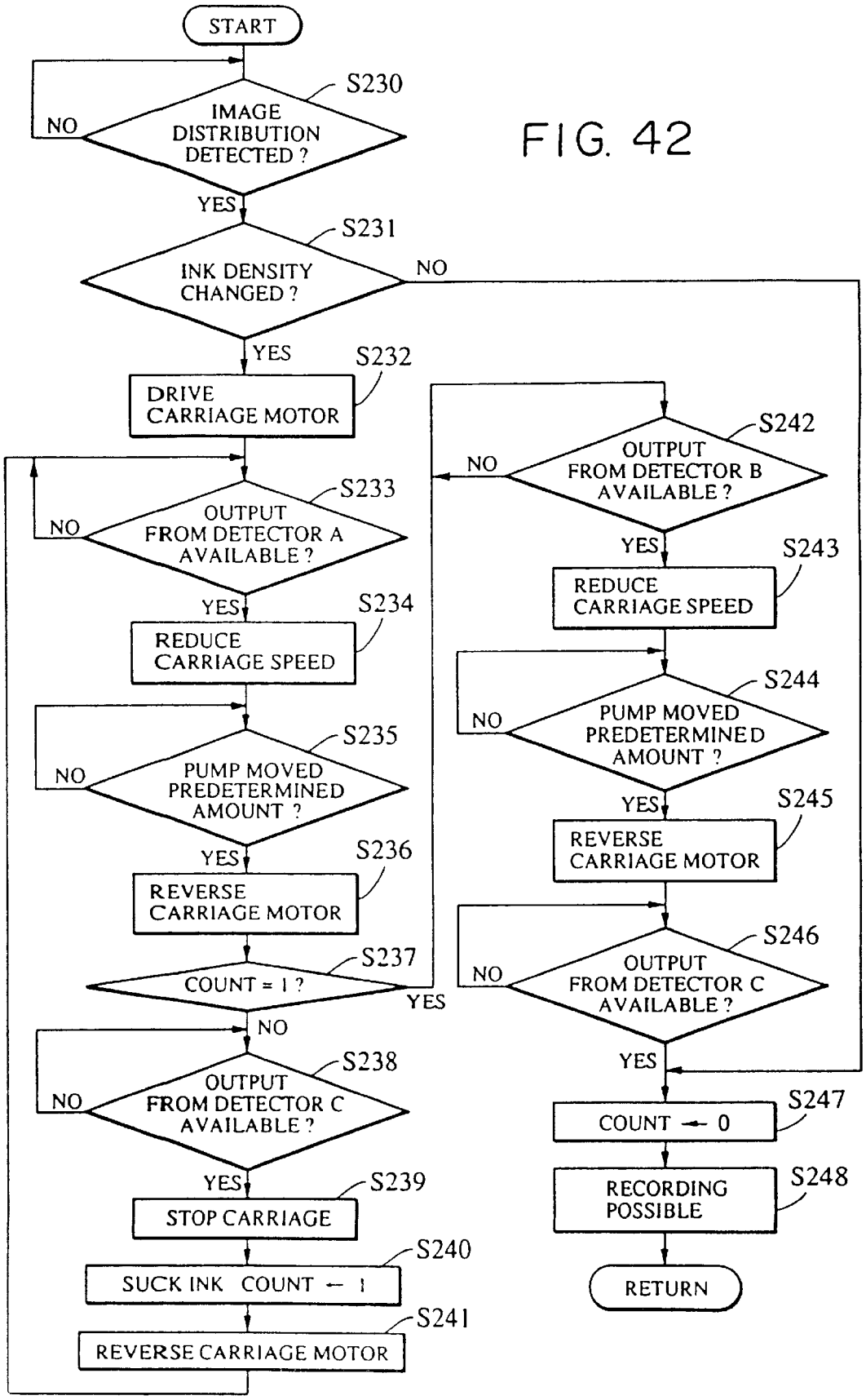
FIG. 42 is a flow chart showing an ink filling process for changing image density in the modification shown in FIG. 37.

FIG. 42 is a flow chart illustrative of the ink supplying process which is executed when the level of ink thickness is to be changed.

The process illustrated in FIG. 42 is discriminated from that process shown in FIG. 36 by Steps S238 to S240 in which inks are sucked from the respective recording heads after supply of inks to the respective sub-tanks.

(Another Modification of Third Embodiment)

Another modification of the third embodiment will be described.

Figure 43:
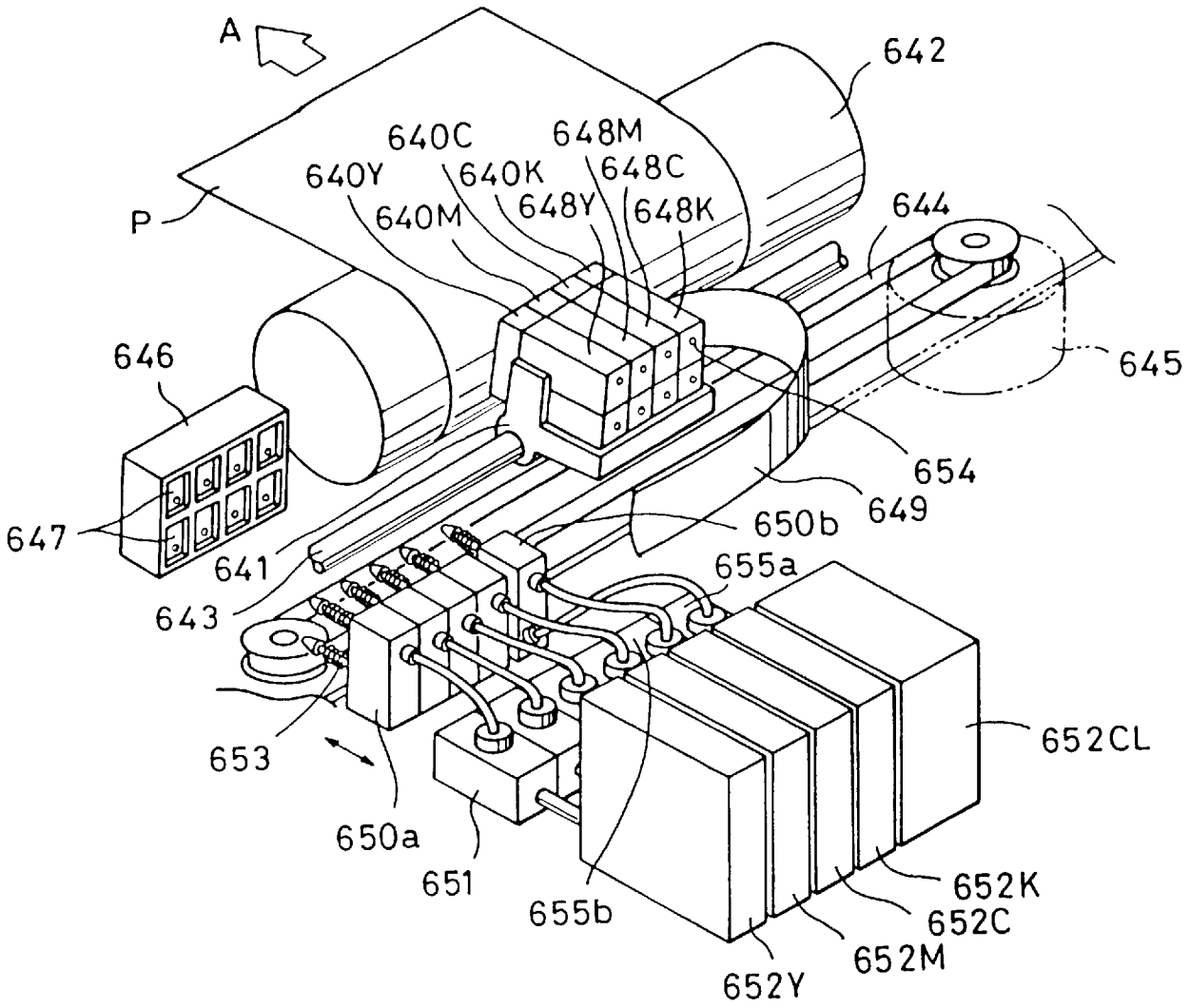
FIG. 43 is a perspective view of an ink jet recording apparatus as another modification of the third embodiment.

FIG. 43 is a perspective view of a color ink jet recording apparatus as the above-described modification of the third embodiment, showing particularly critical portions of the modification.

In this color ink jet recording apparatus, pumps 651 for supplying thick and thin inks and pumps 655*a*, 655*b* for supplying clear ink are disposed on the left end portion of the apparatus. As will be seen from this Figure, the ink tanks of inks of the respective colors are supplied with the inks simultaneously as a result of movement of an integral supply block 650*a*. In contrast, the clear ink is supplied to the sub-tanks of the different colors one after another. It will be understood that this embodiment produces the same advantages as those offered by the third embodiment.

(Fourth Embodiment)

A description will now be given of a fourth embodiment of the ink jet recording apparatus of the present invention which uses inks containing dyes and a clear ink which does not contain any dye, so as to enable blending of inks having different compositions within the apparatus.

Figure 47:
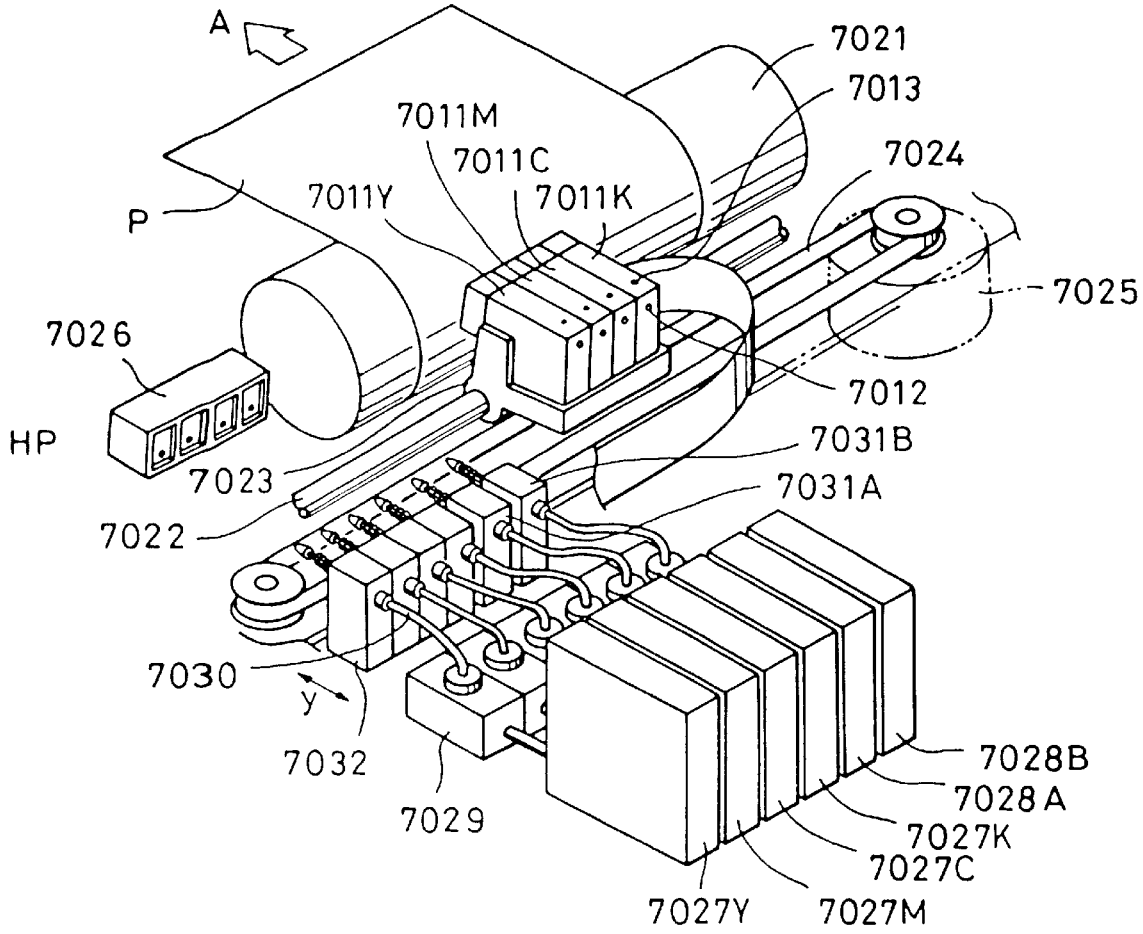
FIG. 47 is a schematic illustration of a fourth embodiment of the ink jet recording apparatus of the present invention.

FIG. 47 is a perspective view of critical portions of a color ink jet recording apparatus as the fourth embodiment of the present invention.

This embodiment has ink jet units 7011K, 7011C, 7011M and 7011Y which have arrays of ink discharge openings for discharging inks of black (K), cyan (C), magenta (M) and yellow (Y) colors. These ink jet units are mounted on a carriage 7023 at a predetermined spacing. Numeral 7012 denotes an ink supply port for supplying an ink to the ink jet unit 7011, while 7013 denotes a vent hole through which the interior of the ink jet unit communicates with the atmosphere.

A recording member P such as recording paper or plastic sheet is fed in the direction of the arrow A while being guided by a platen roller 7021.

The carriage 7023 is adapted to move along an encoder (not shown) while being guided by a guide shaft 7022.

More specifically, the carriage 7023 is driven by a carriage motor 7025 through a driving belt 7024 so as to reciprocally move along the guide shaft 7022.

A heat generating element (electro-thermal transducer), as means for generating thermal energy for discharging an ink, is disposed in each ink channel leading to corresponding ink discharge opening formed in the ink jet unit.

In operation, the electro-thermal transducers are activated based on recording signals in accordance with reading timing provided by the encoder (not shown), so that discrete ink droplets are made to fly towards and deposit on the recording member P, thereby forming an image.

A recovery unit having a cap device 7026 is disposed at a home position (HP) for the carriage which is set outside the recording region. The carriage 7023, when not operating, is stationed at the home position HP so that the surface of each ink jet unit having ink discharge openings is capped with the corresponding cap, thereby preventing clogging of ink discharge openings which otherwise may be caused by foreign matter such as dust or ink which has been solidified due to evaporation of the solvent.

The above-described capping function of the cap device 7026 also is used in other operations which are performed to avoid any discharge failure or clogging in discharge openings which are not used frequently. For instance, a purging operation is performed in which ink is jetted against the cap which is spaced from the discharge openings so as to purge any foreign matter or solidified ink in the discharge openings. A recovery sucking operation also can be conducted by applying, by means of a vacuum pump (not shown), vacuum to the space between the head surface having the discharge openings and the cap with which this surface is capped, thereby forcibly inducing and removing any matter clogging the discharge openings, thereby recovering safe discharging condition. It is also possible to arrange a blade or a wiping member in the vicinity of the cap device in such a manner as to rub the head surface where the discharge openings open in accordance with the movement of the carriage, thereby cleaning this surface of the recording head.

Numerals 7027K, 7027C, 7027M and 7027Y denote main tanks which contain inks of high dye concentrations of K, C, M and Y colors, while 7028A and 7028B respectively denote main tanks storing dye-free clear inks having different compositions. Independent ink supply pumps 7029 are employed for the respective inks. Numeral 7030 denotes ink supply tubes, while numerals 7031A, 7031B and 7032 denote supporting blocks which support the ink supply tubes and which are independently movable in the direction of an arrow "y" by sliding mechanisms which are not shown.

Figure 48:
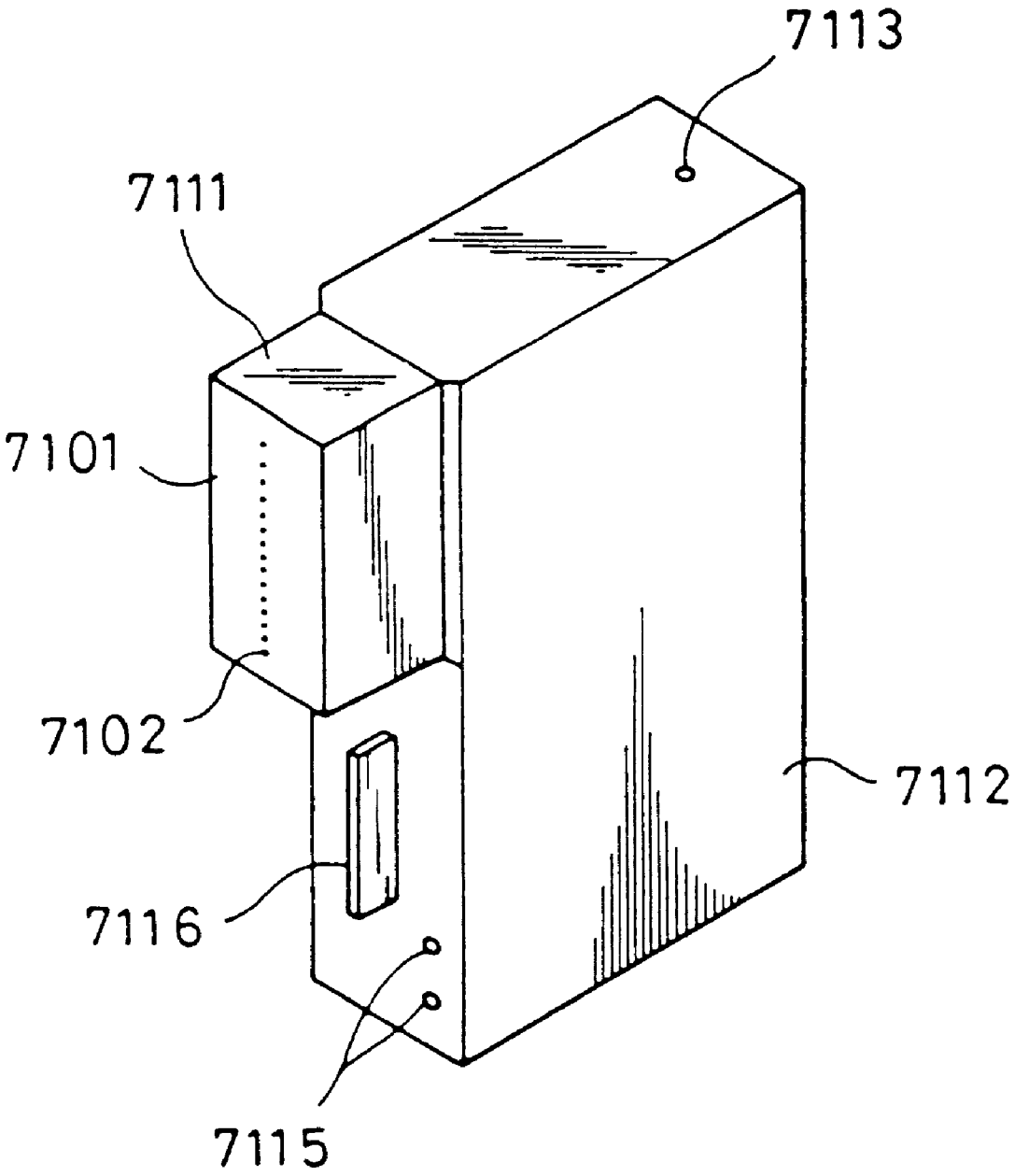
FIG. 48 is a perspective view of an ink jet unit.

FIG. 48 is a schematic perspective view of one of the ink jet units as viewed from the same side as the platen 21.

A recording head portion 7111 has a discharge surface 7101 in which a plurality of discharge openings 7102 open. Each discharge opening communicates with an ink channel in which is disposed an energy generating element which generates energy used for discharging the ink. Numeral 7115 denotes a pair of electrodes which sense the amount of ink remaining in the ink jet unit. The arrangement is such that constant electrical current is made to flow between these electrodes so that the amount of the ink remaining in the ink jet unit is sensed by detecting a change in the electrical resistance between these electrodes.

A connector 7116 for receiving driving signals for driving the energy generating elements is connected to the carriage via a connector holder (not shown) which is provided on the carriage.

Figure 49:
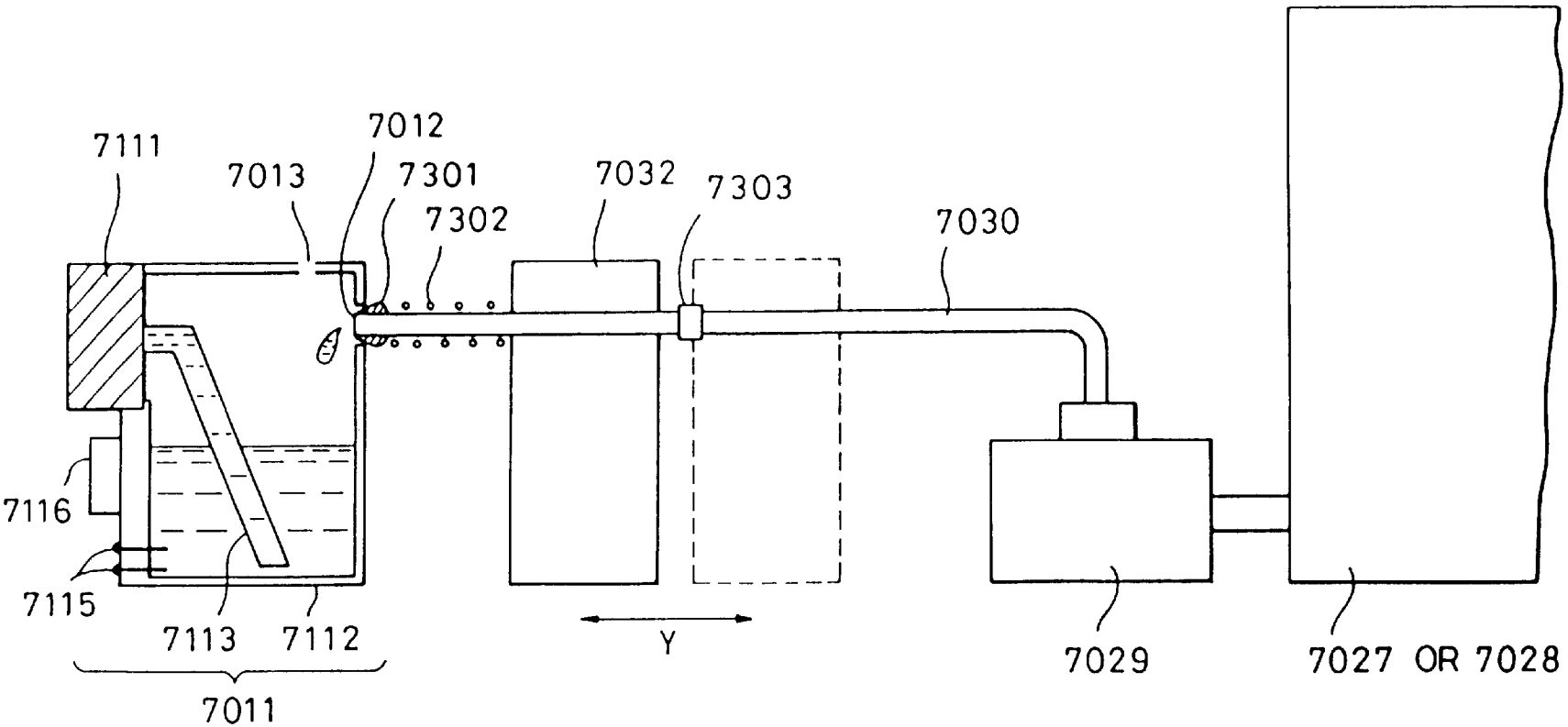
FIG. 49 is an illustration of an ink supply path.

FIG. 49 is a schematic sectional view of a path through which each type of ink is supplied from the main tank to the ink jet unit 7011. The ink supplied into a sub-tank 7112 is introduced to the recording head portion 711 having the discharge openings and the energy generating elements, through a tube 7113.

The ink supply tube 7030 has a conical end portion 7301 which is pressed into close contact with the brim of the ink supply port 7012 by the force of a spring member 7302. Numeral 7303 denotes a stopper member which prevents the supply tube 7030 from projecting excessively by the force of the spring 7302.

When the ink jet unit has been moved to the ink supply position, the supporting block 7032 (or 7031) is moved by the operation of the slide mechanism (not shown) so that the conical end 7301 of the supply tube is brought into close contact with the rim of the supply port 7012. Then, the pump 7029 is activated so that a required amount of ink is supplied from the main tank 7027 (or 7028) into the sub-tank 712 through the ink supply tube 7030. During the supply of the ink into the sub-tank, no pressure rise occurs inside the sub-tank because the interior of the sub-tank communicates with the atmosphere through the vent hole 7013. The support block 7032 (or 7031) is retracted when the required amount of ink has been supplied into the sub-tank.

Figure 50:
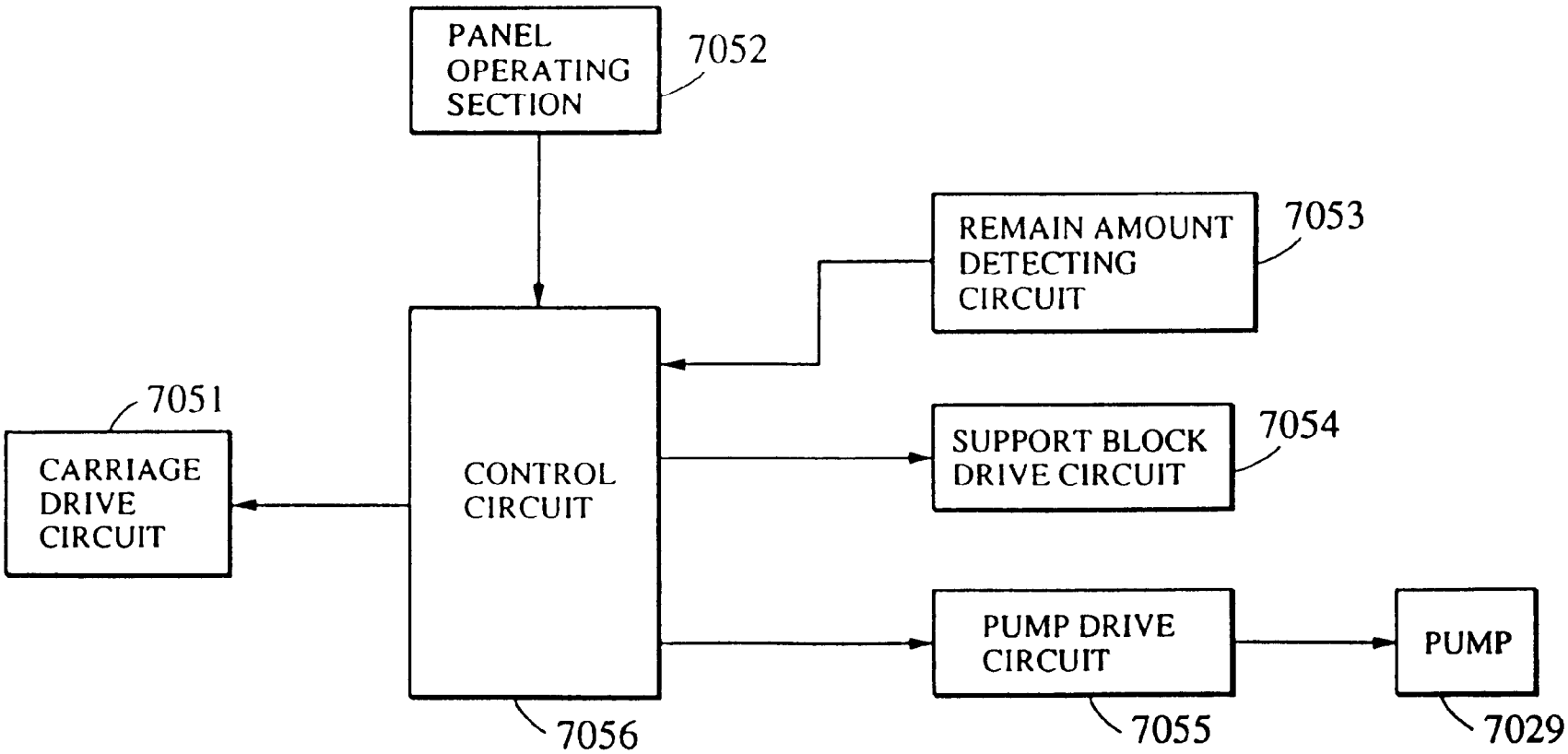
FIG. 50 is a block diagram showing an ink supply control performed in the ink jet recording apparatus shown in FIG. 47.

FIG. 50 is a block diagram illustrative of the ink supplying operation. A carriage drive circuit 7051 drives a carriage motor 7025 which operates to cause scanning reciprocating motion of the carriage. A panel operating section 7052 permits setting of various parameters such as switching of clear ink. Numeral 7053 designate an ink remain amount detecting circuit which is connected to a remain amount sensor provided in the sub-tank. Numeral 7054 denotes a drive circuit for driving the support block back and forth, while 7055 designates a pump drive circuit for driving the pump 7029. A control circuit 7056 includes a ROM which stores mixing ratios of inks of various colors, as well as a CPU, and is adapted to control the ink supplying operation.

Figure 51A:
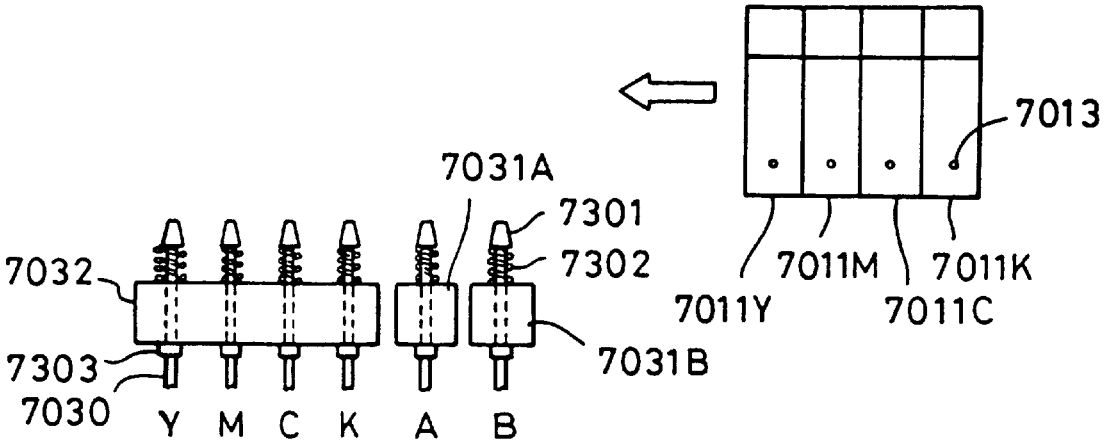
FIGS. 51A to 51C are illustrations of ink blending operation.
Figure 51B:
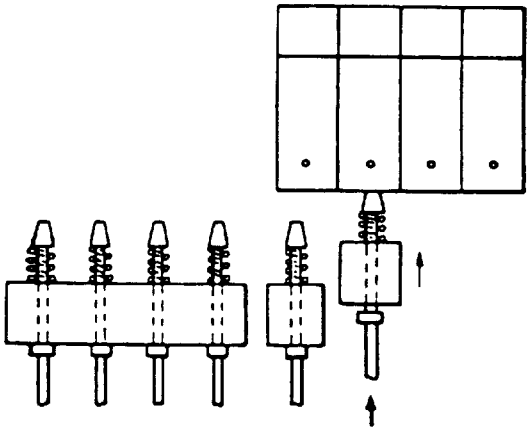
Figure 51C:
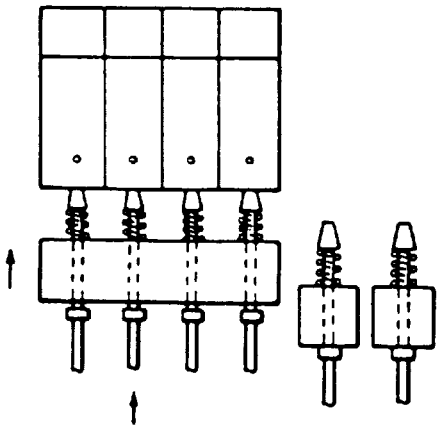

FIGS. 51A to 51C are schematic illustrations of the ink supply system as viewed from the upper side of the system, explanatory of the ink supplying operation for supplying ink to the ink jet unit.

Upon sensing that the ink in the ink jet unit has been consumed, the control circuit operates to shift the carriage to the ink supply position as shown in FIG. 51A. The control circuit determines, based on the instructions set through the panel operation section, which one of the clear inks A and B is to be supplied, and stops the carriage at the position where it can receive the desired one of these two types of clear inks. FIG. 51B shows that the clear ink B is being supplied to the ink jet unit for jetting magenta ink. It will be seen that the support block 7031B has advanced to bring the conical end portion of the ink supply tube into close contact with the supply port of the sub-tank. In this state, the pump 7029 which is exclusive for the clear ink B is operated to supply the required amount of clear ink B. After completion of the supply of the required amount of the clear ink B, the pump 7029 stops operating and the support block 7031B is retracted to the stand-by position.

The carriage is returned to the home position when the supply of the clear ink has been completed, and the support block 7032 for the dye-containing ink is advanced. Then, the required pump, e.g., the pump 7029 which is used exclusively for the magenta ink, is activated to supply the dye-containing ink, whereby the clear ink and the dye-containing ink are mixed within the sub-tank.

The switching from the mode using the clear ink B to the mode using the clear ink A is conducted as follows. Instruction is switched on the panel operation section from the mode using the clear ink B to the mode using the clear ink A. In response to this operation, the ink jet unit is capped with a cap 7026 which is provided at the home position HP, and a recovery pump (not shown) connected to the cap 7026 is activate to suck all the ink in the sub-tank of this ink jet unit. The evacuation of the sub-tank is sensed by the remain amount detecting circuit and, thereafter, the operation described above is executed to blend a new ink by mixing the clear ink A and the dye-containing ink within the sub-tank, whereby the ink of the desired composition is newly prepared.

Ink compositions used in this embodiment are shown in Table 1 below by way of example.

TABLE 1

| | |
|---|---|
| Dye-containing inks | |
| K: 8 wt % dye aqueous solution | |
| C: 7 wt % dye aqueous solution | |
| M: 7 wt % dye aqueous solution | |
| Y: 4 wt % dye aqueous solution | |
| Clear ink composition A | |
| glycerol | 16 wt % |
| thioglycol | 16 wt % |
| urea | 16 wt % |
| pure water | 52 wt % |
| Clear ink composition B | |
| glycerol | 16 wt % |
| thioglycol | 16 wt % |
| ethylene glycol ethylene oxide adduct (N = 10) | 6 wt % |
| urea | 16 wt % |
| pure water | 46 wt % |

In this embodiment, the ink compositions are determined such that the desired inks can be obtained by mixing the dye-containing ink and the clear ink at the mixing ratio 1:1.

The ink prepared by mixing the clear ink A enables characters to be printed with high degree of printing quality on ordinary paper sheets such as copy paper sheet and bond paper. Compositions of inks of respective colors formed by mixing the clear ink A and the dye-containing ink at the ratio 1:1 are shown in Table 2 below.

TABLE 2

| | |
|---|---|
| K ink | |
| dye | 4 wt % |
| glycerol | 8 wt % |
| thioglycol | 8 wt % |
| urea | 8 wt % |
| pure water | 72 wt % |
| C ink | |
| dye | 3.5 wt % |
| glycerol | 8 wt % |
| thioglycol | 8 wt % |
| urea | 8 wt % |
| pure water | 72.5 wt % |
| M ink | |
| dye | 3.5 wt % |
| glycerol | 8 wt % |
| thioglycol | 8 wt % |
| urea | 8 wt % |
| pure water | 72.5 wt % |
| Y ink | |
| dye | 2 wt % |
| glycerol | 8 wt % |
| thioglycol | 8 wt % |
| urea | 8 wt % |
| pure water | 74 wt % |

In general, it has been recognized that the ink jetted from an ink jet recording apparatus can penetrate into recording paper more quickly when the value represented by $\eta/(\gamma \cos \theta)$ is made smaller, where $\eta$ indicates the viscosity of the ink, $\gamma$ indicates the surface tension of the ink and $\theta$ indicates the attack angle at which the ink impinges upon the paper. In general, a smaller attack angle increases the degree of wetting of the paper with the ink so as to increase the penetration into the paper. However, the spreading tendency of the ink on the paper also is increased, so as to impair the sharpness of the dot and, hence, the clearness of the print. The printing clearness can be increased by lowering the degree of wetting of the paper with the ink. The lowered wetting degree, however, undesirably reduces the penetration. The inks having the compositions shown above generally exhibit high surface tension levels of 40 to 50 dyne/cm. This high level of surface tension, with good balance with fastness, reduces penetration into the paper so as to avoid feathering, i.e., undesirable spreading of the ink along random fibers of the paper, thus improving the quality of print of characters.

On the other hand, inks prepared by mixing the clear ink B exhibit very high fastness to ordinary papers such as copy paper or bond paper. Therefore, when color inks of this type are used, undesirable mixing of inks of different colors, i.e., bleeding. is avoided in the boundary between adjacent regions of different colors. At the same time, uniform coloring is obtained in the color region, without reduced unevenness of color.

Table 3 shows compositions of inks prepared by mixing the clear ink B with dye-containing inks.

TABLE 3

| | |
|---|---|
| K ink | |
| dye | 4 wt % |
| glycerol | 8 wt % |
| thioglycol | 8 wt % |
| acetylene glycol ethylene oxide adduct (N = 10) | 3 wt % |
| urea | 8 wt % |
| pure water | 69 wt % |
| C ink | |
| dye | 3.5 wt % |
| glycerol | 8 wt % |
| thioglycol | 8 wt % |
| acetylene glycol ethylene oxide adduct (N = 10) | 3 wt % |
| urea | 8 wt % |
| pure water | 69.5 wt % |
| M ink | |
| dye | 3.5 wt % |
| glycerol | 8 wt % |
| thioglycol | 8 wt % |
| acetylene glycol ethylene oxide adduct (N = 10) | 3 wt % |
| urea | 8 wt % |
| pure water | 69.5 wt % |
| Y ink | |
| dye | 2 wt % |
| glycerol | 8 wt % |
| thioglycol | 8 wt % |
| acetylene glycol ethylene oxide adduct (N = 10) | 3 wt % |
| urea | 8 wt % |
| pure water | 71 wt % |

It is an effective measure to reduce the attack angle q so as to increase the degree of wetting of the paper with the ink, for the purpose of enhancing penetration. Surfactants are broadly used as means for enhancing the degree of wetting. The inks show above incorporate a nonionic surfactant so that the surface tension is generally as small as 30 dyne/cm. These inks, however, exhibit a greater degree of wetting of the paper and a greater tendency of spreading of ink on the paper, thus increasing the dot size, as well as very high penetration speed. However, the sharpness is impaired due to the increased dot size, as compared with the inks formed by mixing the clear ink A, and the color density of the dot itself is lowered for the same reason.

Examples of penetration agents suitably used in the clear ink B are: anion-type surfactants such as aerosol OT, dodecylbenzene sodium sulfonate, lauryl sulfate ester sodium and the like; and nonionic surfactants such as ethylene oxide adduct of higher alcohol expressed by the following formula (1), ethylene oxide adduct of alkylphenol expressed by the following formula (2), ethylene oxide-propylene oxide copolymer expressed by the following formula (3) and ethylene oxide adduct of acetylene glycol expressed by the following formula (4).

Preferably, however, the nonionic surfactants as expressed by the following formulae are used in the invention, partly because the anionic surfactants generally exhibit a high foaming tendency and are not easy to handle and partly because nonionic surfactants are generally superior to anionic surfactants in the imaging characteristics such as anti-bleeding characteristic and anti-feathering characteristic.

Formula 1

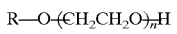

R: alkyl group n: integer

Formula 2

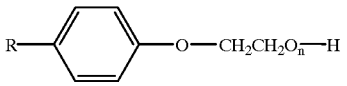

R: alkyl group n: integer

Formula 3

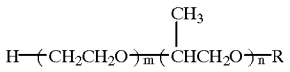

R: alkyl group or hydrogen m, n: integer

Formula 4

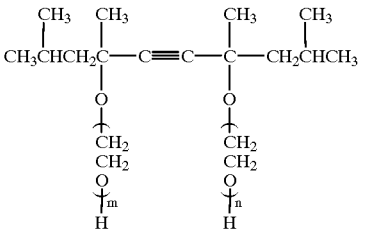

m, n: integer

Among the ethylene-oxide-type nonionic surfactants mentioned above, ethylene oxide adduct of acetylene glycol is used most preferably because this surfactant exhibits a good balance of required properties or characteristics such as absorption in an ink absorber, imaging characteristics on recording medium, discharge characteristic during discharge from a recording head, and so forth. Furthermore, this type of surfactant enables control of hydrophilic nature and penetration by varying the number N of added ethylene oxide. When N is below 6, water solubility is impaired to reduce dissolution in the ink, although the penetration is improved. Conversely, a too large n causes the hydrophilic nature to be enhanced excessively to reduce the penetration. In particular, when N is increased beyond 14, the effect of addition of ethylene oxide is saturated, while the penetration is further reduced, having an undesirable effect on the discharge characteristic. Thus, the number N of added of ethylene oxide preferably ranges between 6 and 14.

Preferably, the amount of addition of nonionic surfactant ranges between 0.1 and 20 wt %. This surfactant does not have an appreciable effect in improving image characteristic and permeability when its content is below 0.1%, whereas addition of this surfactant in excess of 20% undesirably raises the cost of ink and impairs the reliability of the ink, while causing saturation in the effects produced by addition of this surfactant.

Each of the described nonionic surfactants may be used alone or two or more of them may be used in combination.

The inks also may contain dye as the coloring agent, low-volatile organic solvent such as polyhydric alcohol for preventing clogging, and organic solvent such as alcohol for attaining excellent bubbling stability and fastness on paper.

Examples of water-soluble organic solvents suitably contained in the ink used in the invention are: glycols such as polyethylene glycol and polypropylene glycol; alkylene glycols in which the alkylene group contains 2 to 6 carbon atoms, such as ethylene glycol, propylene glycol, butylene glycol, triethylene glycol, 1,2,6-hexane triol, hexylene glycol and diethylene glycol; glycerol; low alkyl ethers of polyhydric alcohols such as ethylene glycol methylether, diethylene glycol methyl (or ethyl) ether and triethylene glycol monomethyl (or ethyl) ether; alcohols such as methyl alcohol, ethyl alcohol, n-propyl alcohol, isopropyl alcohol, n-butyl alcohol, sec-butyl alcohol, tert-butyl alcohol, isobutyl alcohol, benzyl alcohol and cyclohexanol; amides such as dimethyl formamide and dimethyl acetoamide; ketone or ketone alcohols such as acetone and diacetone alcohol; ethers such as tetrahydrofuran and dioxane; and nitrogen-containing cyclic compounds such as N-methyl-2-pyrrolidone, 2-pyrrolidone and 1,3-dimethyl-2-imidazolidinone. These water-soluble organic solvents are used in an amount that does not impair the image characteristics or discharge reliability. Among these water-soluble organic solvents, preferably used are polyhydric alcohols and alkyl ethers of polyhydric alcohols, and the content of such solvents preferably ranges between 1 and 30 wt %.

The content of pure water in the ink used in the present invention preferably ranges between 50 and 90 wt %.

Various types of dye can be used as the dye component of the ink used in the present invention, such as direct dye, acidic dye, basic dye, reactive dye, disperse dye and a developer. The content of such dyes is determined in consideration of factors such as the type of liquid solvent, characteristics required for the ink, rate of discharge from the recording head and so forth. In general, however, the dye content ranges form 0.5 to 15 wt %, preferably from 1 to 7 wt %.

It has proved that the effect of preventing clogging, as well as discharge characteristics, is remarkably improved when thioglycol or urea (or its derivative) is contained in the ink. This effect is attributable to the fact that the dissolution of the dye in the ink is improved by the addition of such a component. The content of thioglycol or urea (or derivative) preferably ranges from 1 to 30 wt %, although the addition of thioglycol or urea (or derivative) is not essential.

The ink used in the present invention can contain, in addition to the main components described above, a viscosity adjusting agent such as polyvinyl alcohol, cellulose and water-soluble resin; a pH adjuster such as diethanol amine, triethanol amine or a buffer; and/or antimold agent, in an amount which does not hamper the advantages of the invention.

The invention can be embodied in the form of an ink jet recording apparatus of the type which electrostatically charges the ink. The ink used in such a type of ink jet recording apparatus can contain a specific resistance adjusting agent such as lithium chloride, ammonium chloride and sodium chloride.

Although a multi-color ink jet recording apparatus has been specifically described, it will be clear that the described fourth embodiment can equally be applied to a monochromatic recording apparatus or color recording apparatus which performs recording of a specific color other than black and white. The ink compositions described hereinbefore are also only illustrative. Although in the described embodiments the quality or nature of the recorded image is variable on ordinary recording paper sheets such as bond paper, copy paper or the like, the described ink jet recording apparatus may b modified to use also a clear ink which is used in preparing an ink suitable for recording on other type of recording medium such as transparency sheet of an overhead projector (OHP). It is also possible to combine the described embodiment with a facility which would enable the user to freely vary the ratio of mixing of the dye-containing ink and the clear ink so that the user can freely set the density of recorded image.

(Fifth Embodiment)

A recording method adaptable to the ink jet recording apparatus and using a plurality of inks having different concentrations has been suggested in order to improve the gradation characteristics, in particular the characteristics of highlight portions. A dark and light multi-valued recording method using dark and light inks having a plurality of concentrations of the same color is able to improve the gradation characteristics in the highlight portions, reduce the granular apperance of the dots and improve the image quality. The reason for this is that injection of low concentration (light) ink onto the highlight portions eliminates the presence of noise-like single dots.

Figure 52:
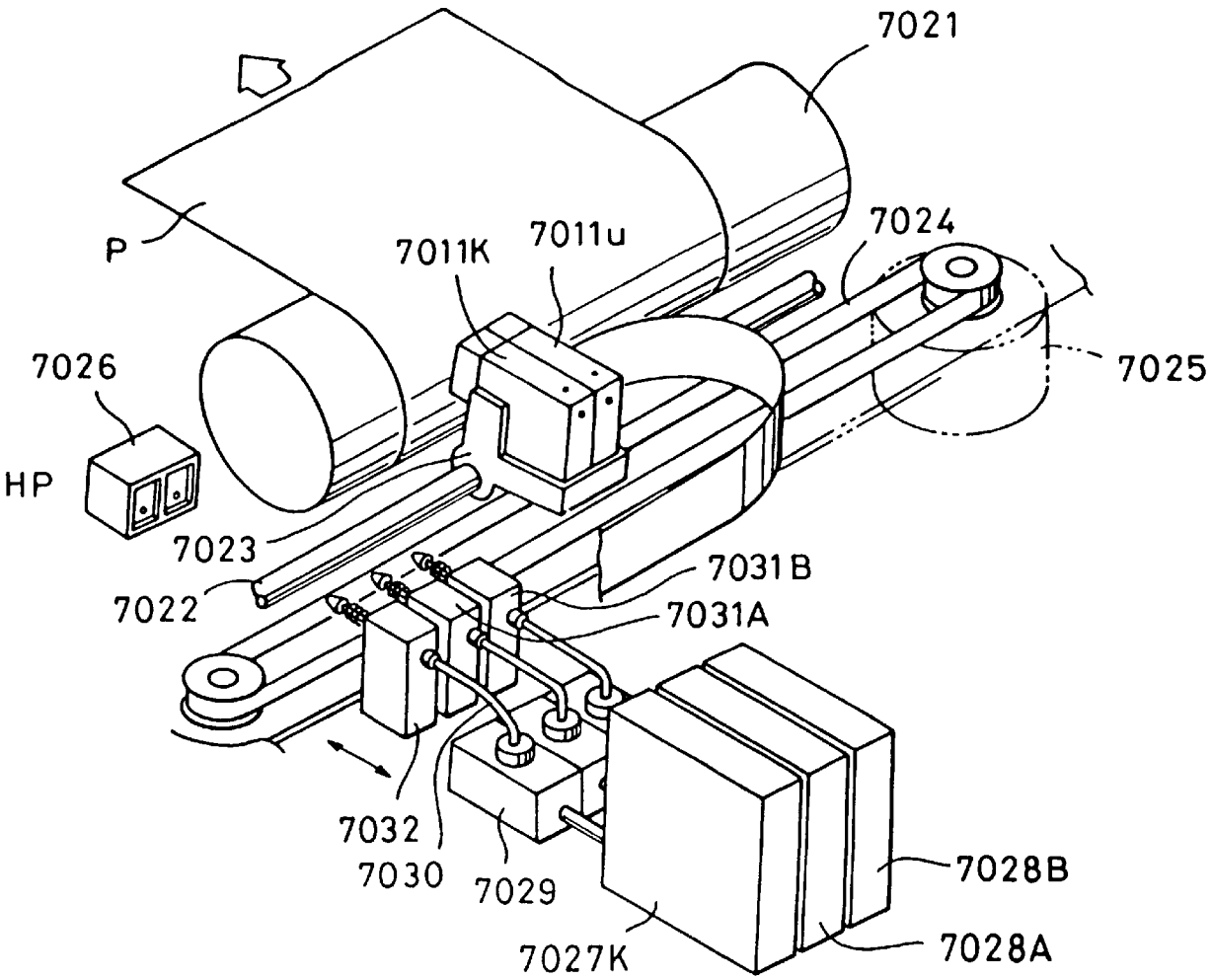
FIG. 52 is a schematic illustration of a fifth embodiment of the ink jet recording apparatus of the present invention.

FIG. 52 is a perspective view which illustrates an ink jet recording apparatus according to the fifth embodiment of the present invention, the ink jet recording apparatus according to this embodiment being arranged to perform a similar operation to that performed by the ink jet recording apparatus according to the fourth embodiment. An ink jet unit 11*k* discharges a dark ink, while an ink jet unit 11*u* discharges a light ink. The two ink jet units 11*k* and 11*u* are disposed to face the carriage at a predetermined distance.

An example of the composition of the ink for use in this embodiment is shown in Table 4.

TABLE 4

| Dye Ink K | 6 wt % Dye Solution | |
|---|---|---|
| Clear Ink Composition A | Diethylene glycol | 10 wt % |
| | Pure water | 90 wt % |
| | Diethylene glycol | 10 wt % |
| Clear Ink Composition B | Acetylene glycol | 6 wt % |
| | Ethylene oxide additive (N = 10) | |
| | Pure water | 84 wt % |

This embodiment was arranged in such a manner that the dark ink may be prepared by mixing the dye ink and the clear ink at a ratio of 1:1 and the light ink may be prepared by mixing the same at a ratio of 1:5. Further, the concentration of the dye in the dark ink was made to be 3%, while that in the light ink was made to be 1%.

The ink prepared by mixing with the clear ink A is an ink enabling an excellent quality of characters to be formed on plain paper, such as copy paper or bond paper. The composition of the ink prepared by mixing the clear ink A and the dye ink at the foregoing ratio is shown in Table 5.

TABLE 5

| | | |
|---|---|---|
| Dark | Dye | 3 wt % |
| | Diethylene glycol | 5 wt % |
| | Pure water | 92 wt % |
| Light | Dye | 1 wt % |
| | Diethylene glycol | 8.3 wt % |
| | Pure water | 90.7 wt % |

As described above, the difference in the blending ratio varies the concentration of the solvent in the dark and light ink composition. The organic solvent, such as the diethylene glycol is added mainly for the purpose of preventing clogging. Since the dark ink containing the dye at a high concentration easily clogs as compared with the light ink, it is preferable that the concentration of the organic solvent be determined to be adaptable to the composition of the dark ink. It is preferable to select organic solvent of a type which does not vary the quality of the formed image even if the concentration is changed.

The ink prepared by mixing with the clear ink B has the following characteristics, such as a very high speed of fixation on the plain paper, such as the copy paper or the bond paper, a capability of preventing undesirable mixture (boundary running or bleeding) in a color recording process even if regions recorded in different color inks are positioned adjacently, and uniform coloring (free from irregular color).

The composition of an ink prepared by mixing the clear ink B and the dye ink at the foregoing ratio is shown in Table 6.

TABLE 6

| | | |
|---|---|---|
| Dark | Dye | 3 wt % |
| | Thiodiglycol | 5 wt % |
| | Acetylene glycol | 3 wt % |
| | Ethylene oxide additive (N = 10) | |
| | Pure water | 89 wt % |
| Light | Dye | 1 wt % |
| | Thiodiglycol | 8.3 wt % |
| | Acetylene glycol | 5 wt % |
| | Ethylene oxide additive (N = 10) | |
| | Pure water | 85.7 wt % |

A surface active agent has characteristics that the quality of the formed image is not substantially changed if the concentration of the same is larger than a predetermined quantity. Although the surface active agent decreases the surface tension of the ink in inverse proportion to the quantity thereof, the surface tension cannot be changed further if its concentration is higher than the micellar limit concentration level. Therefore, if the concentration of the surface active agent has been raised to a level higher than a certain level, the surface tension between the material, on which an image is recorded, and the ink is not changed, that is the wettability is not changed furthermore. The ethylene oxide additive of the acetylene glycol does not vary the quality of the image if its quantity is larger than 2 to 3 wt %. Therefore, it is also preferable that the composition of a penetrating agent be determined to be a value sufficient to prepare the dark ink.

Although this embodiment has been described in such a manner that the single color ink serves as an example, the present invention is not limited to this. A further significant effect can be obtained when the present invention is adapted to a dark and light color recording apparatus including a plurality of dark and light color inks exemplified by cyan, magenta, yellow and black and the like because considerably various inks are included.

The number of concentrations of the dye in the ink is not limited to two, that is dark and light. The concentrations may be three or more such that the recording process is performed by a light ink, a medium concentration ink and a dark ink.

According to the foregoing fourth and fifth embodiments, the ink jet recording apparatus of a type discharging ink to form an image comprises, in addition to the inks containing dyes, a plurality of clear inks each of which does not contain a dye, the ink jet recording apparatus being arranged in such a manner that the inks having different compositions can be blended in the recording apparatus. Therefore, an ink jet recording apparatus of a type enabling a user to select the optimum ink composition to meet the user's desire can be realized.

Among the ink jet recording methods, the present invention enables an excellent effect to be obtained if it is adapted to a recording head or a recording apparatus of a type having an arrangement that heat energy is utilized to form a flying fluid droplet so as to perform the recording operation.

As for the typical structure and the principle, it is preferable that the basic structure disclosed in, for example, U.S. Pat. Nos. 4,723,129 or 4,740,796 is employed. The aforesaid method can be adapted to both a so-called on-demand type apparatus and a continuous type apparatus. In particular, a satisfactory effect can be obtained when the on-demand type apparatus is employed because of the structure arranged in such a manner that one or more drive signals, which rapidly raise the temperature of an electricity-to-heat converter disposed to face a sheet or a fluid passage which holds the fluid (ink) to a level higher than levels at which nucleate boiling takes place are applied to the electricity-to-heat converter so as to generate heat energy in the electricity-to-heat converter and to cause at the heat effecting surface of the recording head film boiling to take place so that bubbles can be formed in the fluid (ink) to correspond to the one or more drive signals. The enlargement/contraction of the bubble will cause the fluid (ink) to be discharged through a discharging opening so that one or more droplets are formed. If a pulse shaped drive signal is employed, the bubble can be enlarged/contracted immediately and properly, causing a further preferred effect to be obtained because the fluid (ink) can be discharged with excellent responsiveness.

It is preferable that a pulse drive signal disclosed in U.S. Pat. Nos. 4,463,359 or 4,345,262 is employed. If conditions disclosed in U.S. Pat. No. 4,313,124, which relates to the temperature rising ratio at the heat effecting surface, are employed, a satisfactory recording result can be obtained.

As an alternative to the structure (linear fluid passage or perpendicular fluid passage) of the recording head disclosed in each of the aforesaid inventions and having an arrangement that discharge ports, fluid passages and electricity-to-heat converters are combined, a structure having an arrangement such that the heat effecting surface is disposed in a bent region as disclosed in U.S. Pat. Nos. 4,558,333 or 4,459,600 may be employed.

In addition, the following structures may be employed: a structure having an arrangement such that a common slit is formed to serve as a discharge section of a plurality of electricity-to-heat converters as disclosed in Japanese Patent Laid-Open No. 59-123670; and a structure in which an opening for absorbing pressure waves of heat energy is disposed to correspond to the discharge section.

In addition, a chip type recording head which can be electrically connected to the body of the apparatus or to which ink can be supplied from the body of the apparatus when it is fastened to the body of the apparatus may be employed. Furthermore, a cartridge recording head having an ink tank integrally formed with the recording head may be employed.

It is preferred to additionally to employ the recording head restoring means and an auxiliary means provided as the component of the recording apparatus according to the present invention because the effect of the present invention can be further stabilized. Specifically, it is preferable to employ any combination of a recording head capping means, a cleaning means, a pressurizing or suction means, an electricity-to-heat converter, an auxiliarly heating element or a sub-heating means constituted by combining the converter and the auxiliary heating element. Further, it is preferred to perform a sub-discharge mode in which a discharge is performed independently from the recording discharge in order to stably perform the recording operation.

The recording apparatus may be arranged to be capable of recording a color-combined image composed of different colors or a full color image obtained by mixing colors to each other by integrally forming the recording head or by combining a plurality of recording heads as well as recording only a main color such as black.

Although a fluid ink is employed in each of the aforesaid embodiments of the present invention, ink which is solidified at room temperature or lower and as well as softened at room temperature, or ink in the form of a fluid at room temperature or ink which is formed into a fluid when the recording signal is supplied may be employed because the aforesaid ink jet recording method is ordinarily designed in such a manner that the temperature of ink is controlled in a range from 30° C. to 70° C. so as to keep the viscosity of the ink in a stable discharge range.

Furthermore, ink of the following types can be adapted to the present invention: ink which is liquefied when heat energy is supplied in response to the recording signal so as to be discharged in the form of fluid ink, the aforesaid ink being exemplified by ink, the temperature rise of which due to supply of the heat energy is positively prevented by utilizing the temperature rise as energy of state change from the solid state to the liquid state; and ink which is solidified when it is unused for the purpose of preventing ink evaporation. Furthermore, ink which is first liquefied when supplied with heat energy may be adapted to the present invention. In the aforesaid case, the ink may be of a type which is held as fluid or solid material in a recess of a porous sheet or a through hole at a position to face the electricity-to-heat converter as disclosed in Japanese Patent Laid-Open No. 54-56847 or Japanese Patent Laid-Open No. 60-71260. It is most preferred that the ink be adapted to the aforesaid film boiling method.

The recording apparatus according to the present invention may be in the form of a copying apparatus combined with a reader or the like, or a facsimile apparatus having a transmission/receiving function as well as the integrated or independent apparatus serving as image output terminal equipment of information processing apparatus such as a word processor or computer.

Figure 44:
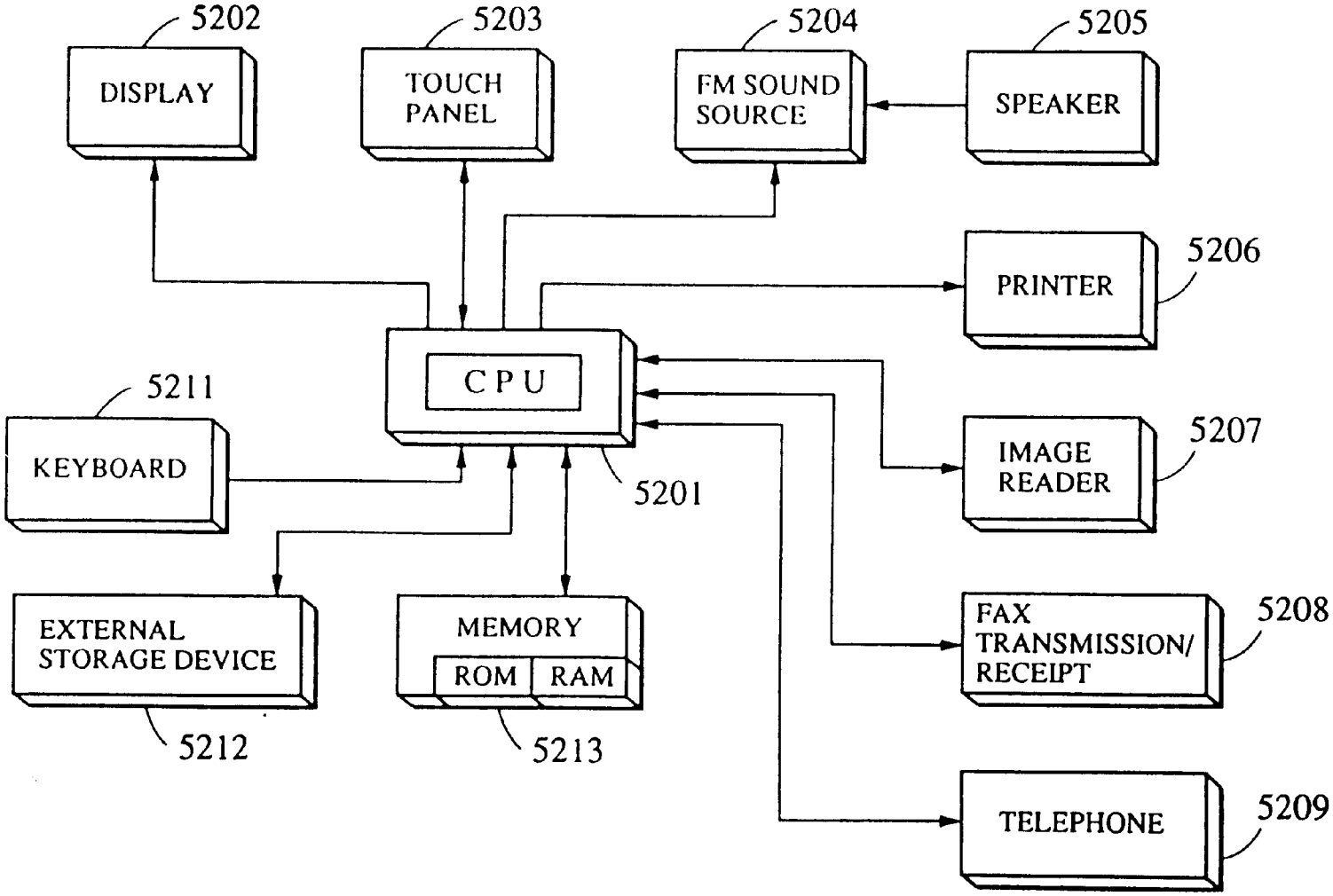
FIG. 44 is a block diagram of an information processing system employing an ink jet recording apparatus embodying the present invention.

FIG. 44 is a block diagram which illustrates the schematic structure of a case where the recording apparatus according to the present invention is adapted to an information processing apparatus having a function to serve as a word processor, a personal computer, a facsimile apparatus or a copying apparatus. Referring to FIG. 44, reference numeral

5201 represents a control section for controlling the apparatus, the control section 5201 having a CPU comprising a microprocessor or the like and a variety of I/O ports to perform control by transmitting, to the units to be controlled, control signals and data signals and the like and by receiving control signals and data signals and the like from the same. Reference numeral 5202 represents a display section having a display screen which displays a variety of menus, document information and image data read by an image reader 5207 and the like. Reference numeral 5203 represents a transparent and pressure-sensitive touch panel, the surface of which is arranged to be depressed with a finger or the like, the touch panel 5203 enabling input of items and/or that of coordinates to be performed on the display 5202.

Reference numeral 5204 represents an FM (Frequency Modulation) sound source section for causing music information created by a music editor or the like to be recorded on a memory section 5210 or an external storage unit 5212 in the form of digital data and reading the same from the foregoing memory or the like to subject the information to an FM process. An electric signal transmitted by the FM sound source 5204 is converted into an audible sound. A printer section 5206 is an output terminal of a word processor, a personal computer, a facsimile apparatus or a copying apparatus to which the recording apparatus according to the present invention is adapted.

Reference numeral 5207 represents the image reader section for photoelectrically reading data of an original document to input the same, the image reader 5207 being disposed at an intermediate position of the conveyance passage for an original document to read a facsimile original document and a variety of original documents. Reference numeral 5208 represents a facsimile transmitting receiving section for facsimile-transmitting data of the original document read by the image reader section 5207 and receiving and decoding a transmitted facsimile signal, the facsimile transmitting and receiving section 5208 having an interface function between outside and the apparatus. Reference numeral 5209 represents a telephone section having a variety of telephone functions, such as an ordinary telephone function and a telephone answering function and the like. Reference numeral 5210 represents a memory section including a ROM for storing a system program, a manager program, other application programs, character fonts and dictionaries, a RAM for storing application programs and character information installed from the external storage unit 5212 and a video RAM and the like.

Reference numeral 5211 represents a keyboard section with which document information and a variety of commands and the like are supplied. Reference numeral 5212 represents the external storage unit comprising a floppy disk or a hard disk or the like as a storage medium, the external storage unit 5212 being capable of storing character information, music or voice information and user's application programs and the like.

Figure 45:
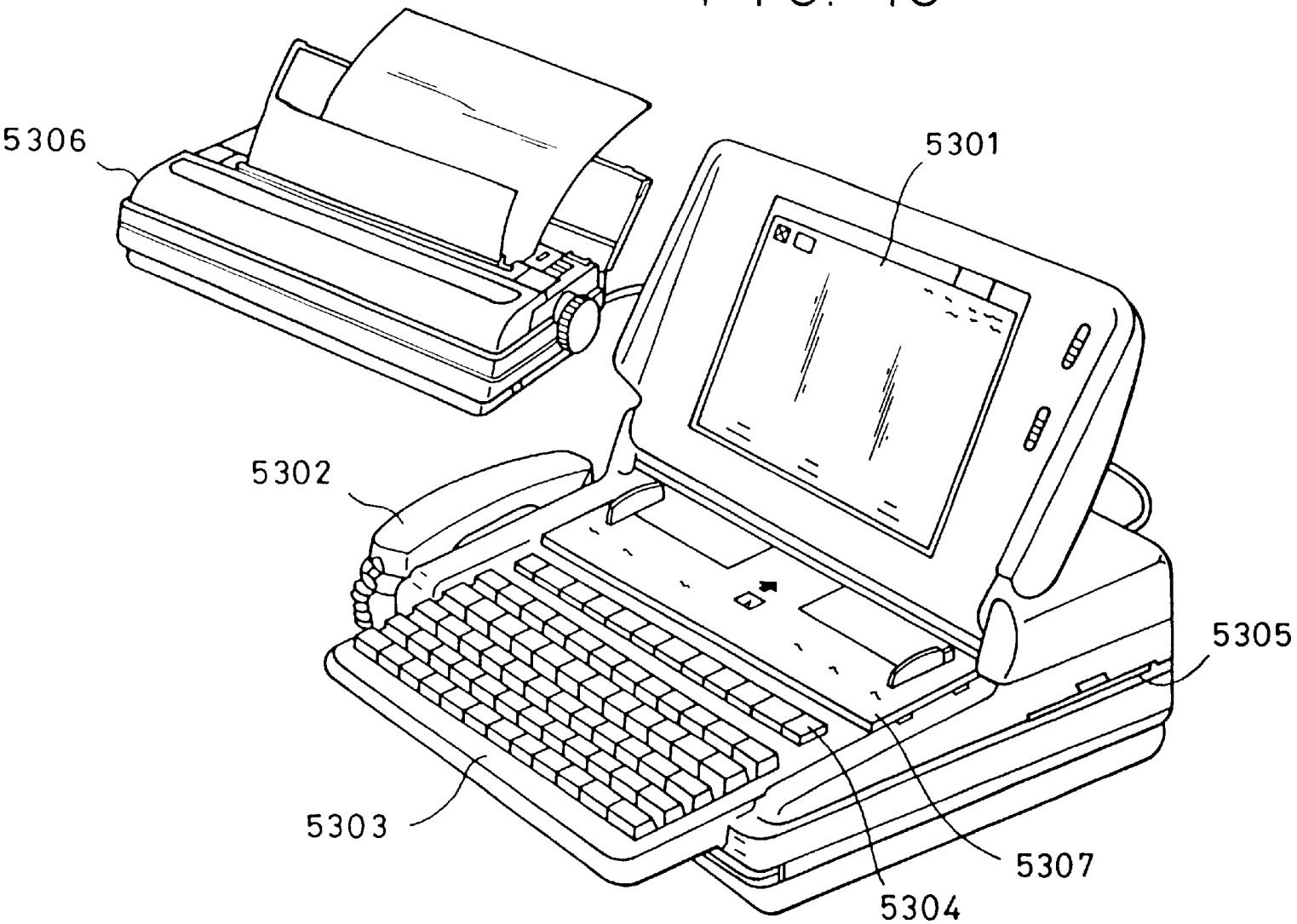
FIG. 45 is a perspective view of an example of the information processing apparatus used in the system shown in FIG. 44.

FIG. 45 is an outline view which illustrates the information processing apparatus shown in FIG. 44. Referring to FIG. 45, reference numeral 5301 represents a flat panel display using liquid crystals or the like to display a variety of menus, graphic information and document information and the like. A touch panel is mounted on the display 5301, the touch panel having a surface which is arranged to be pressed by a finger or the like so that input of coordinates and/or that of items is enabled. Reference numeral 5302 represents a handset for use when the apparatus is used as a telephone.

The keyboard 5303 is detachably connected to the body through a cord to supply a variety of character information and data items. Further, the keyboard 5303 has a variety of function keys 5304. Reference numeral 5305 represents a port through which a floppy disk is inserted.

Reference numeral 5307 represents a paper loading section on which the original document to be read by the image reader section 5207 is placed, the original document being discharged through the rear portion of the apparatus after it has been read as described above. Data, which has been facsimile-received, is recorded by an ink jet printer 5306.

Although the foregoing display 5301 may comprise a CRT, it is preferable to employ a flat panel, such as a liquid crystals display using ferroelectric liquid crystal because the size, thickness and weight can be reduced. Then, description will be made about the operation to be performed in a case where the foregoing information processing apparatus is operated as a word processor. Referring to FIG. 44, character information supplied through the keyboard section 5211 is processed in the control section 5201 in accordance with the document processing program to be transmitted as an image to the printer section 5206. In a case where the foregoing image processing apparatus is operated as a personal computer, various data supplied through the keyboard section 5211 is calculated and processed in the control section 5201 in accordance with the application program, and the results of the calculations are, in the form of an image, transmitted to the printer section 5206. In a case where the foregoing apparatus is operated as a receiver of a facsimile apparatus, facsimile information supplied from the facsimile transmitting and receiving section 5208 through a communication line is subjected to a receipt process in the control section 5201 in accordance with a predetermined program and transmitted, in the form of a received image, to the printer section 5206.

Figure 46:
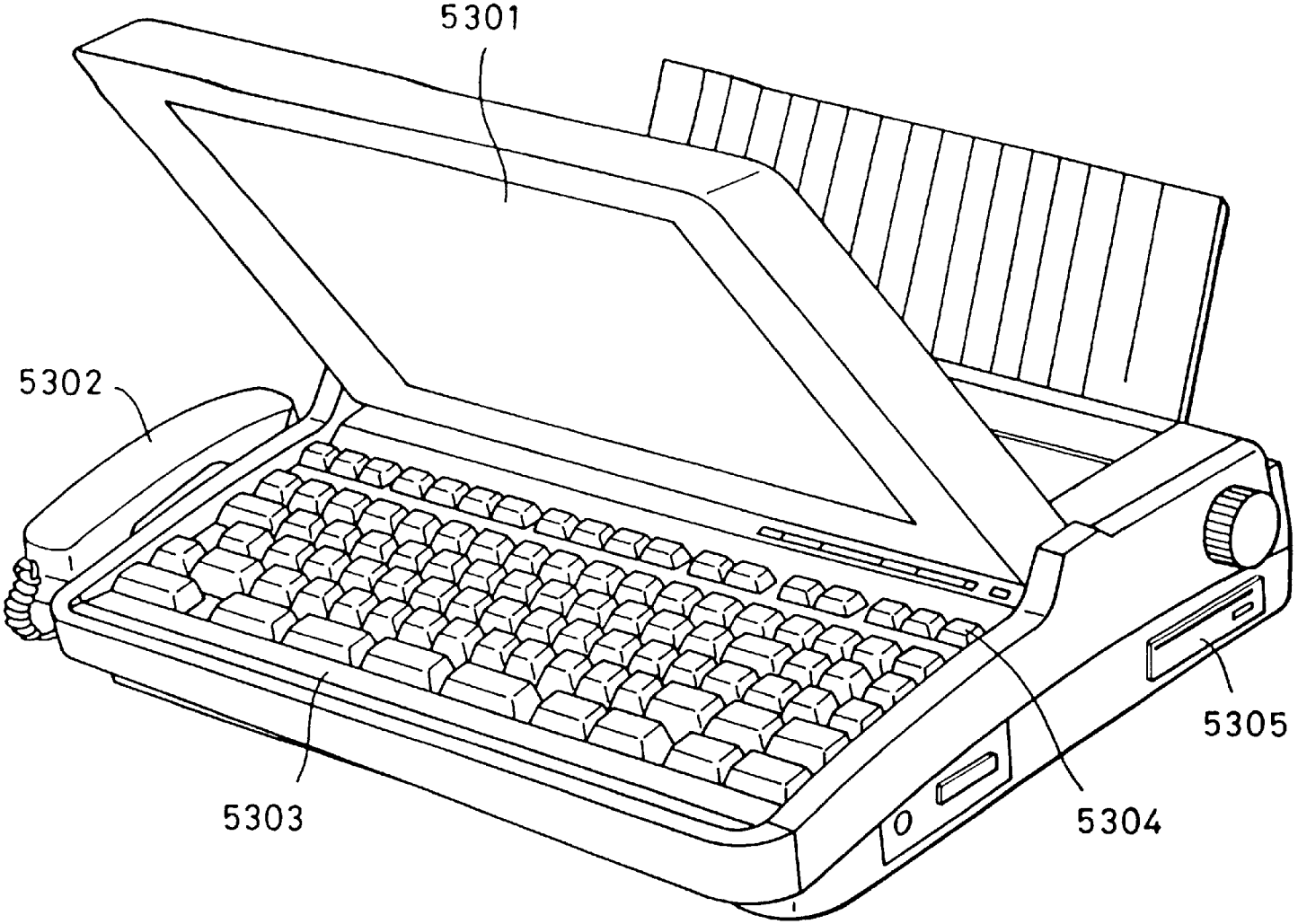
FIG. 46 is a perspective view of another example of the information processing apparatus.

In a case where it is operated as a copying apparatus, the original document is read by the image reader section 5207, data of the read original document being transmitted to the printer section 5206 in the form of a copied image through the control section 5201. In a case where it is operated as a transmitter of the facsimile apparatus, data of the original document read by the image reader section 5207 is subjected to a transmission process by the control section 5201 in accordance with a predetermined program, and then processed data is transmitted to the communication line through the facsimile transmitting and receiving section 5208. The foregoing information processing apparatus may be an integrated type apparatus including an ink jet printer therein as shown in FIG. 46. In this case, the portability can be improved. Referring to FIG. 46, elements having the same functions as the elements shown in FIG. 45 are given corresponding reference numerals.

By adapting the recording apparatus according to the present invention to the foregoing multi-function information processing apparatus, a high quality recorded image can be obtained. Therefore, the function of the information processing apparatus can be further improved.

As can be understood from the foregoing description, according to the present invention, larger numbers of concentrations and colors than the number of the concentrations and colors previously prepared can be set to be used in the recording process to be suitable to the concentration distribution or the like of an image to be recorded.

As a result, a recording process capable of forming an image exhibiting excellent gradation can be performed by a simple apparatus.

What is claimed is:

1. An ink jet recording apparatus which performs recording by means of a plurality of recording heads, each said recording head having at least one discharge opening, comprising:

an ink storage means for storing an ink, wherein said ink contains a dye;

a clear ink storage means for storing a clear ink, wherein the clear ink does not contain a dye;

mixing ratio setting means for setting the ratio of said ink and said, clear ink to be supplied to said recording head; and ink supplying means for supplying the ink stored in said ink storage means to a first recording head in said plurality of recording heads, and supplying the ink stored in said ink storage means and said clear ink stored in said clear ink storage means to a second recording head in said plurality of recording heads at the ratio which is based on the set mixing ratio.

2. An ink jet recording apparatus according to claim 1, wherein said ink supplying means comprises supply valves, and wherein said mixing ratio setting means is manually operated to set the ratio.

3. An ink jet recording apparatus according to claim 1, wherein said ink supplying means comprises a plurality of supply valves and a valve control means for electromagnetically controlling said supply valves, and said mixing ratio setting means stes the ratio by means of said valve control means.

4. An ink jet recording apparatus according to claim 1, wherein said ink storage means has ink supply holes corresponding to said first and second recording heads, and said clear ink storage means has an ink supply hole corresponding to said second recording head, and wherein the ratio of mixing of said ink and said clear ink is set in accordance with the ratio between areas of supply holes of said ink storage means and said clear ink storage means which are for supplying ink to said second recording head.

5. An ink jet recording apparatus according to claim 1, wherein said recording head comprises heat energy generating means for applying head energy to said ink to form a bubble in said ink, thereby causing said ink to be discharged from said recording head.

6. An ink jet recording method which performs recording by means of a plurality of recording heads, each said recording head having at least one discharge opening, comprising the steps of:

storing a first ink, wherein the first ink contains a dye;

storing a second ink, wherein the second ink is a clear ink which does not contain a dye;

supplying said first ink to a first said recording head;

supplying said first ink and said second ink to a second said recording head;

setting a ratio of mixing of said first and said second inks;

mixing said first and second inks at said ratio to form a mixed ink;

discharging said first ink through said first recording head; and discharging said mixed ink through said second recording head.

7. An ink jet recording apparatus according to claim 6, wherein a first said discharge opening discharges an ink which is not the ink selected from said plurality of inks, and a second ink discharge opening for discharging the mixed ink.

8. An ink jet recording method according to claim 6, further comprising the step of applying heat to a particular one in said inks to form a bubble of said particular one of said inks, thereby discharging said ink from said recording head.

9. An ink jet recording apparatus which performs recording by means of a plurality of recording heads, each said recording head having at least one ink discharge opening, comprising:

a plurality of ink storage means for storing a plurality of inks, wherein each said ink contains a different type of a colorant;

a clear ink storage means for storing a clear ink, wherein the clear ink does not contain a dye;

a plurality of first recording heads for discharging a color ink to be stored in said plurality of ink storage means;

a plurality of second recording heads for discharging a mixed ink of said clear ink and each of a plurality of inks stored in said plurality of ink storage means;

ink supplying means for supplying the color inks stored in said plurality of ink storage means to a corresponding said recording head in said plurality of first recording heads, and supplying said color ink and said clear ink to said second recording head; and mixing ratio setting means for controlling the ratio of said color ink and said clear ink to be provided to said second recording head, wherein the ink discharged from said recording head is said color ink and said clear ink, mixed at a predetermined mixing ratio.

10. An ink jet recording apparatus according to claim 9, wherein said supplying means comprises supply valves, and wherein said mixing ratio setting means is manually operated to set the mixing ratio.

11. An ink jet recording apparatus according claim 9, wherein said supplying means comprises a plurality of supply valves and a valve control means for electromagnetically controlling said supply valves, and said mixing ratio setting means sets the mixing ratio by means of said valve control means.

12. An ink jet recording apparatus according to claim 9, wherein said recording heads comprise heat energy generating means for applying heat to a particular one of said inks, thereby causing said ink to be discharged from said recording head.

13. An ink jet recording apparatus according to claim 12, wherein the inks selected have different levels of dye concentration.

14. An ink jet recording apparatus according to claim 12, wherein the selected inks contain different types of colorant.

15. An ink jet recording apparatus according to claim 12, wherein the inks selected include a clear ink which does not contain a dye.

16. An ink jet recording method which performs recording by means of a plurality of recording heads, each said recording head having at least one discharge opening, comprising the steps of:

storing a plurality of inks, wherein each said ink contains a different type of colorant;

storing a clear ink, wherein the clear ink does not contain a dye;

supplying a color ink to a plurality of first said recording heads;

supplying said color ink and said clear ink to a plurality of second said recording heads;

setting a ratio of mixing of said color ink with said clear ink;

mixing said color ink and said clear ink at said ratio to form a mixed ink;

discharging said color ink through said plurality of first recording heads; and discharging said mixed ink through said plurality of second recording heads.

17. An ink jet recording apparatus according to claim 16, further comprising the step of applying heat to a particular one of said inks to form a bubble of said particular one of said inks, thereby discharging said ink from said recording head.

18. An ink tank comprising:

partitioning means for dividing an interior of the ink tank into a plurality of ink chambers for separately storing a plurality of inks containing a colorant, and for storing a clear ink not containing a colorant, each said ink chamber storing a respective one of said inks; and an ink supplying section through which one of said inks containing a colorant selected from said plurality of inks and said clear ink are supplied from said ink chambers, said ink supplying section being divided by said partitioning means to provide openings of different areas communicating with respective ones of said ink chambers so that a ratio of rates of supply of said inks from said respective ink chambers is determined in accordance with a ratio of the areas of said openings associated with said respective ink chambers, said ink supplying section supplying said inks at said ratio to provide a mixed ink.

19. An ink tank according to claim 18, further comprising an additional ink supplying section through which a given said ink is supplied from one of said ink chambers.

20. An ink tank according to claim 18, wherein said inks are supplied to a recording head comprising a heat energy generating means for applying heat to a particular one of said inks to form a bubble in said particular one of said inks, thereby causing said ink to be discharged from said recording head.

21. An ink tank for supplying inks to a recording head having a plurality of arrays of ink discharge openings each having a plurality of ink discharge openings, comprising, said ink tank having an interior and a bottom:

partitioning means for dividing said ink tank interior into a plurality of ink chambers for separately storing a plurality of type of inks, said ink tank having a plurality of ink supply holes formed in the bottom of said ink tank for supplying said plurality of types of inks therethrough, said ink supply holes being separated and divided by said partition means such that different said ink chambers have different areas of opening of said ink supply holes so that a ratio of rates of supply of said inks from said ink chambers is determined in accordance with a ratio of the areas of said openings of said ink supply holes associated with said ink chambers.

22. An ink tank according to claim 21, further comprising a plurality of ink absorption members disposed in respective said ink chambers.

23. An ink tank according to claim 22, wherein said ink supply holes supply said inks to said recording head.

24. An ink tank according to claim 21, wherein said plurality of types of inks have different levels of dye concentration.

25. An ink tank according to claim 21, wherein said plurality of types of inks contain different types of colorant.

26. An ink tank according to claim 21, wherein said different types of inks include a clear ink which does not contain a dye.

27. An ink jet recording apparatus according to claim 21, wherein said recording head comprises heat energy generating means for applying heat to a particular one of said inks to form a bubble of said particular one of said inks, thereby causing said ink to be discharged from said recording head.

28. An ink jet recording apparatus which performs recording by means of a plurality of recording heads, each said recording head having a plurality of ink discharge openings, comprising:

a plurality of ink storage means for storing a plurality of different kinds of inks, wherein each said ink contains a different type of colorant;

a clear ink storage means for storing a clear ink not containing a dye;

a plurality of first recording heads for discharging a color ink stored in said plurality of ink storage means;

a plurality of second recording heads for discharging a mixed ink of said clear ink and each of a plurality of inks stored in said plurality of ink storage means;

ink supplying means for supplying color inks stored in said plurality of ink storage means to a corresponding said recording head in said plurality of said first recording heads, and supplying said color ink and said clear ink to said second recording head in said plurality of said second recording heads; and mixing control means for controlling mixing of said inks by said ink supplying means to said second recording head in accordance with an image to be recorded.

29. An ink jet recording apparatus according to claim 28, wherein said mixing control means controls the inks which are mixed by said ink mixing means.

30. An ink jet recording apparatus according to claim 28, wherein said mixing control means controls a ratio of mixing of the inks selected which are mixed by said ink mixing means.

31. An ink jet recording apparatus according to claim 28, wherein said different inks include a clear ink which does not contain a dye.

32. An ink jet recording apparatus according to claim 28, wherein said different inks include a plurality of kinds of clear inks which have different compositions and each of which do not contain a dye.

33. An ink jet recording apparatus according to claim 28, wherein said recording head comprises heat energy generating means for applying heat to a particular one of said inks to form a bubble in said particular one of said inks, thereby causing said ink to be discharged from said recording head.

34. An ink jet recording apparatus which performs recording by means of a recording head, said recording head having at least one discharge opening, comprising:

an ink storage means for storing an ink, wherein said ink contains a colorant;

a clear ink storage means for storing a clear ink, wherein the clear ink does not contain a dye;

mixing ratio setting means for setting a ratio of said ink and said clear ink to be supplied to said recording head; and ink supplying means for supplying the ink stored in said ink storage means and said clear ink stored in said clear ink storage means to said recording head at a ratio in accordance with the set ratio.

35. An ink jet recording apparatus according to claim 34, wherein said ink supplying means comprises supply valves, and wherein said mixing ratio setting means is manually operated to set the ratio.

36. An ink jet recording apparatus according to claim 34, wherein said ink supplying means comprises a plurality of supply valves and a value control means for electromagnetically controlling said supply valves, and said mixing ratio setting means sets the ratio by means of said valve control means.

37. An ink jet recording apparatus according to claim 34, wherein said ink storage means has ink supply hole for supplying ink to said recording heads, and said clear ink storage means has an ink supply hole for supplying said clear ink to said recording head, and where the ratio of mixing of said ink and said clear ink is set in accordance with the ratio between area of supply holes of said ink storage means and said clear ink storage means which are for supplying ink to said recording head.

38. An ink jet recording apparatus according to claim 34, wherein said recording head comprises heat energy generating means for applying head energy to said mixed ink to form a bubble in said mixed ink, thereby causing said mixed ink to be discharged from said recording head.

39. An ink jet recording method which performs recording by means of a recording head, which has at least one discharge opening, comprising steps of:

storing an ink, wherein said ink contains a colorant;

storing a clear ink, wherein the clear ink does not contain a colorant;

setting a ratio of mixing of said ink with said clear ink;

supplying an ink and said clear ink to said recording head at said ratio set by said setting step and forming a mixed ink; and discharging said mixed ink through said recording head.

40. An ink jet recording method according to claim 39, further comprising the step of applying heat energy to a particular one of said mixed ink to form a bubble in said mixed ink, thereby discharging said ink from said recording head.

* * * * *

UNITED STATES PATENT AND TRADEMARK OFFICE

CERTIFICATE OF CORRECTION

PATENT NO. : 6,183,071 B1
DATED : February 6, 2001
INVENTOR(S) : Hitoshi Sugimoto, et al.

It is certified that error appears in the above-identified patent and that said Letters Patent is hereby corrected as shown below:

Title page,
Under [*], the following should be inserted:
-- Notice: This patent issued on a continued prosecution application filed under 37 CFR §1.53 (d), and is subject to the twenty year patent term provisions of 35 U.S.C. §154 (a) (2). --
Under Item [56], References Cited, U.S. PATENT DOCUMENTS, "Iwata" should read -- Iwata et al. --.
Under Item [56], References Cited, Foreign Patent Documents,
"403284954" should read -- 3-284954 -- and
"40-4338554" should read -- 4-338554 --.
Under Item [57], ABSTRACT, line 12, "a" should read -- as --.

Column 2,
Line 4, "of" (first occurrence) should be deleted.

Column 3,
Line 60, "duced" should read -- duce --.

Column 5,
Line 3, "heeds" should read -- heads --.

Column 7,
Line 16, "FIG. 28" should read -- FIG. 28; --.

Column 10,
Line 15, "miss-registration" should read -- misregistration --; and
Line 25, "a" should read -- as --.

Column 11,
Line 9, "adhesive," should read -- adhesion, --.

Column 14,
Line 24, "the" (first occurrence) should be deleted.

Column 16,
Line 16, "refereed" should read -- referred --.

Column 19,
Line 18, "371Kk" should read -- $371K_k$ --.

UNITED STATES PATENT AND TRADEMARK OFFICE

CERTIFICATE OF CORRECTION

PATENT NO. : 6,183,071 B1
DATED : February 6, 2001
INVENTOR(S) : Hitoshi Sugimoto, et al.

It is certified that error appears in the above-identified patent and that said Letters Patent is hereby corrected as shown below:

Column 28,
Line 5, "addition of" should read -- added --; and
Line 54, "is" should read -- are --.

Column 29,
Line 16, "b" should read -- be --.

Column 31,
Line 50, "relates" should read -- relate --.

Column 32,
Line 8, "to" (first occurrence) should be deleted.

Column 35,
Line 6, "said," should read -- said --;
Line 23, "stes" should read -- sets --; and
Line 65, "in" should read -- of -- and "of" (first occurrence) should read -- in --.

Column 37,
Line 5, "of" (second occurence) should read -- in --; and
Line 40, "type" should read -- types --.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*